US009811048B2

(12) United States Patent
Eto

(10) Patent No.: US 9,811,048 B2
(45) Date of Patent: Nov. 7, 2017

(54) IMAGE FORMING APPARATUS THAT RESTRAINS CONTACT FAILURE OF STORAGE UNIT

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/251,653

(22) Filed: Aug. 30, 2016

(65) Prior Publication Data

US 2017/0075297 A1 Mar. 16, 2017

(30) Foreign Application Priority Data

Sep. 10, 2015 (JP) ..... 2015-178254

(51) Int. Cl.
*G03G 21/16* (2006.01)
*G03G 15/08* (2006.01)

(52) U.S. Cl.
CPC ..... *G03G 21/1676* (2013.01); *G03G 15/0865* (2013.01); *G03G 21/1652* (2013.01)

(58) Field of Classification Search
CPC ..... G03G 21/1676; G03G 15/0865; G03G 21/1652
USPC ..... 399/119, 260
See application file for complete search history.

(56) References Cited

U.S. PATENT DOCUMENTS

2006/0193652 A1* 8/2006 Sato ..... G03G 15/0822 399/90
2011/0305467 A1* 12/2011 Umezawa ..... G03G 15/556 399/27
2012/0275820 A1 11/2012 Eto ..... 399/110
2014/0050502 A1* 2/2014 Tsuritani ..... G03G 15/0832 399/90

FOREIGN PATENT DOCUMENTS

JP 2012-230280 A 11/2012

* cited by examiner

*Primary Examiner* — Sandra Brase
(74) *Attorney, Agent, or Firm* — Stein IP, LLC

(57) ABSTRACT

An image forming apparatus includes an apparatus main body, an image carrier, a developing device, a developer housing container, and a connector. The connector includes a connector housing and elastically deformable second ground terminal and second input/output terminal. The connector housing includes an opening and an end edge. The end edge defines one side portion of the opening. The second ground terminal and the second input/output terminal are projected from the opening. The second ground terminal and the second input/output terminal contact the first ground terminal and the first input/output terminal, respectively by mounting the developer housing container to the internal space. The second ground terminal and the second input/output terminal each abut the end edges on the connector housing with elastic force. The abutment regulates a maximum amount of projection of the second ground terminal and the second input/output terminal with respect to the opening.

8 Claims, 43 Drawing Sheets

A-A

RIGHT ⟷ LEFT

IMAGE FORMING APPARATUS THAT RESTRAINS CONTACT FAILURE OF STORAGE UNIT

INCORPORATION BY REFERENCE

This application is based upon, and claims the benefit of priority from, corresponding Japanese Patent Application No. 2015-178254 filed in the Japan Patent Office on Sep. 10, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus that forms images on sheets, there has been known an image forming apparatus that includes an apparatus main body, a photoreceptor drum (an image carrier), a developing device, and a developer housing container. The developing device supplies the photoreceptor drum with a developer. This develops an electrostatic latent image on the photoreceptor drum. The developer housing container replenishes the developing device with the developer.

There has been disclosed a technique where a developer housing container is removably attachable to an apparatus main body. With the technique, a cover member on the apparatus main body is opened to mount a developer housing container inside the apparatus main body. When a developer discharge port on the developer housing container communicates with a developer replenishment port on the developing device, a developer is replenishable to the developing device.

There has been known a technique where the developer housing container includes an IC chip (a storage unit) for transmission and reception of predetermined information with the apparatus main body. As a communication method by which the IC chip transmits and receives information with the apparatus main body, a wireless or a contact communication method is employed.

SUMMARY

An image forming apparatus according to one aspect of the disclosure includes an apparatus main body, an image carrier, a developing device, a developer housing container, and a connector. The apparatus main body includes an openable/closable cover member and an internal space. The image carrier is located in the apparatus main body. The mage carrier has a circumference surface on which an electrostatic latent image is formed by rotationally driving the image carrier. The developing device includes a developer replenishment port to which a developer is replenished and a mounting portion. The developing device is mounted at a developing position with the cover member open. The developing position is opposed to the image carrier in the internal space. The developing device supplies the image carrier with the developer. The developer housing container includes a developer discharge port from which the developer is discharged and a storage unit. The developer housing container internally houses the developer. The developer housing container is mountable to the internal space selectably by a first mounting aspect or a second mounting aspect. The first mounting aspect mounts the developer housing container to the internal space integrally with the developing device with the cover member open. The developer housing container is preliminary mounted to the mounting portion of the developing device such that the developer discharge port communicates with the developer replenishment port. The second mounting aspect mounts the developer housing container to the mounting portion of the developing device preliminary mounted to the internal space with the cover member open such that the developer discharge port communicates with the developer replenishment port. The connector is located opposed to the developer housing container in the apparatus main body. The connector is electrically connected to the storage unit in the developer housing container. The developer housing container is mounted to the internal space in the first mounting aspect or the second mounting aspect. The storage unit includes a substrate, a first ground terminal, and a first input/output terminal exposed outside at the substrate. The connector includes a connector housing and elastically deformable second ground terminal and second input/output terminal. The connector housing includes an opening and an end edge. The end edge defines one side portion of the opening. The elastically deformable second ground terminal and second input/output terminal are projected from the opening. The second ground terminal and the second input/output terminal contacts the first ground terminal and the first input/output terminal, respectively, by mounting the developer housing container to the internal space. The second ground terminal and the second input/output terminal each abut the end edges on the connector housing with elastic force, the abutment regulating a maximum amount of projection of the second ground terminal and the second input/output terminal with respect to the opening.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
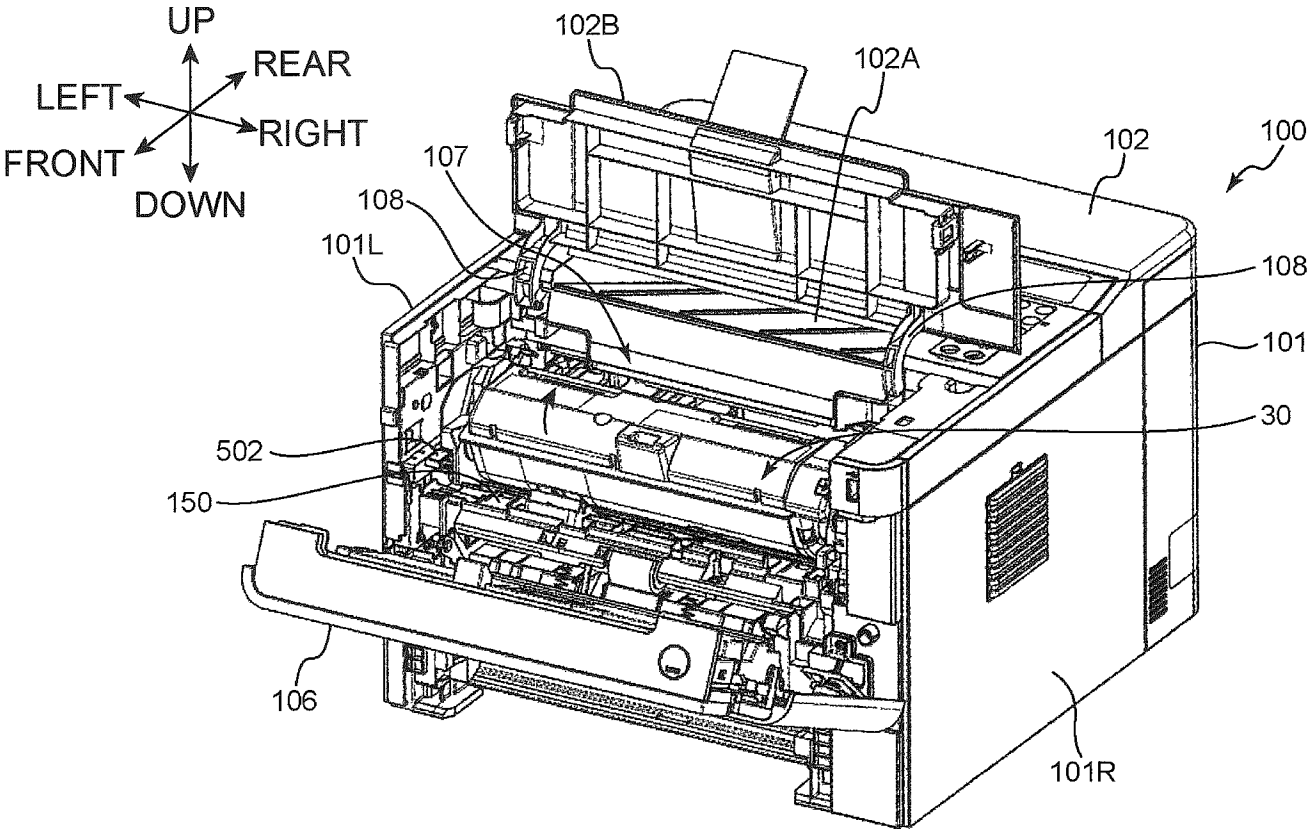
FIG. 1 obliquely illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
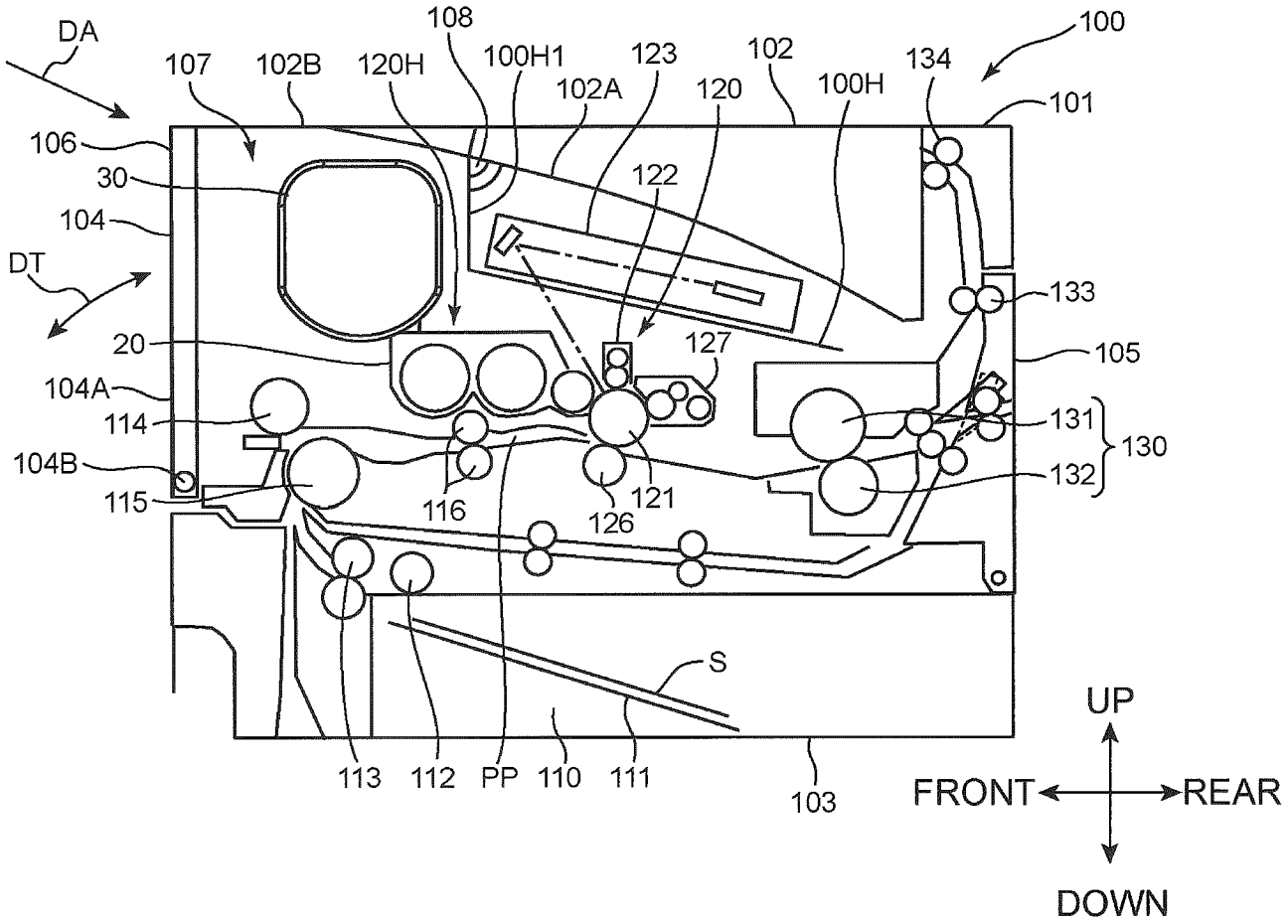
FIG. 2 illustrates a cross section inside the image forming apparatus according to the one embodiment.

Referring to the drawings, the following describes one embodiment of the disclosure. FIG. 1 obliquely illustrates a printer 100 (an image forming apparatus) according to the embodiment. FIG. 2 schematically illustrates a cross section of the internal structure of the printer 100. While the printer 100 illustrated in FIGS. 1 and 2 is, what is called, a black-and-white printer, the image forming apparatus may be a color printer, a facsimile device, a multi-functional peripheral that includes these functions, and other apparatuses for forming toner images on sheets in other embodiments. In the following description, directional terms like "up," "down," "front," "rear," "left," and "right" are simply used for clarifying the description without limiting principles of the image forming apparatus.

The printer 100 includes a housing 101 (an apparatus main body) that houses various devices for forming images on a sheet S. The housing 101 includes an upper wall 102 defining the top surface of the housing 101, a bottom wall 103 defining the bottom surface of the housing 101, a main-body rear wall 105 between the upper wall 102 and the bottom wall 103, and a main-body front wall 104 located in front of the main-body rear wall 105. The housing 101 includes a main-body internal space 107 (an internal space) where various kinds of devices are arranged. In the main-body internal space 107 of the housing 101, a sheet conveyance path PP that conveys the sheet S in a predetermined conveyance direction runs. The housing 101 includes a pair of a left-side wall 101L and a right-side wall 101R (FIG. 1). The left-side wall 101L and the right-side wall 101R are wall portions that form the left and right side surfaces of the housing 101.

In the center of the upper wall 102, a paper sheet discharge unit 102A is arranged. The paper sheet discharge unit 102A has an inclined surface inclining downward from the front portion toward the rear portion of the upper wall 102. The sheet S with images formed in an image forming unit 120, which will be described later, is discharged into the paper sheet discharge unit 102A. In the main-body front wall 104, a front cover 106 (a cover member) and a manual bypass tray 104A are arranged. The front cover 106 and the manual bypass tray 104A are vertically openable/closable using respective lower end sides as fulcrums (an arrow DT in FIG. 2). The manual bypass tray 104A is turnable with respect to the front cover 106. The manual bypass tray 104A includes a tray fulcrum 104B, which serves as the fulcrum. FIG. 1 illustrates a state where the front cover 106 including the manual bypass tray 104A is open to the housing 101.

With a closed state with respect to the housing 101, the front cover 106 and the manual bypass tray 104A constitute a part of the main-body front wall 104.

On the other hand, a front end portion 102B of the upper wall 102 is turnable rearward with an arm 108 as a fulcrum (FIG. 1). As illustrated in FIG. 1, when the front end portion 102B of the upper wall 102 and the front cover 106 are each opened, the main-body internal space 107 is exposed outside the printer 100. This results in that a developer unit 120H and a toner container 30, which will be described later, are attachable inside the housing 101. When the sheet S gets stuck in the sheet conveyance path PP, the sheet S will become removable.

Referring to FIG. 2, the printer 100 includes a cassette 110, a pickup roller 112, a first feed roller 113, a second feed roller 114, a conveyance roller 115, a registration roller pair 116, the image forming unit 120, and a fixing unit 130.

The cassette 110 internally houses the sheets S. The cassette 110 includes a lift plate 111. The lift plate 111 inclines so as to push up the leading edge of the sheet S. The cassette 110 is extractable forward with respect to the housing 101.

The pickup roller 112 is arranged on the leading edge of the sheet S pushed up by the lift plate 111. Rotation of the pickup roller 112 pulls the sheet S out of the cassette 110.

The first feed roller 113 is located in the downstream side of the pickup roller 112 and further sends out the sheet S downstream. The second feed roller 114 is located in the inside (the rear side) of the fulcrum of the manual bypass tray 104A and pulls the sheet S on the manual bypass tray 104A inside the housing 101.

The conveyance roller 115 is located in the downstream side (hereinafter also simply referred to as a downstream) of a sheet conveyance direction (hereinafter also simply referred to as a conveyance direction) of the first feed roller 113 and the second feed roller 114. The conveyance roller 115 further conveys the sheet S, which is sent out by the first feed roller 113 and the second feed roller 114, downstream.

The registration roller pair 116 has a function of correcting an oblique conveyance of the sheet S. This adjusts a position of an image to be formed on the sheet S. The registration roller pair 116 supplies the image forming unit 120 with the sheet S in accordance with timing of the image formation by the image forming unit 120.

The image forming unit 120 includes a photoreceptor drum 121 (an image carrier), a charger 122, an exposure apparatus 123, a developing device 20, the toner container 30 (the developer housing container), a transfer roller 126, and a cleaning apparatus 127. As will be described later, the developing device 20 and the toner container 30 are integrally removably attachable with respect to the housing 101 as the developer unit 120H.

The photoreceptor drum 121 has a cylindrical shape and is rotatably supported by the housing 101. The photoreceptor drum 121 has a circumference surface where an electrostatic latent image is formed and carries a toner image (a developer image) corresponding to this electrostatic latent image on the circumference surface. The charger 122 applied with a predetermined voltage causes the circumference surface of the photoreceptor drum 121 to be approximately evenly charged.

The exposure apparatus 123 irradiates the circumference surface of the photoreceptor drum 121 charged by the charger 122 with a laser beam. This laser beam is irradiated in accordance with image data output from an external device (not illustrated) such as a personal computer communicatively connected to the printer 100. This results in forming the electrostatic latent image corresponding to the image data on the circumference surface of the photoreceptor drum 121. The exposure apparatus 123 is supported by a support frame 100H (FIG. 2). The support frame 100H is a frame located inside the housing 101. The support frame 100H is located along the paper sheet discharge unit 102A inclined downward toward the rear. A frame front wall 100H1 is located upright at the front end portion of the support frame 100H. The frame front wall 100H1 is a wall portion extending in a vertical direction immediately below the paper sheet discharge unit 102A. The frame front wall 100H1 is located opposed to the toner container 30 (FIG. 2).

The developing device 20 supplies toner to the circumference surface of the photoreceptor drum 121 on which the electrostatic latent image is formed. The toner container 30 internally houses the toner and replenishes the toner to the developing device 20. The toner container 30 is located to be removably attachable with respect to the developing device 20. Supplying the toner to the photoreceptor drum 121 by the developing device 20 develops (visualizes) the electrostatic latent image formed on the circumference surface of the photoreceptor drum 121. This results in forming the toner image (the developer image) on the circumference surface of the photoreceptor drum 121.

The transfer roller 126 is arranged facing the photoreceptor drum 121 while sandwiching the sheet conveyance path PP under the photoreceptor drum 121. The transfer roller 126 forms a transfer nip portion with the photoreceptor drum 121 and transfers the toner image to the sheet S.

The cleaning apparatus 127 removes the toner left on the circumference surface of the photoreceptor drum 121 after the toner image has been transferred to the sheet S.

The fixing unit 130 is arranged in the downstream side of the conveyance direction with respect to the image forming unit 120 and fixes the toner image on the sheet S. The fixing unit 130 includes a heating roller 131 that melts the toner on the sheet S and a pressure roller 132 that causes the sheet S to be brought into close abutment on the heating roller 131.

The printer 100 further includes a conveyance roller pair 133 located in the downstream side of the fixing unit 130 and a discharge roller pair 134 located in the downstream side of the conveyance roller pair 133. The sheet S is conveyed upward by the conveyance roller pair 133 and is finally discharged out of the housing 101 by the discharge roller pair 134. The sheet S discharged out of the housing 101 is stacked on the paper sheet discharge unit 102A.

Structure of Developer Unit

Figure 3:
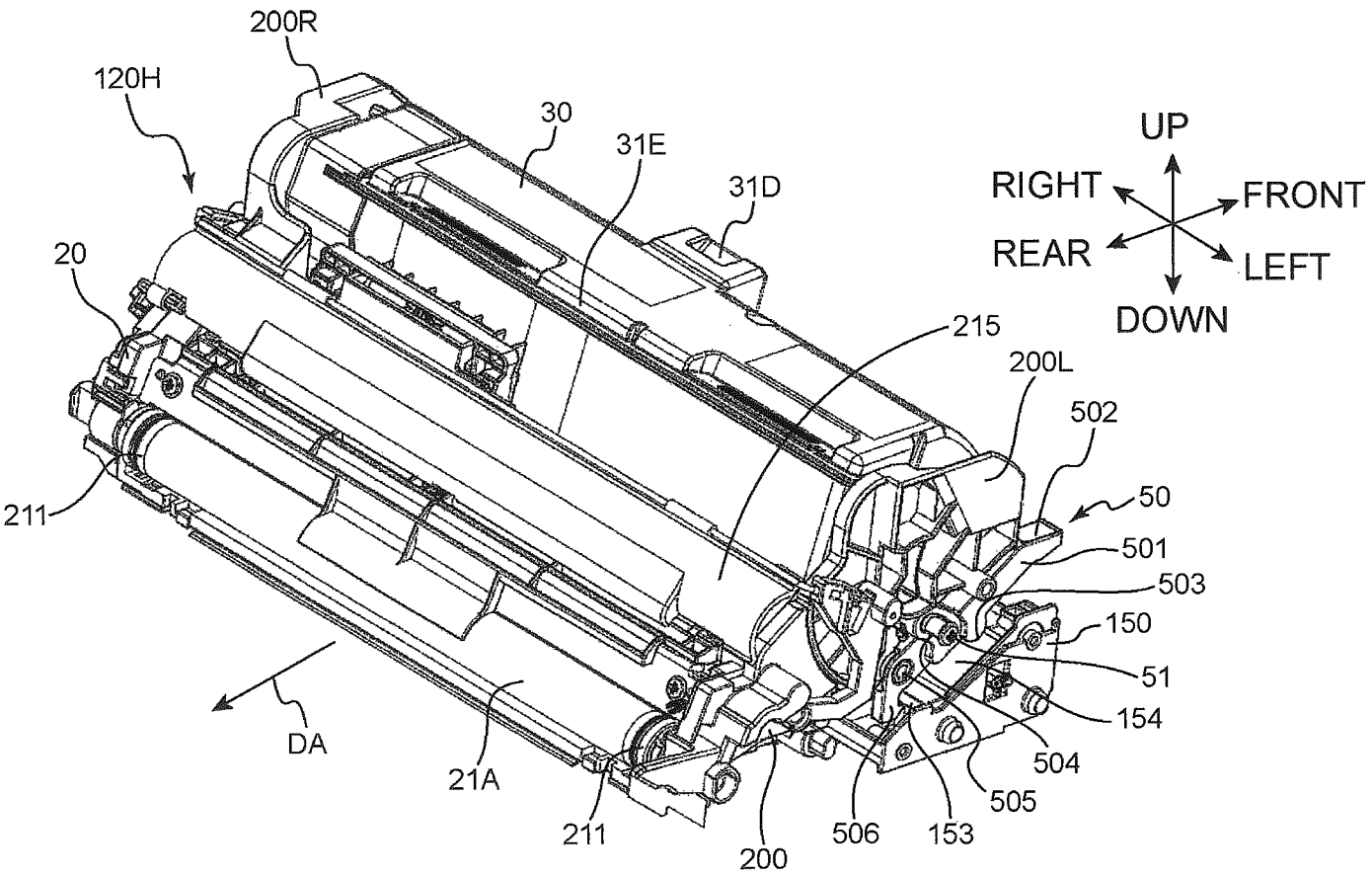
FIG. 3 obliquely illustrates a developer unit and a guiding portion according to the one embodiment.
Figure 4A:
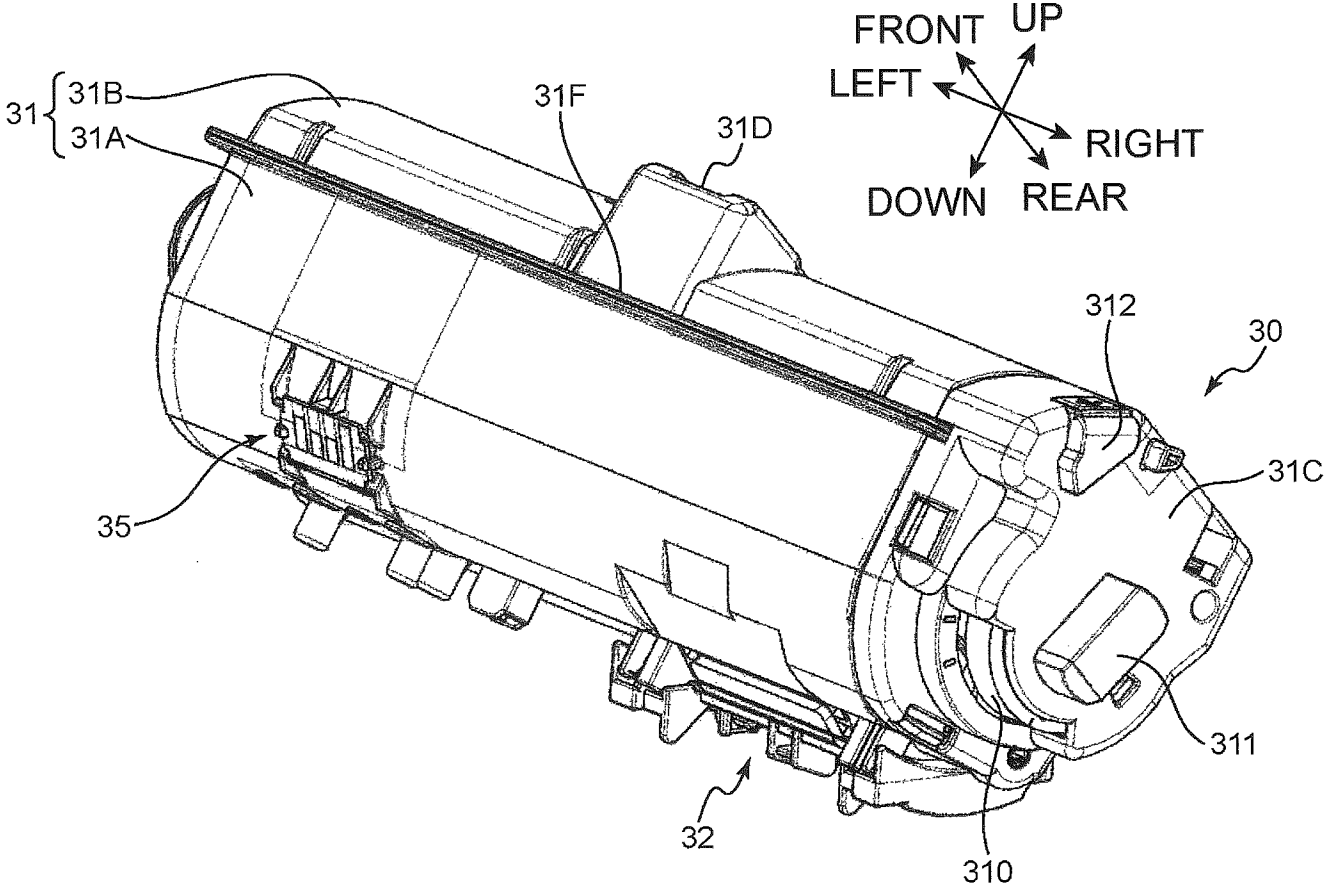
FIG. 4A obliquely illustrates a developer housing container according to the one embodiment.
Figure 4B:
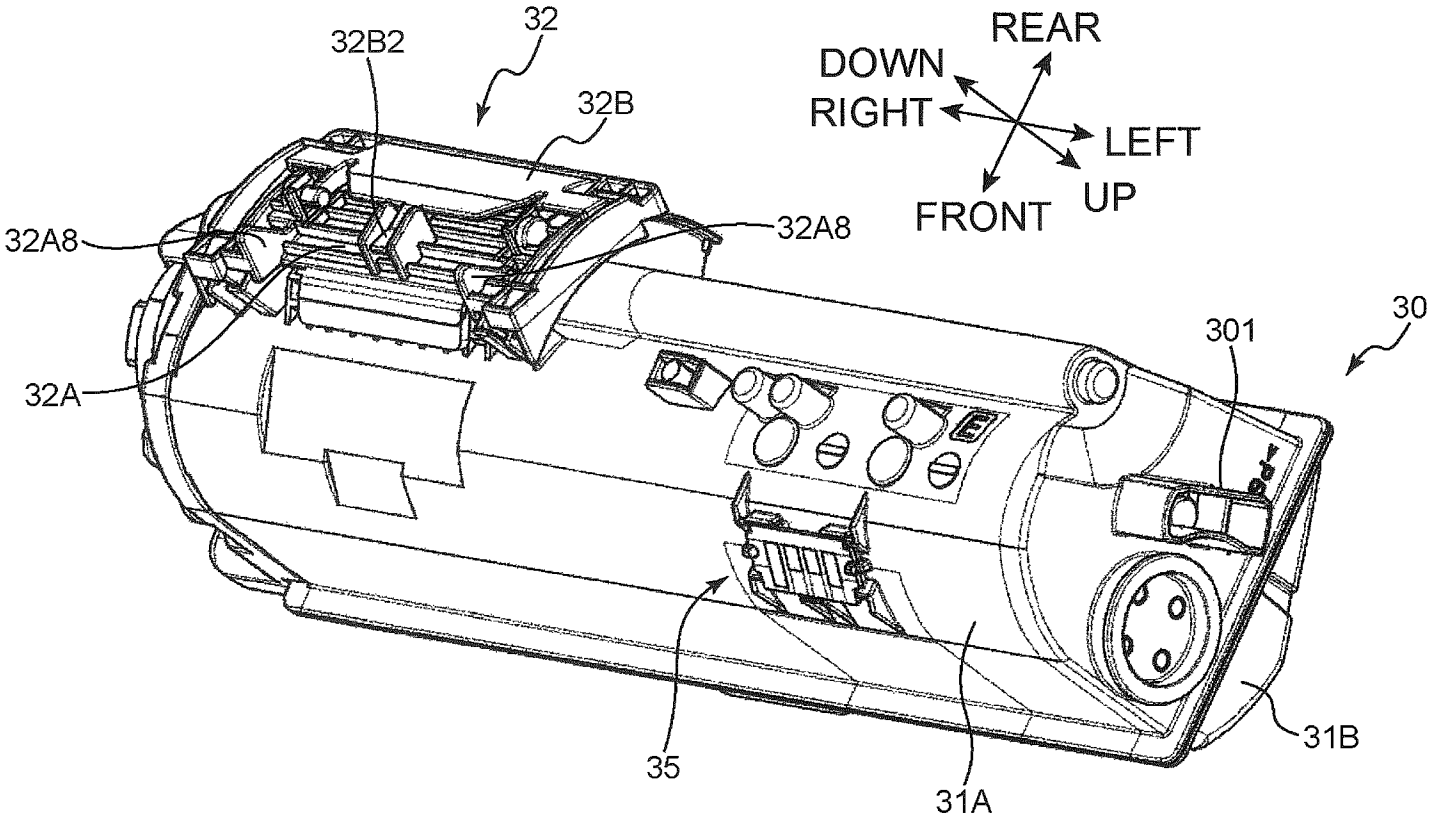
FIG. 4B obliquely illustrates the developer housing container according to the one embodiment.
Figure 5:
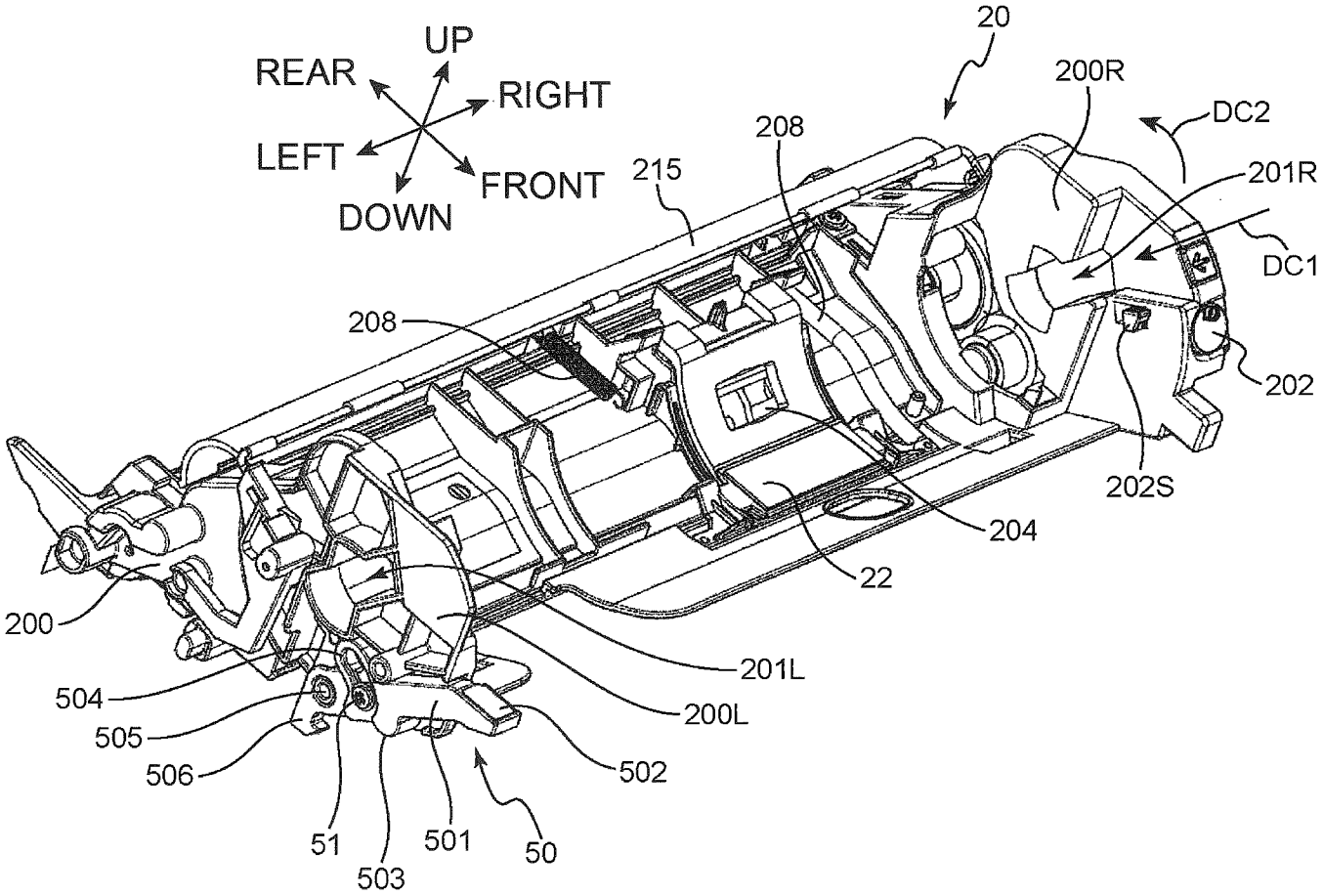
FIG. 5 obliquely illustrates a developing device according to the one embodiment.
Figure 6:
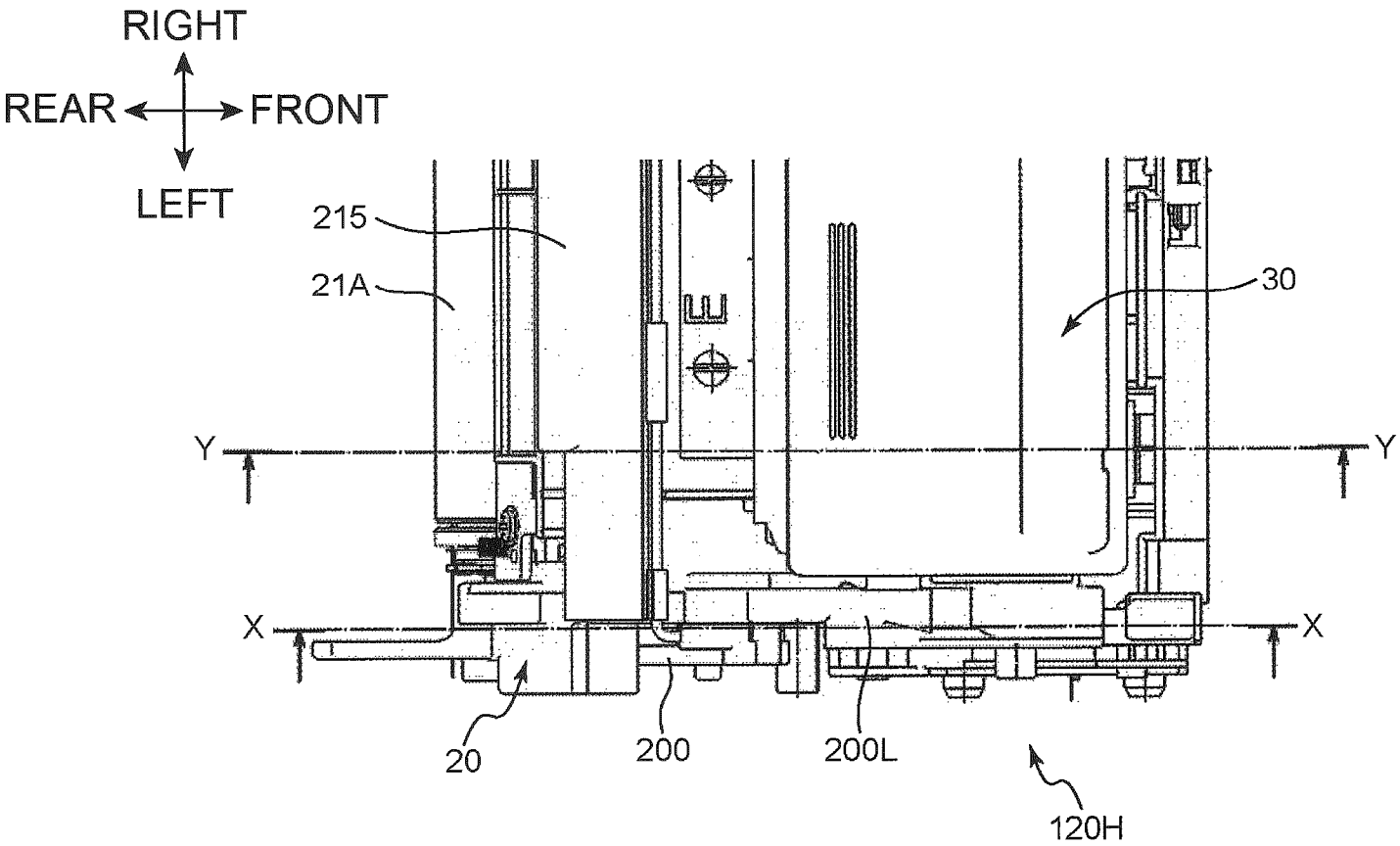
FIG. 6 illustrates a part of a top surface of the developer unit according to the one embodiment.

Next, referring to FIGS. 3 to 10, the following describes in detail the developer unit 120H (the developing device 20 and the toner container 30) according to the embodiment. FIG. 3 obliquely illustrates the developer unit 120H and a main body unit 150 (a part of the housing 101), which will be described later, according to the embodiment. FIGS. 4A and 4B obliquely illustrate the toner container 30 according to the embodiment. FIG. 5 obliquely illustrates the developing device 20 according to the embodiment. FIG. 6 illustrates a part of the top surface of the developer unit 120H. FIGS. 7 to 10 illustrate cross sections of the developer unit 120H and the main body unit 150. The respective cross-sectional views of FIGS. 7 and 8 correspond to the cross-sectional view at X-X line in FIG. 6, and the respective cross-sectional views of FIGS. 9 and 10 correspond to the cross-sectional view at Y-Y line in FIG. 6.

As described above, the developer unit 120H (FIG. 3) includes the developing device 20 and the toner container 30. The developer unit 120H is removably attachable along a predetermined attachment/detachment direction with respect to the housing 101. This results in that the toner container 30 is attachable to the housing 101, integrally with the developing device 20. When the developing device 20 is first mounted to the housing 101, the toner container 30 is independently mounted to the developing device 20 inside the housing 101. An arrow DA in FIGS. 2 and 3 indicates an attachment direction of the developer unit 120H relative to the housing 101.

Figure 7:
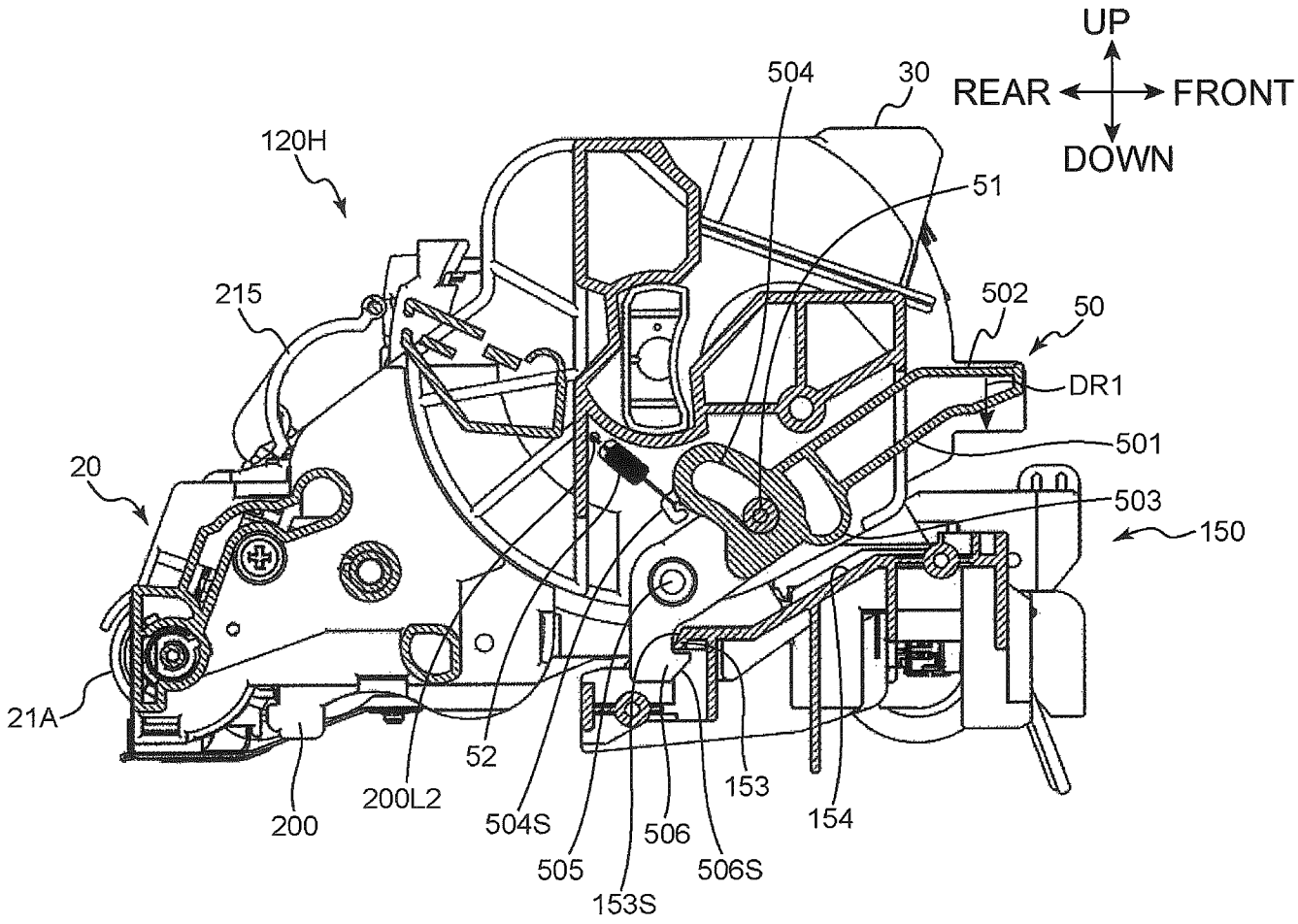
FIG. 7 illustrates a cross section of the developer unit and the guiding portion according to the one embodiment.

Further, the printer 100 includes the main body unit 150 (the guide portion) as illustrated in FIGS. 3 and 7. The main body unit 150 is arranged in the housing 101 and guides an entrance and attachment/detachment of the developer unit 120H (the developing device 20) to/from the main-body internal space 107. As illustrated in FIG. 1, opening the front cover 106 with respect to the housing 101 exposes the main body unit 150 outside the housing 101. The developer unit 120H is mounted in the main-body internal space 107 of the housing 101 such that the developer unit 120H passes through over the main body unit 150. As it appears in FIG. 3, the main body unit 150 has an approximately triangular shape from the side view and is a unit extending long in the lateral direction. The main body unit 150 includes positioning mechanisms 150S (FIG. 9), an engaged portion 153 (FIGS. 3 and 7), and a guide surface 154.

A pair of the positioning mechanisms 150S are arranged at both the end portions in the lateral direction of the main body unit 150. The positioning mechanism 150S includes a urging protrusion 151 and a unit urging spring 152. The urging protrusion 151 is brought into abutment on a housing pressed portion 200K (FIG. 9) of the developer unit 120H mounted to the housing 101. The unit urging spring 152 urges the urging protrusion 151 toward the rear. In other words, the positioning mechanism 150S including the unit urging spring 152 urges the developer unit 120H that is mounted at a developing position inside the housing 101 toward the rear, and thus positions the developer unit 120H.

The guide surface 154 (FIG. 7) is formed on the top surface portion of the main body unit 150. The guide surface 154 has a function of guiding the attachment of the developer unit 120H. The guide surface 154 has an inclined surface extending downward from the front toward the rear. Of the guide surface 154, the further rear end side of this inclined surface is configured to be a horizontal surface. The engaged portion 153 is arranged in the distal end side of the attachment direction (the arrow DA direction in FIG. 3) of the developer unit 120H with respect to the guide surface 154. A hook 506 (FIG. 7) of a lock lever 50, which will be described later, is engageable with the engaged portion 153.

Referring to FIG. 4A, the toner container 30 houses toner (developer) inside. The toner container 30 includes a container main body 31 and a container cover 31C. The container main body 31 has a shape extending in the lateral direction (the longitudinal direction). The container main body 31 includes a main unit 31A and a lid portion 31B. The main unit 31A defines a lower part of the container main body 31. The top surface portion of the container main unit 31A has an opening.

The lid portion 31B is secured to the main unit 31A such that the lid portion 31B covers the opening of the main unit 31A. In the embodiment, the lid portion 31B is welded and fixed to the main unit 31A. The main unit 31A and the lid portion 31B are secured at a container flange 31F, which is formed along a peripheral edge of the opening of the main unit 31A. The lid portion 31B includes a first grip portion 31D and a second grip portion 31E (FIG. 3). When the toner container 30 is mounted to the developing device 20 or when the developer unit 120H, which includes the toner container 30 and the developing device 20, is mounted to the housing 101, an operator is allowed to grip the first grip portion 31D and the second grip portion 31E.

The container cover 31C is mounted in the right side portion of the container main body 31. The container cover 31C includes a right-side guide 311, a transmission gear 310, and a lock engaging portion 312. The main unit 31A of the container main body 31 includes a left-side guide 301. The right-side guide 311 is a guide that is located to protrude from the container cover 31C and has an approximately rectangular parallelepiped shape. The left-side guide 301 with a shape identical to the right-side guide 311 is included in the side portion on the left side of the toner container 30 (FIG. 4B). These guides guide the attachment of the toner container 30 to the developing device 20. The transmission gear 310 is a gear that transmits a rotary drive power to a container paddle 30K, which will be described later. The lock engaging portion 312 is a protrusion projected from the container cover 31C on a right-side surface of the container cover 31C spaced from the right-side guide 311. In a cross-sectional view intersecting with the lateral direction, the lock engaging portion 312 has an approximately trapezoidal shape. The lock engaging portion 312 is engageable with a lock abutment piece 202S (FIG. 5).

Figure 9:
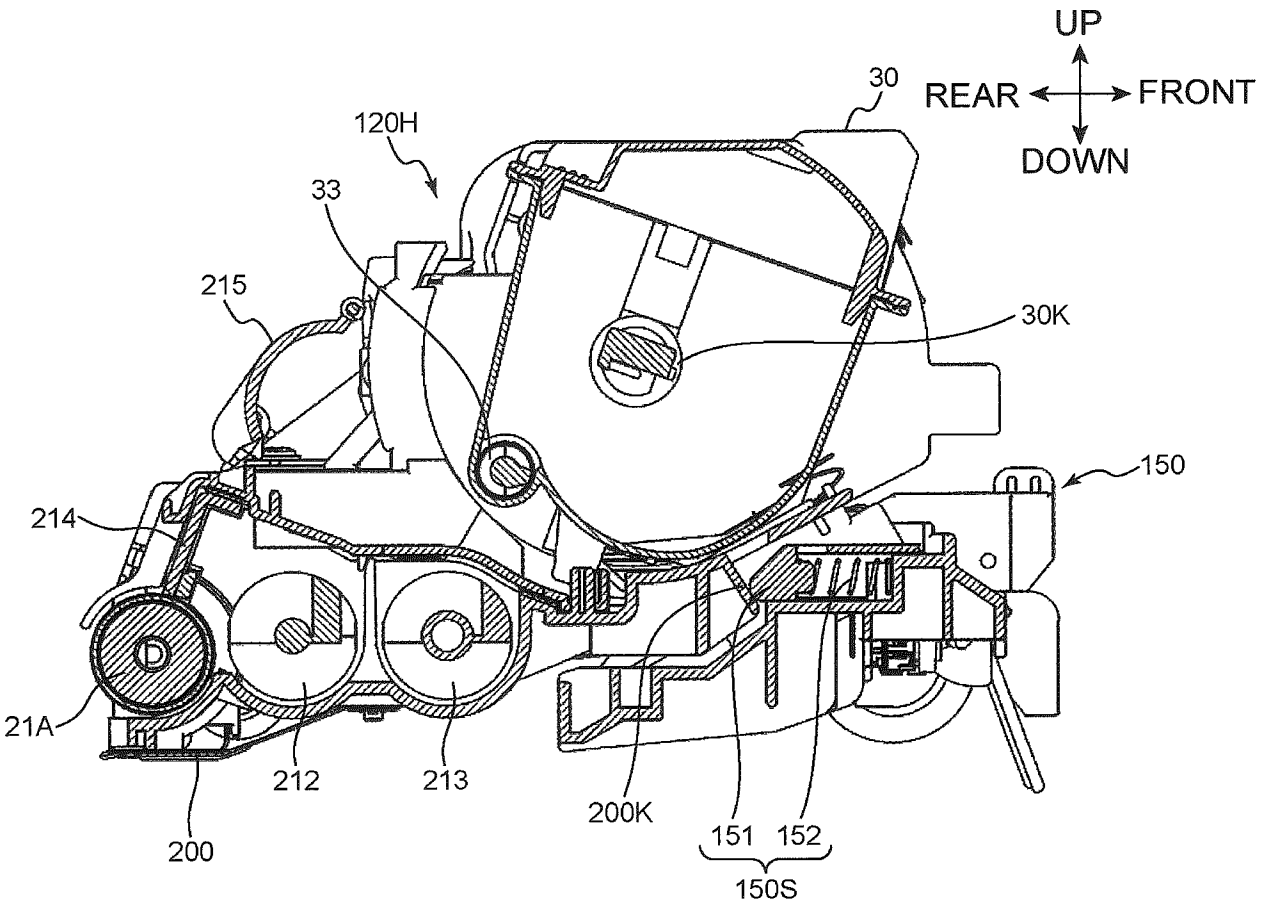
FIG. 9 illustrates a cross section of the developer unit and the guiding portion according to the one embodiment.

Further, the toner container 30 includes a container screw 33 and the container paddle 30K (FIG. 9).

The container screw 33 is a screw arranged along the bottom portion of the main unit 31A. The bottom portion of the main unit 31A has a toner discharge port 30P (FIG. 11B), which will be described later, with an opening. The container screw 33 is rotationally driven and conveys the toner inside the container main body 31 to the toner discharge port 30P. Slidingly moving a container shutter 32 (FIG. 11A), which will be described later, included in the container main body 31 opens the toner discharge port 30P and ensures discharge of the toner from the toner container 30. The container paddle 30K is rotatably supported inside the toner container 30 and stirs the toner housed inside the toner container 30.

The developing device 20 includes a development housing 200 (FIG. 3), a developing roller 21A (FIGS. 3 and 9), an abutting roller 211 (FIG. 3), a first screw 212 (FIG. 9), a second screw 213 (FIG. 9), a layer thickness regulating member 214 (FIG. 9), and a developing-roller cover 215.

The development housing 200 is a housing that supports the respective members of the developing device 20. The development housing 200 has a function to support the toner container 30. Referring to FIG. 5, the development housing 200 includes a housing-left-side wall 200L, a housing-right-side wall 200R, and a toner replenishment port 204 (a developer replenishment port). The housing-left-side wall 200L and the housing-right-side wall 200R are wall portions located upright from both the end portions in the lateral direction of the development housing 200. The toner container 30 is mounted between the housing-left-side wall 200L and the housing-right-side wall 200R.

The housing-right-side wall 200R includes a right-side guide groove 201R, the lock abutment piece 202S, and a lock button 202. The housing-left-side wall 200L includes a left-side guide groove 201L. The right-side guide groove 201R and the left-side guide groove 201L are guide grooves formed in the housing-right-side wall 200R and the housing-left-side wall 200L, respectively. These guide grooves are formed along the attachment direction (an arrow DC1 in FIG. 5) of the toner container 30 relative to the development housing 200. The above-described right-side guide 311 (FIG. 4A) of the toner container 30 enters the right-side guide groove 201R. The left-side guide 301 (FIG. 4B) included in the left side surface of the toner container 30 enters the left-side guide groove 201L. The toner container 30 is turned in an arrow DC2 direction in FIG. 5 after inserted over the development housing 200. This results in that the toner discharge port 30P of the toner container 30 faces the toner replenishment port 204, and this ensures toner (developer) replenishment to the developing device 20 from the toner container 30. The far-sides of the left-side guide groove 201L and the right-side guide groove 201R have a fan shape (FIG. 5) to allow the rotations of the left-side guide 301 and the right-side guide 311. The following further describes an attachment structure of the toner container 30 to the development housing 200 in the developing device 20 in detail.

The lock abutment piece 202S locks the lock engaging portion 312 (FIG. 4A) to lock the toner container 30 turned in the arrow DC2 direction. Pressing the lock button 202 releases the engagement of the lock abutment piece 202S and the lock engaging portion 312, releasing the lock of the toner container 30. This turns the toner container 30 in a direction opposite to the arrow DC2 direction in FIG. 5. This results in that the toner container 30 is detachable from the developing device 20 in a direction opposite to the arrow DC1 direction.

The developing roller 21A is rotatably supported by the development housing 200. The developing roller 21A carries developer constituted of toner on its circumference surface. The developing roller 21A supplies the toner to the photoreceptor drum 121 and develops the electrostatic latent image on the photoreceptor drum 121. A pair of the abutting rollers 211 are arranged at both the end portions in the axial direction of the developing roller 21A. The abutting roller 211 holds a constant interval between the developing roller 21A and the photoreceptor drum 121 by being brought into abutment on the circumference surface of the photoreceptor drum 121. The first screw 212 and the second screw 213 are screws rotatably supported inside the development housing 200. The developer inside the development housing 200 is circulatory conveyed by the first screw 212 and the second screw 213. The developer is supplied to the developing roller 21A by the first screw 212. The layer thickness regulating member 214 regulates a layer thickness of the developer supplied on the developing roller 21A. The developing-roller cover 215 is configured to be swingable with respect to the development housing 200. FIG. 3 illustrates a state where the developing-roller cover 215 has retreated over the developing roller 21A. Swinging the developing-roller cover 215 downward from the state illustrated in FIG. 3 ensures that the developing-roller cover 215 covers the developing roller 21A. Consequently, this prevents a foreign object from adhering on the developing roller 21A and prevents the peripheral area from being stained by the toner on the developing roller 21A when the developer unit 120H is detached from the housing 101.

Further, the developing device 20 includes the lock lever 50 (FIGS. 3 and 5). The lock lever 50 is swingably located in the housing-left-side wall 200L of the developing device 20. The lock lever 50 takes a lock posture and a release posture. In the lock posture, the lock lever 50 locks the developer unit 120H (the developing device 20) at a developing position, which will be described later, inside the housing 101. In the release posture, the lock lever 50 releases the lock of the developer unit 120H and allows detachment of the developer unit 120H from the housing 101 along the predetermined attachment/detachment direction. The posture is changeable between the lock posture and the release posture.

Referring to FIGS. 3, 5, and 7, the lock lever 50 includes a lever main body 501, a lever pressed portion 502, an abutting portion 503, a guide groove 504, a fulcrum 505, and the hook 506.

The lever main body 501 is a main body portion of the lock lever 50 and, as illustrated in FIG. 7, is arranged so as to obliquely extend from the front and upper side toward the rear and lower side. The lever pressed portion 502 is a flat portion provided on the upper end portion of the lever main body 501. The lever pressed portion 502 is pressed by an operator before the developer unit 120H is detached from the housing 101. The abutting portion 503 has a circular arc shape protruding downward, in the approximately center portion in the front-rear direction of the lock lever 50. As illustrated in FIGS. 3 and 7, mounting the developer unit 120H inside the housing 101 arranges that the abutting portion 503 faces the guide surface 154 of the main body unit 150. The guide groove 504 is a groove portion that opens in the rear of the abutting portion 503. The guide groove 504 opens so as to form a circular arc shape centered upon the fulcrum 505. The rear side of the guide groove 504 includes a lever-side lock portion 504S. The lever-side lock portion 504S has a hook shape located to protrude from the lock lever 50. One end of a lever-urging spring 52, which will be described later, is engagingly locked to the lever-side lock portion 504S.

The fulcrum 505 is arranged in the rear end side of the lock lever 50. The fulcrum 505 is rotatably supported by the housing-left-side wall 200L of the development housing 200. The fulcrum 505 is a fulcrum in swing of the lock lever 50. The above-described abutting portion 503 is arranged between the fulcrum 505 and the lever pressed portion 502 (FIG. 7). The hook 506 is arranged in the opposite side to the lever pressed portion 502 with respect to the fulcrum 505. The hook 506 is engageable with the engaged portion 153 (FIG. 7) of the main body unit 150. As illustrated in FIG. 7, the hook 506 extends downward from the fulcrum 505, and its distal end portion is bent forward (to the rear end side in the attachment direction of the developer unit 120H).

Further, the developing device 20 includes a guide screw 51 and the lever-urging spring 52 (FIG. 7). The guide screw 51 is inserted into the guide groove 504 and is a screw fastened to the housing-left-side wall 200L. The guide screw 51 has a function to guide the swing of the lock lever 50 along the guide groove 504.

The lever-urging spring 52 is a spring member that expands and contracts between the housing-left-side wall 200L of the development housing 200 and the lock lever 50. The above-described housing-left-side wall 200L includes a housing-side lock portion 200L2. As illustrated in FIG. 7, one end of the lever-urging spring 52 is engagingly locked to the lever-side lock portion 504S of the lock lever 50, and the other end of the lever-urging spring 52 is engagingly locked to the housing-side lock portion 200L2. This results in that the lever-urging spring 52 urges the lock lever 50 around the fulcrum 505 such that the hook 506 engagingly locks to the engaged portion 153 (FIG. 7).

Attachment/Detachment of Developer Unit

Next, the attachment/detachment of the developer unit 120H relative to the housing 101 will be described. As described above, the developer unit 120H is constituted of the developing device 20 and the toner container 30. The toner container 30 is removably attachable with respect to the developing device 20. The developer unit 120H is attachable to the housing 101 even with only the developing device 20 without including the toner container 30. Here, a description will be given of a state where the developer unit 120H including the toner container 30 is mounted and detached relative to the housing 101.

As illustrated in FIG. 1, when the front cover 106 of the housing 101 and the front end portion 102B of the upper wall 102 are opened, the developer unit 120H is mounted in the main-body internal space 107 of the housing 101. In this case, the developer unit 120H is inserted into the main-body internal space 107 along the arrow DA direction in FIGS. 2 and 3. The main body unit 150 (FIG. 3) guides the lower portion of the developer unit 120H. In accordance with the attachment of the developer unit 120H, the hook 506 of the lock lever 50 moves rearward sliding on the guide surface 154. Afterward, an inclined surface 506S (FIG. 7) of the hook 506 slidingly rubs against an inclined surface 153S of the engaged portion 153. In this case, in FIG. 7, slight clockwise turning of the hook 506 around the fulcrum 505 causes the distal end portion of the hook 506 to enter the lower side of the engaged portion 153 while the developer unit 120H moves downward. This results in that the hook 506 engages with the engaged portion 153, and the developer unit 120H is locked at the developing position illustrated in FIG. 7. At the developing position, the developing roller 21A of the developing device 20 is located facing the photoreceptor drum 121 with a predetermined interval. The posture of the lock lever 50 in FIG. 7 is defined as the lock posture of the lock lever 50. In this case, as illustrated in FIG. 9, the housing pressed portion 200K of the development housing 200 is pressed rearward by the urging protrusion 151 of the positioning mechanism 150S. That is, the positioning mechanism 150S urges the developer unit 120H toward a direction where the developing roller 21A approaches the photoreceptor drum 121. Then, positioning the developer unit 120H at the developing position in FIGS. 7 and 9 in the housing 101 causes the abutting roller 211 (FIG. 3) to be brought into abutment on the circumference surface of the photoreceptor drum 121 and thus arranges the developing roller 21A at a predetermined interval with respect to the photoreceptor drum 121. This results in stable supply of toner from the developing roller 21A to the photoreceptor drum 121 and formation of toner images on the photoreceptor drum 121.

Figure 8:
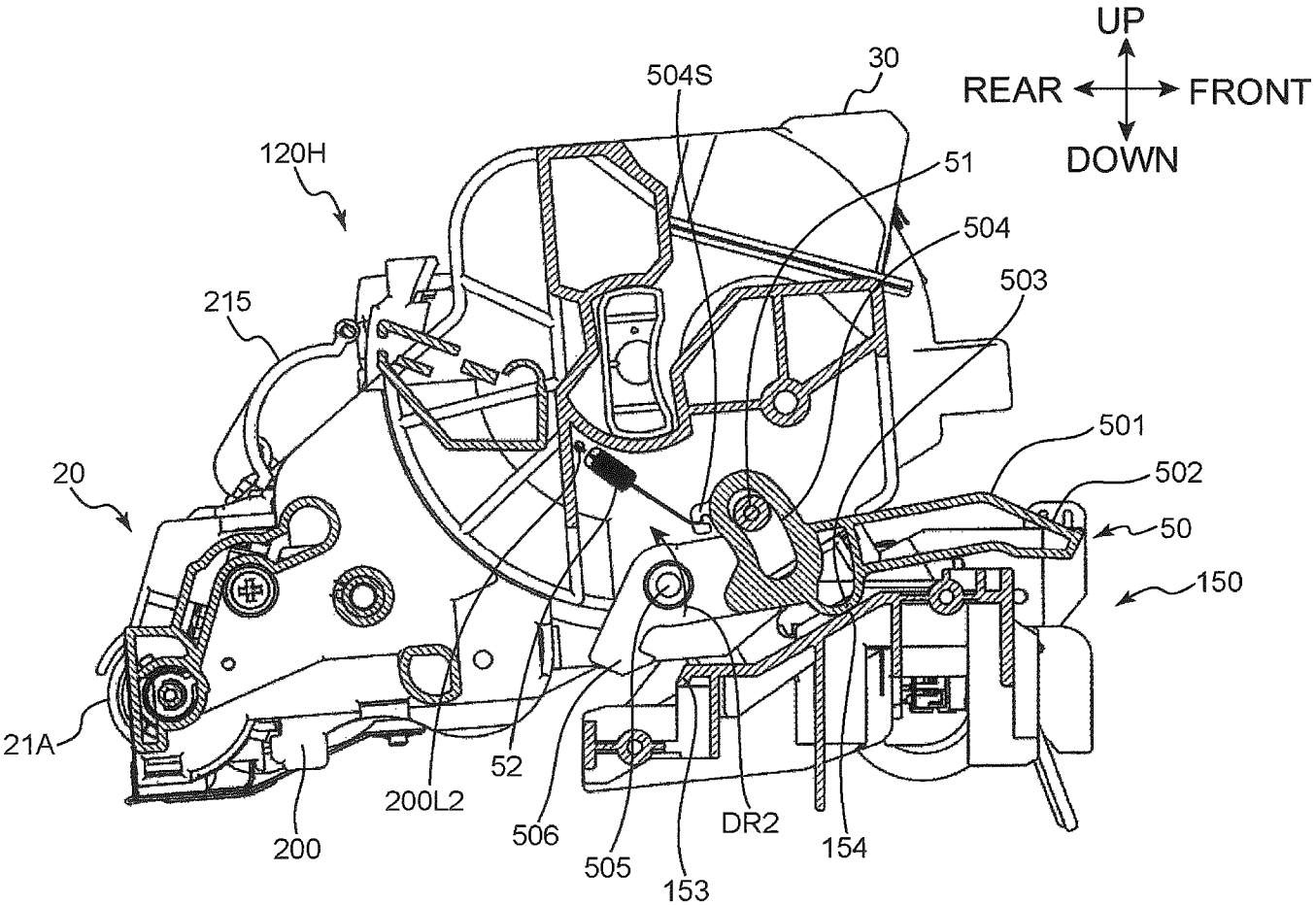
FIG. 8 illustrates a cross section of the developer unit and the guiding portion according to the one embodiment.
Figure 10:
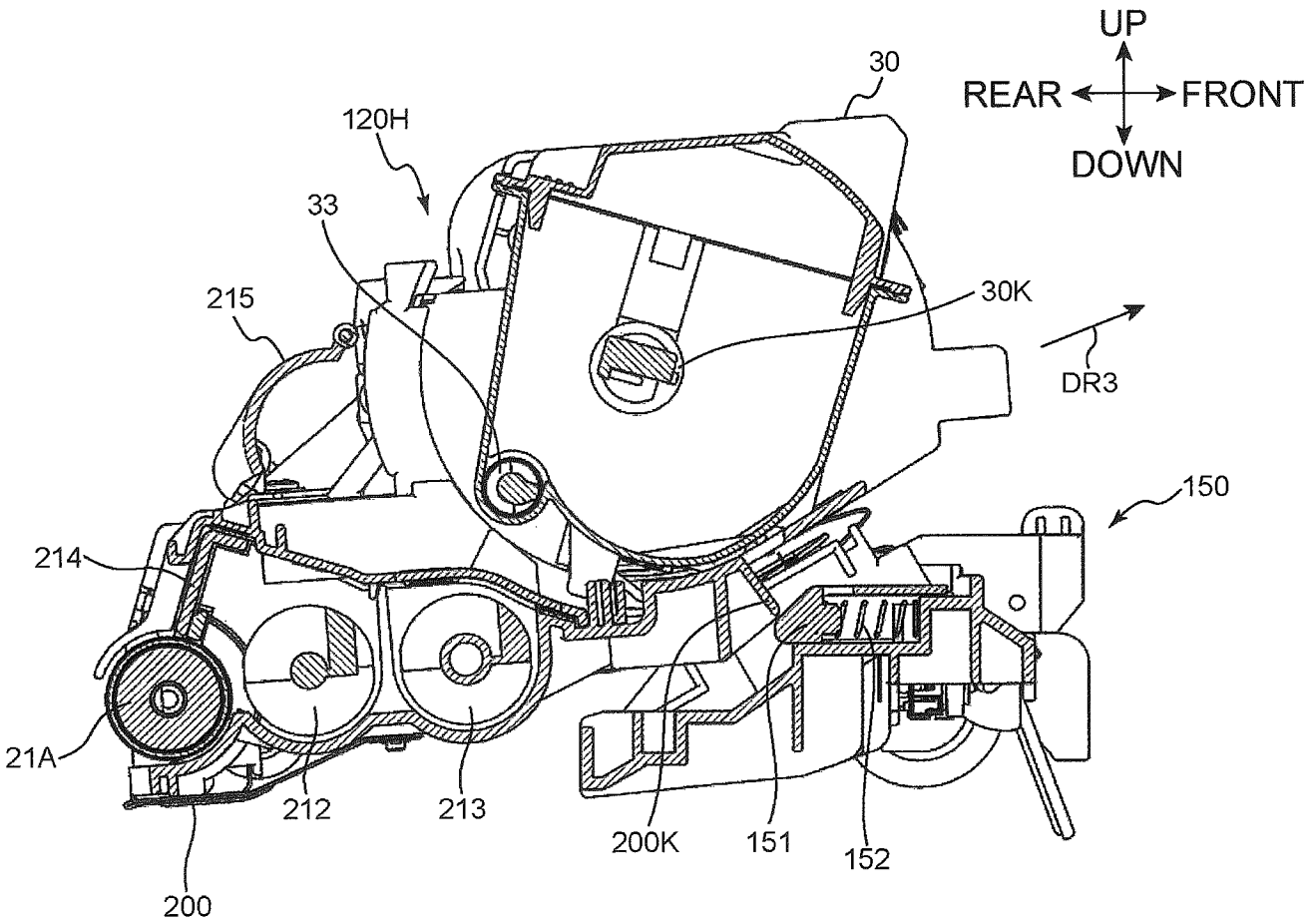
FIG. 10 illustrates a cross section of the developer unit and the guiding portion according to the one embodiment.

When the developer unit 120H is detached from the housing 101, as illustrated in FIG. 1, opening the front cover 106 of the housing 101 and the front end portion 102B of the upper wall 102 exposes the lever pressed portion 502 of the lock lever 50 outside the printer 100. An operator first press the lever pressed portion 502 downward (an arrow DR1 in FIG. 7). This results in that the lock lever 50 swings around the fulcrum 505 against the urging force of the lever-urging spring 52 and takes the release posture illustrated in FIG. 8. In this case, engagement of the hook 506 with the engaged portion 153 is released. Further pressing the lever pressed portion 502 causes the abutting portion 503 of the lock lever 50 to be brought into abutment on the guide surface 154, as illustrated in FIG. 8. Then, the developer unit 120H is pushed up to a standby position upper than the developing position illustrated in FIG. 7, with this abutting portion 503 as the fulcrum and the fulcrum 505 being a load point (an arrow in FIG. 1 and an arrow DR2 in FIG. 8). As illustrated in FIG. 10, this results in that the housing pressed portion 200K goes on the inclined surface of the urging protrusion 151, and the positioning of the developer unit 120H by the positioning mechanism 150S is released. In this case, the urging force from the positioning mechanism 150S (the unit urging spring 152) is not strongly applied to the development housing 200. Consequently, this ensures easy detachment of the developer unit 120H from the housing 101 along the above-described attachment/detachment direction (an arrow DR3 in FIG. 10).

As illustrated in FIG. 8, after the developer unit 120H has been pushed up in the arrow DR2 direction, bringing the hook 506 in abutment on the guide surface 154 (the above-described horizontal surface) on the upper side of the engaged portion 153 by the own weight of the developer unit 120H holds the developer unit 120H at the standby position. Consequently, even when the operator releases his/her hand from the lock lever 50, this prevents the hook 506 from engaging again with the engaged portion 153. This ensures that the operator easily and surely detaches the developer unit 120H.

In other embodiments, when the developer unit 120H is pushed up to the standby position, the inclined surface 506S (FIG. 7) of the hook 506 may be in abutment on the inclined surface 153S of the engaged portion 153. In this case as well, the lock lever 50 is turnable around the fulcrum 505 in accordance with pulling-out operation (the arrow DR3 in FIG. 10) of the developer unit 120H. This similarly prevents the hook 506 from engaging again with the engaged portion 153.

Structures of Toner Container and Developing Device

Figure 11A:
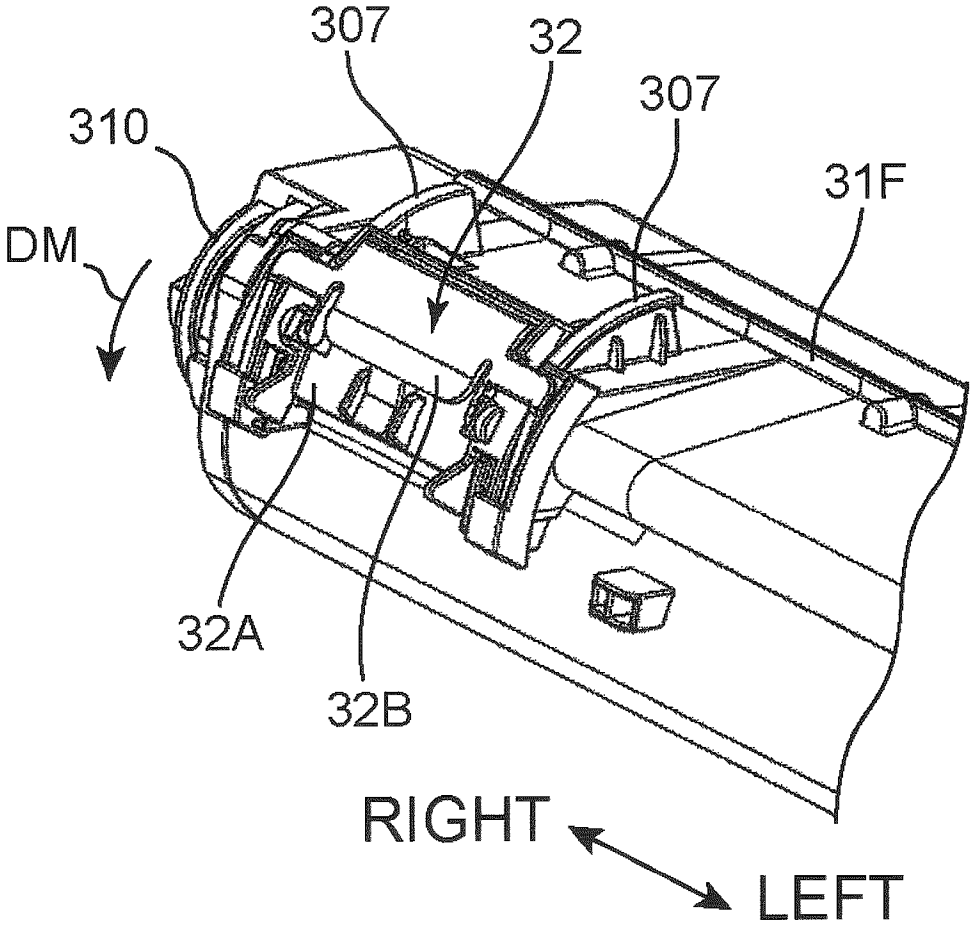
FIG. 11A obliquely illustrates the developer housing container according to the one embodiment.
Figure 11B:
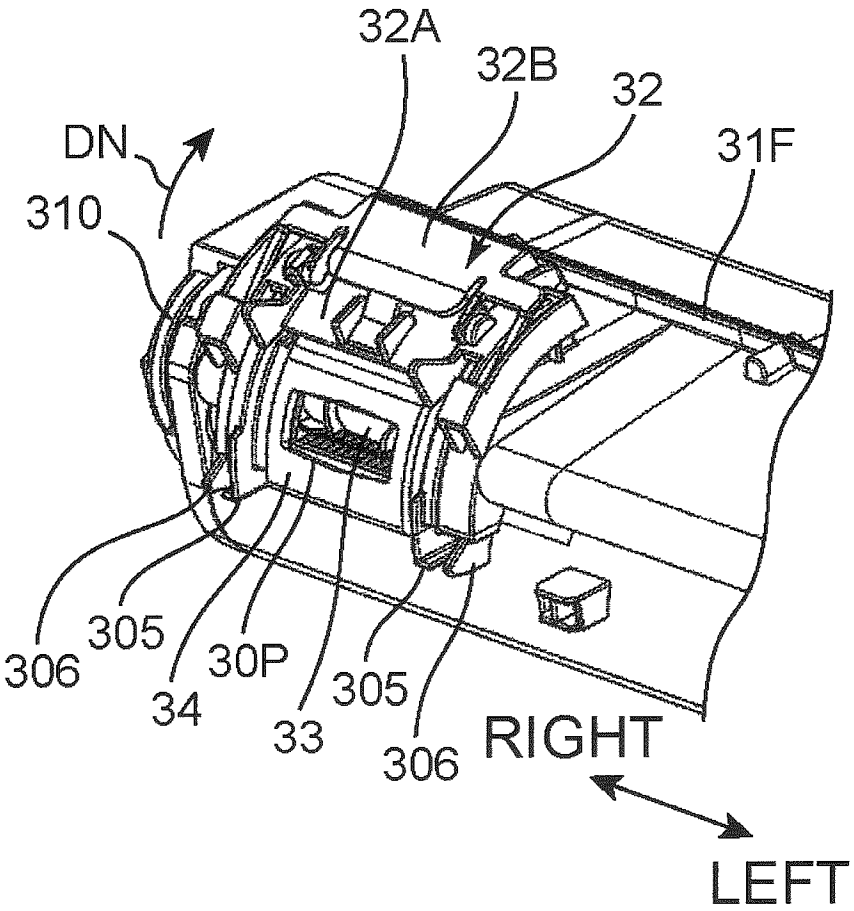
FIG. 11B obliquely illustrates the developer housing container according to the one embodiment.
Figure 12A:
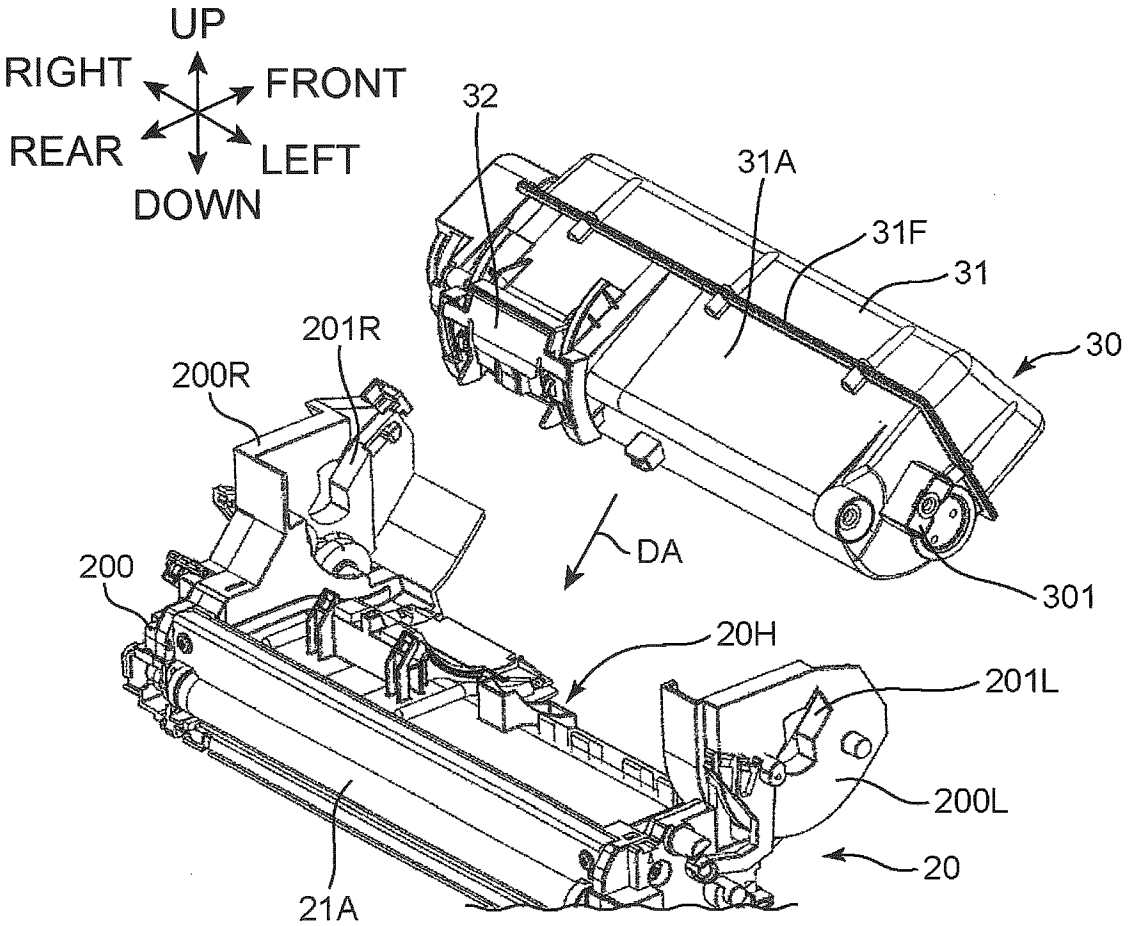
FIG. 12A obliquely illustrates a state where the developer housing container is mounted to the developing device according to the one embodiment.
Figure 12B:
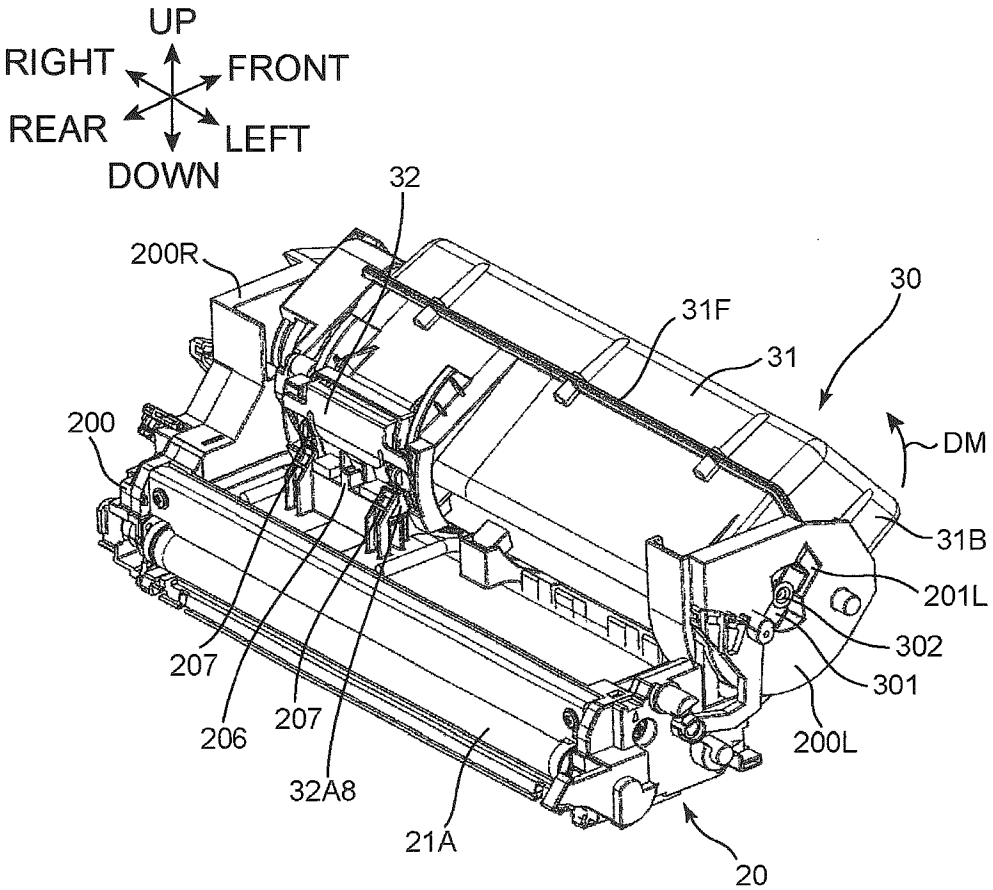
FIG. 12B obliquely illustrates a state where the developer housing container is mounted to the developing device according to the one embodiment.
Figure 12C:
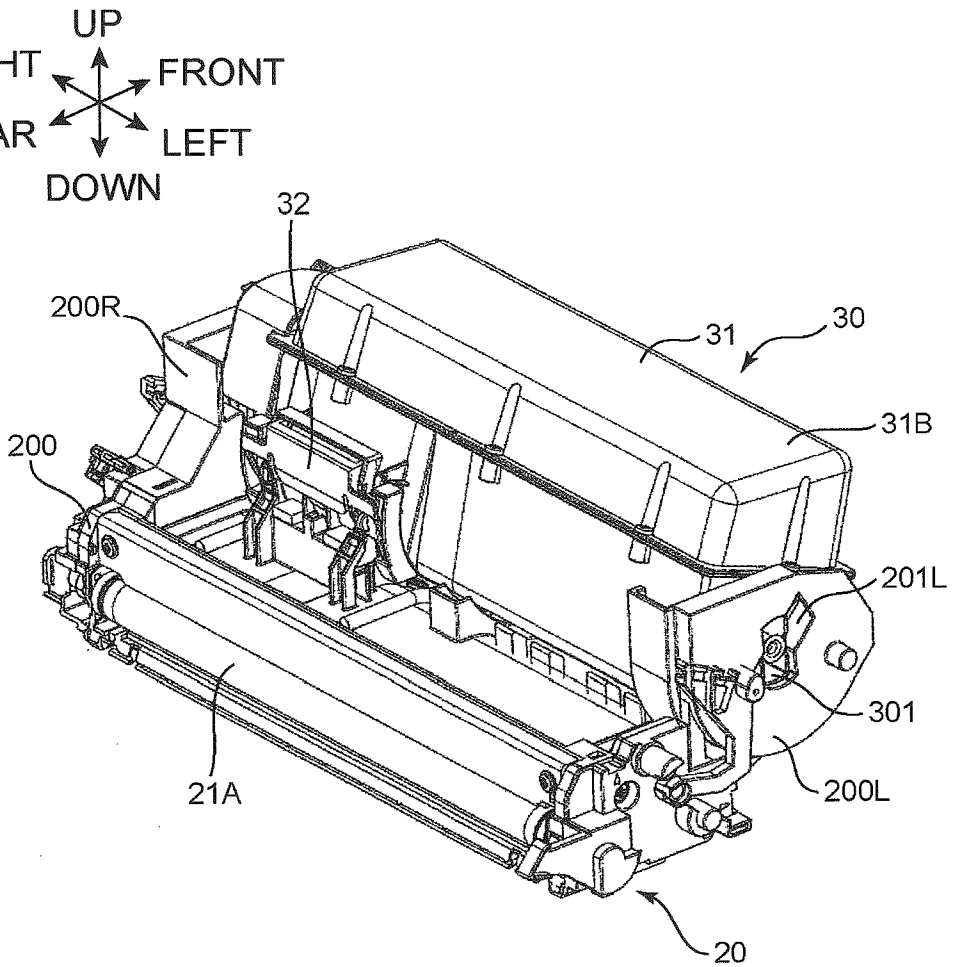
FIG. 12C obliquely illustrates a state where the developer housing container is mounted to the developing device according to the one embodiment.
Figure 13A:
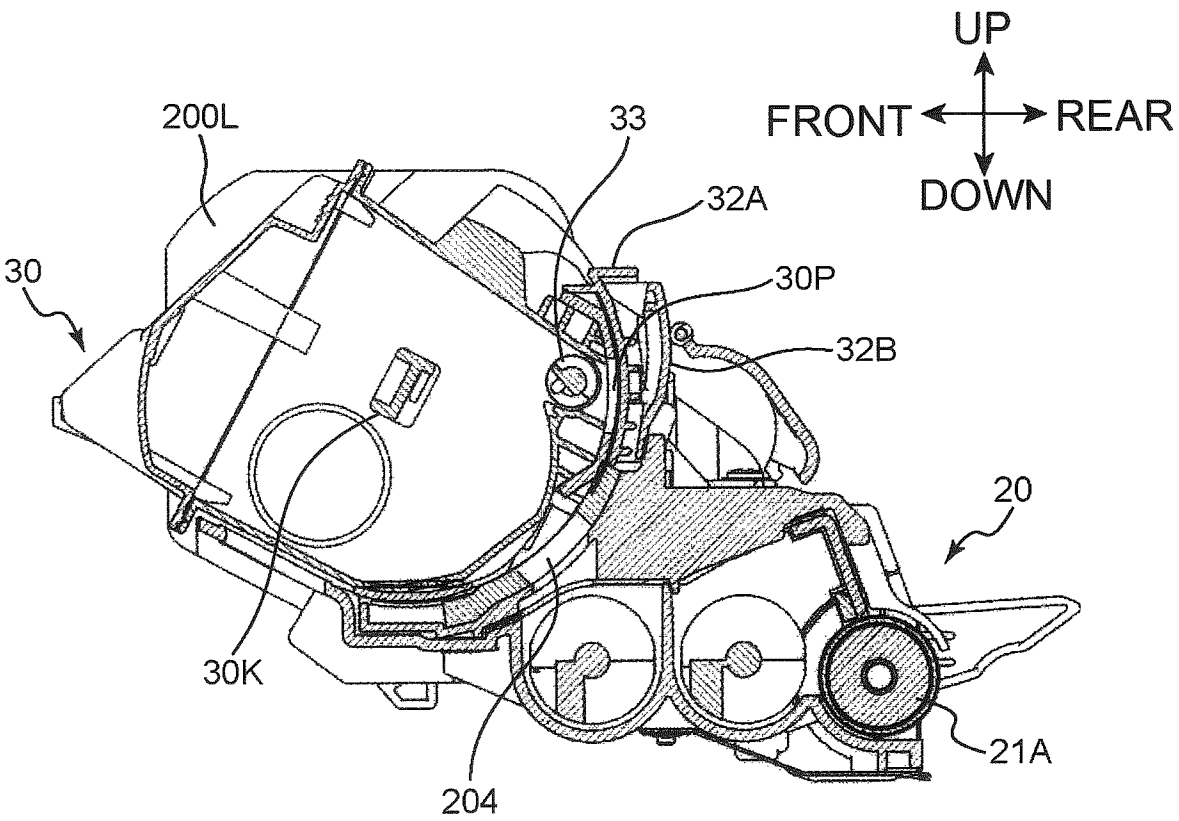
FIG. 13A illustrates a state where the developer housing container is mounted to the developing device according to the one embodiment in cross section.
Figure 13B:
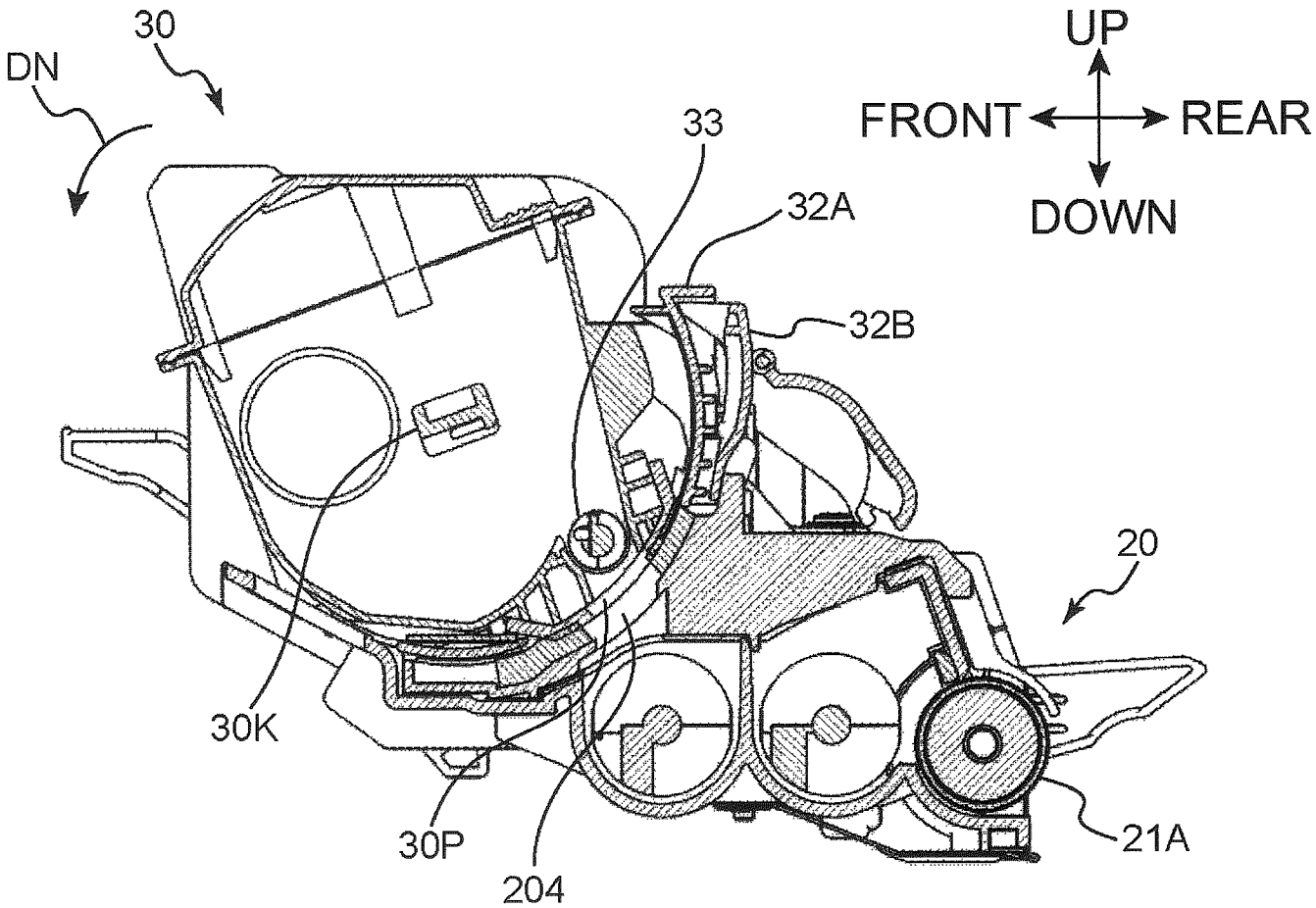
FIG. 13B illustrates a state where the developer housing container is mounted to the developing device according to the one embodiment in cross section.

The following further describes the structures of the toner container 30 and the developing device 20 according to the embodiment in detail. FIGS. 11A and 11B obliquely illustrate the enlarged toner container 30. FIG. 11A illustrates a state that the container shutter 32 shuts the toner discharge port 30P, which will be described later. FIG. 11B illustrates the open toner discharge port 30P. FIGS. 12A and 12B obliquely illustrate a state where the toner container 30 is mounted to the developing device 20. FIG. 12C obliquely illustrates the toner container 30 mounted to the developing device 20. FIGS. 13A and 13B illustrate a state where the toner container 30 is mounted to the developing device 20 in cross section.

The toner container 30 has a longitudinal shape extending in one direction. The toner container 30 is mounted to the developing device 20 inside the housing 101 such that the longitudinal direction of the toner container 30 goes along the lateral direction. In addition to the above-described container main body 31, the toner container 30 includes the container shutter 32 (FIGS. 4B and 11A), the toner discharge port 30P (FIG. 11B) (the developer discharge port), a paddle bearing portion 302 (see FIG. 12B), container shutter pressing portions 305 (FIG. 11B), elastic piece pressing portions 306 (FIG. 11B), guide ribs 307 (FIG. 11A), and the transmission gear 310 (FIGS. 4A and 11A).

The toner discharge port 30P (FIG. 11B) is an opening open to a right edge side on a lower surface of the main unit 31A. The toner housed inside the toner container 30 is discharged from the toner discharge port 30P and is supplied to the developing device 20.

The above-described left-side guide 301 is a protrusion with longitudinal shape formed to extend in a predetermined direction at the left side surface of the main unit 31A. The above-described left-side guide 301 regulates a mounting direction of the toner container 30 to the developing device 20 (an arrow DA direction in FIG. 12A). The left-side guide 301 internally has a cavity. The paddle bearing portion 302 (FIG. 12B) is a bearing portion located inside the left-side guide 301. The paddle bearing portion 302 rotatably journals the container paddle 30K. The right-side guide 311 also internally includes a bearing portion similar to the paddle bearing portion 302 (FIG. 12B) on the left-side guide 301 side. The bearing portion is adjacent to the transmission gear 310 and journals a shaft portion of the container paddle 30K.

The container shutter pressing portions 305 (FIG. 11B) are a pair of ribs projected so as to sandwich a discharge protrusion 34, which has the toner discharge port 30P, in the longitudinal direction (the lateral direction) of the toner container 30. The container shutter pressing portions 305 are located downstream in a rotation direction of the toner container 30 during mounting (a first rotation direction, an arrow DM in FIG. 11A) with respect to the toner discharge port 30P. The pair of container shutter pressing portions 305 each extend along the rotation direction. The container shutter pressing portions 305 have a shape whose distal end portions bent along the longitudinal direction of the toner container 30 (each so as to expand in the lateral direction). The container shutter pressing portions 305 have a function of pressing a main body shutter 22, which will be described later, and being pressed by the main body shutter 22.

The elastic piece pressing portions 306 (FIG. 11B) are pair of projection pieces adjacent to the container shutter pressing portions 305 and projected from the main unit 31A. A pair of the elastic piece pressing portions 306 are located so as to sandwich the pair of container shutter pressing portions 305 in the lateral direction. The elastic piece pressing portions 306 extend along the above-described rotation direction of the toner container 30. The elastic piece pressing portions 306 have an inclined shape whose projection height heightens as away from the toner discharge port 30P. The elastic piece pressing portions 306 are opposed to an elastic piece of a shutter stopper 32B, which will be described later, and have a function of pressing the elastic piece.

The guide ribs 307 (FIG. 11A) are pair of arc-shaped rib members projected from the main unit 31A and connected to the container shutter pressing portions 305. The guide ribs 307 are formed extending along the rotation direction of the container main body 31. A pair of the guide ribs 307 are located so as to sandwich the toner discharge port 30P in the lateral direction. Outer peripheral portions of a pair of the guide ribs 307 each bend in the lateral direction and have a predetermined width. The guide ribs 307 guide the container shutter 32, which will be described later, slidably movable around a predetermined shaft center.

The transmission gear 310 (FIGS. 4A and 11A) is a rotation gear rotatably supported to the right side surface of the toner container 30. The transmission gear 310 has a function of transmitting rotary drive power to the container paddle 30K. Mounting the toner container 30 to the developing device 20 connects a gear group (not illustrated) of the developing device 20 to the transmission gear 310, thus the rotary drive power is input to the transmission gear 310.

The container shutter 32 (FIG. 11A) is supported to the container main body 31 so as to be slidably movable with respect to the toner discharge port 30P to seal or open the toner discharge port 30P (FIGS. 11A and 11B). The container shutter 32 slidably moves along the rotation direction of the container main body 31 during the attachment to the developing device 20. The container shutter 32 includes a shutter main body 32A and the shutter stopper 32B. The shutter stopper 32B is swingably supported to the shutter main body 32A.

The shutter main body 32A is an approximately rectangular-shaped member that has a curved surface along a circumference surface of the container main body 31. The shutter main body 32A seals the toner discharge port 30P. The shutter stopper 32B is mounted to a surface of the shutter main body 32A on a side opposite from a surface for sealing the toner discharge port 30P. The shutter stopper 32B has a function to regulate or allow a slidable movement of the container shutter 32.

Referring to FIGS. 12A and 12B, the developing device 20 includes a container mounting portion 20H (a mounting portion) between the housing-right-side wall 200R and the housing-left-side wall 200L. The toner container 30 is mounted to the container mounting portion 20H.

Further, the development housing 200 includes a stopper pressing portion 206 (FIG. 12B), container shutter securing portions 207, and shutter springs 208 (FIG. 5).

The stopper pressing portion 206 (FIG. 12B) is a protrusion projected from a top panel of the development housing 200 adjacent to a rear side of the toner replenishment port 204. When the toner container 30 is mounted to the container mounting portion 20H, the stopper pressing portion 206 has a function of pressing a stopper releasing piece 32B2 (FIG. 4B) on the container shutter 32 of the toner container 30. In other words, the stopper pressing portion 206 allows the slidable movement of the container shutter 32.

The container shutter securing portions 207 (FIG. 12B) are protrusions projected from the top panel of the development housing 200 so as to sandwich the stopper pressing portion 206 in the lateral direction. In a cross-sectional view intersecting with the lateral direction, the container shutter securing portions 207 have an approximately trapezoidal shape. Wedge-shaped cutouts are formed on front side surfaces of the container shutter securing portions 207. When the toner container 30 is mounted to the container mounting portion 20H, shutter engaging pieces 32A8 (FIG. 4B), which are on the container shutter 32 of the toner container 30, engage these cutouts. Consequently, the container shutter securing portions 207 secure the container shutter 32 and regulate the movement (turning) of the container shutter 32.

The shutter springs 208 (FIG. 5) are pair of spring members located outside a pair of the container shutter securing portions 207 in the lateral direction. The shutter springs 208 extend in a front-rear direction. One ends of the shutter springs 208 are locked to the top panel of the development housing 200. The other ends of the shutter springs 208 are locked to the main body shutter 22 (FIG. 5), which will be described later.

Further, the developing device 20 includes the main body shutter 22 (FIG. 5). The main body shutter 22 is supported to the development housing 200 slidably movable to the toner replenishment port 204. The main body shutter 22 seals or opens the toner replenishment port 204.

The above-described shutter springs 208 urge the main body shutter 22 in a direction that the main body shutter 22 seals the toner replenishment port 204 (FIG. 5). Accordingly, as illustrated in FIG. 12A, with the toner container 30 removed from the developing device 20, the main body shutter 22 receives urging force from the shutter springs 208 to seal the toner replenishment port 204.

Mounting and Removal of Toner Container to/from Developing Device

The following describes the mounting of the toner container 30 to the developing device 20. As described above, in this embodiment, with the developing device 20 mounted to the housing 101 first, the toner container 30 alone is removably attachable to the developing device 20. Even if the toner container 30 becomes empty, this ensures easily exchanging the toner container 30. If the container shutter 32 is slidably moved from a position of covering the toner discharge port 30P by mistake until the toner container 30 is mounted to the developing device 20, the toner leaks from the toner discharge port 30P. This embodiment prevents the slidable movement of the container shutter 32 from the toner discharge port 30P while the toner container 30 alone is mounted.

With the front cover 106 open, a user of the printer 100 mounts the toner container 30 to the developing device 20 inside the housing 101. The user inserts the left-side guide 301 and the right-side guide 311 on the toner container 30 into the left-side guide groove 201L and the right-side guide groove 201R, respectively. This mounts the toner container 30 to the container mounting portion 20H while the toner container 30 is guided along the mounting direction (the arrow DA direction in FIG. 12A) by the left-side guide groove 201L and the right-side guide groove 201R (FIGS. 12B and 13A). With this posture, the toner discharge port 30P on the toner container 30 is separated above the toner replenishment port 204 of the developing device 20, and the toner discharge port 30P and the toner replenishment port 204 have not been communicated yet (FIG. 13A).

In this respect, the stopper pressing portion 206 on the development housing 200 presses the stopper releasing piece 32B2 (FIG. 4B) on the shutter stopper 32B. This releases the lock to the container shutter 32 by the shutter stopper 32B, ensuring the slidable movement of the container shutter 32 to the container main body 31.

Meanwhile, when the toner container 30 is mounted to the container mounting portion 20H with the insertion posture in FIG. 12B, a pair of the shutter engaging pieces 32A8 (FIG. 4B) on the shutter main body 32A of the container shutter 32 engage the wedge-shaped cutouts of the container shutter securing portions 207 (FIG. 12B). This secures the container shutter 32 to the container shutter securing portions 207. After this, the user rotationally drives the container main body 31 of the toner container 30 from the insertion posture illustrated in FIG. 12B to the first rotation direction (an arrow DM direction in FIG. 12B) around the shaft center of the container paddle 30K (FIG. 13A).

While the toner container 30 is slidably moved to the container shutter 32 to which the toner discharge port 30P is secured, the toner container 30 reaches a replenishment position illustrated in FIGS. 12C and 13B. With the posture of the toner container 30 illustrated in FIGS. 12C and 13B, the communication of the toner discharge port 30P on the toner container 30 with the toner replenishment port 204 on the developing device 20 (FIG. 13B) ensures the toner replenishment to the developing device 20.

With the toner container 30 not mounted to the container mounting portion 20H, the main body shutter 22 seals the toner replenishment port 204. When the toner container 30 is rotationally driven in the first rotation direction as described above and the posture is changed from the insertion posture to a replenishment posture, a part of the toner container 30 presses the main body shutter 22 in the first rotation direction against the urging force from the shutter springs 208 (FIG. 5). This slidably moves the main body shutter 22 in the first rotation direction together with the container main body 31 of the toner container 30 and as illustrated in FIG. 13B, the toner replenishment port 204 is open. Accordingly, the toner discharge port 30P and the toner replenishment port 204 are vertically communicatable.

As illustrated in FIG. 12C, mounting the toner container 30 to the container mounting portion 20H with the replenishment posture engages the lock abutment piece 202S (FIG. 5) to the lock engaging portion 312 (FIG. 4A). Consequently, the lock abutment piece 202S locks the toner container 30 to the replenishment posture (FIG. 13B). With this locked state, even if the urging force from the shutter springs 208 (FIG. 5) reaches the toner container 30 via the main body shutter 22, the lock abutment piece 202S regulates the rotation of the toner container 30. This restrains the rotation of the toner container 30 in a second rotation direction, that is, this restrains changing the posture of the toner container 30 from the replenishment posture to the insertion posture.

On the other hand, when a sensor (not illustrated) detects the empty toner in the toner container 30, a display (not illustrated) on the printer 100 notifies an exchange display for the toner container 30. When the user presses the lock button 202 (FIG. 5), the lock abutment piece 202S moves rearward. This separates the lock abutment piece 202S from the lock engaging portion 312 rearward, thus releasing the engagement between the lock abutment piece 202S and the lock engaging portion 312. This loses the regulating force regulating the lock engaging portion 312, thereby releasing the lock of the toner container 30. Since the urging forces from the shutter springs 208 are given to the main body shutter 22, while the main body shutter 22 presses the toner container 30, the toner container 30 rotates in the second rotation direction, which is a direction opposite from the first rotation direction (an arrow DN in FIG. 13B). Consequently, the toner container 30 automatically changes the posture from the replenishment posture to the insertion posture by the urging force from the shutter springs 208.

The posture change of the toner container 30 turns the toner discharge port 30P in the second rotation direction, and the toner discharge port 30P is re-sealed by the container shutter 32 at the insertion position. The urging force from the shutter springs 208 slidably moves the main body shutter 22, thus re-sealing the toner replenishment port 204 by the main body shutter 22.

Again, the toner container 30 with the insertion posture illustrated in FIGS. 12B and 13A is detached from the container mounting portion 20H along a direction opposite from the mounting direction, thus removing the toner container 30 from the developing device 20. Thus, in this embodiment, releasing the lock of the toner container 30 changes the posture of the toner container 30 to the insertion posture. Then, the container shutter 32 and the main body shutter 22 seal the toner discharge port 30P and the toner replenishment port 204, respectively. When the user removes the toner container 30, this prevents the peripheral areas of the developing device 20 and the toner container 30 from being contaminated with the toner.

Contact Communication of Storage Unit

Figure 14:
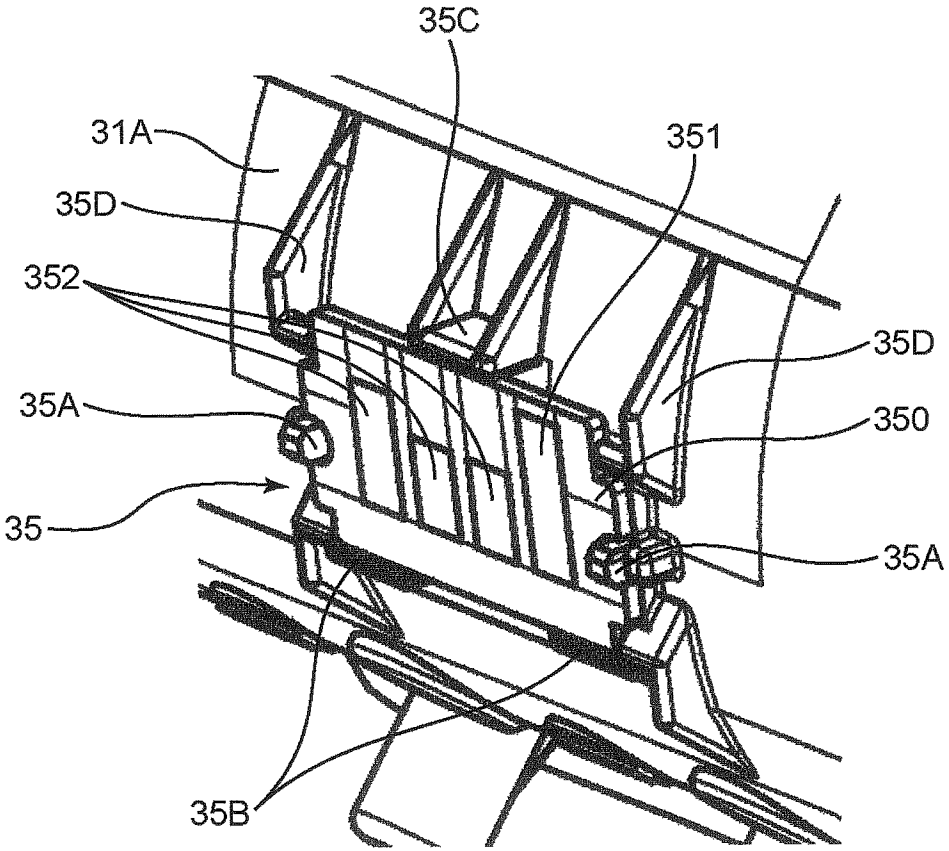
FIG. 14 obliquely illustrates an enlarged storage unit in the developer housing container according to the one embodiment.
Figure 15:
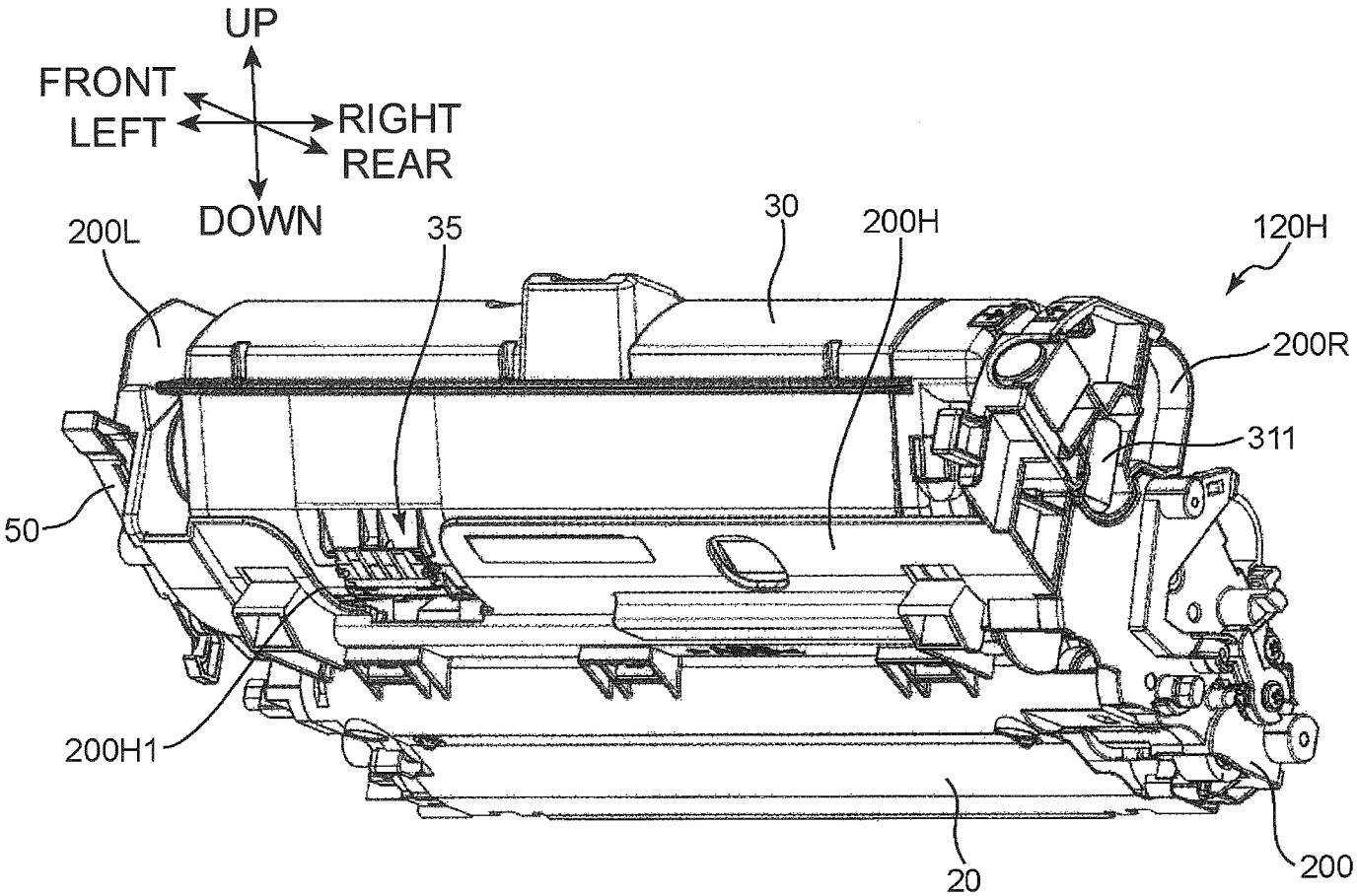
FIG. 15 obliquely illustrates the developer unit according to the one embodiment.
Figure 16:
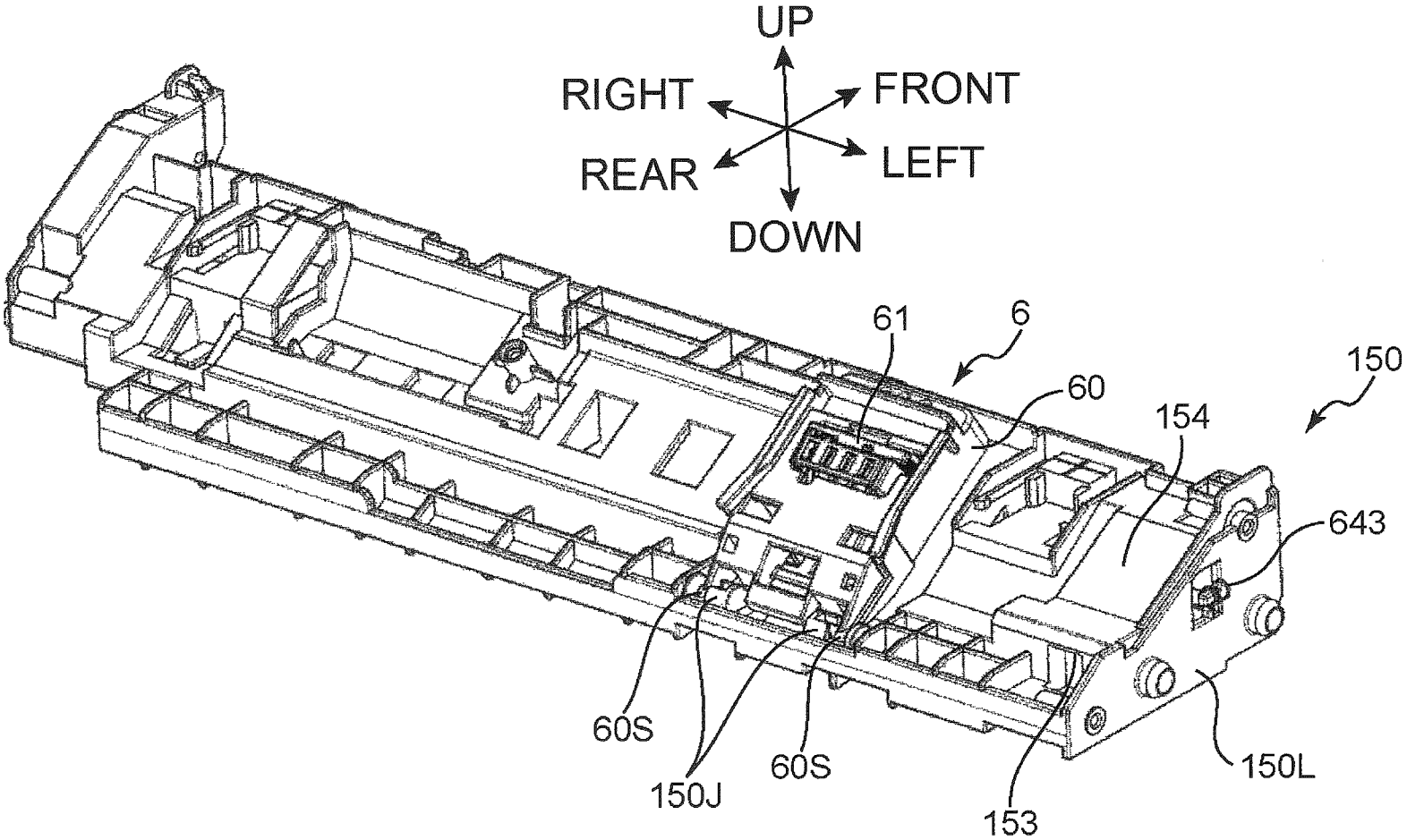
FIG. 16 obliquely illustrates the guide unit according to the one embodiment.
Figure 19A:
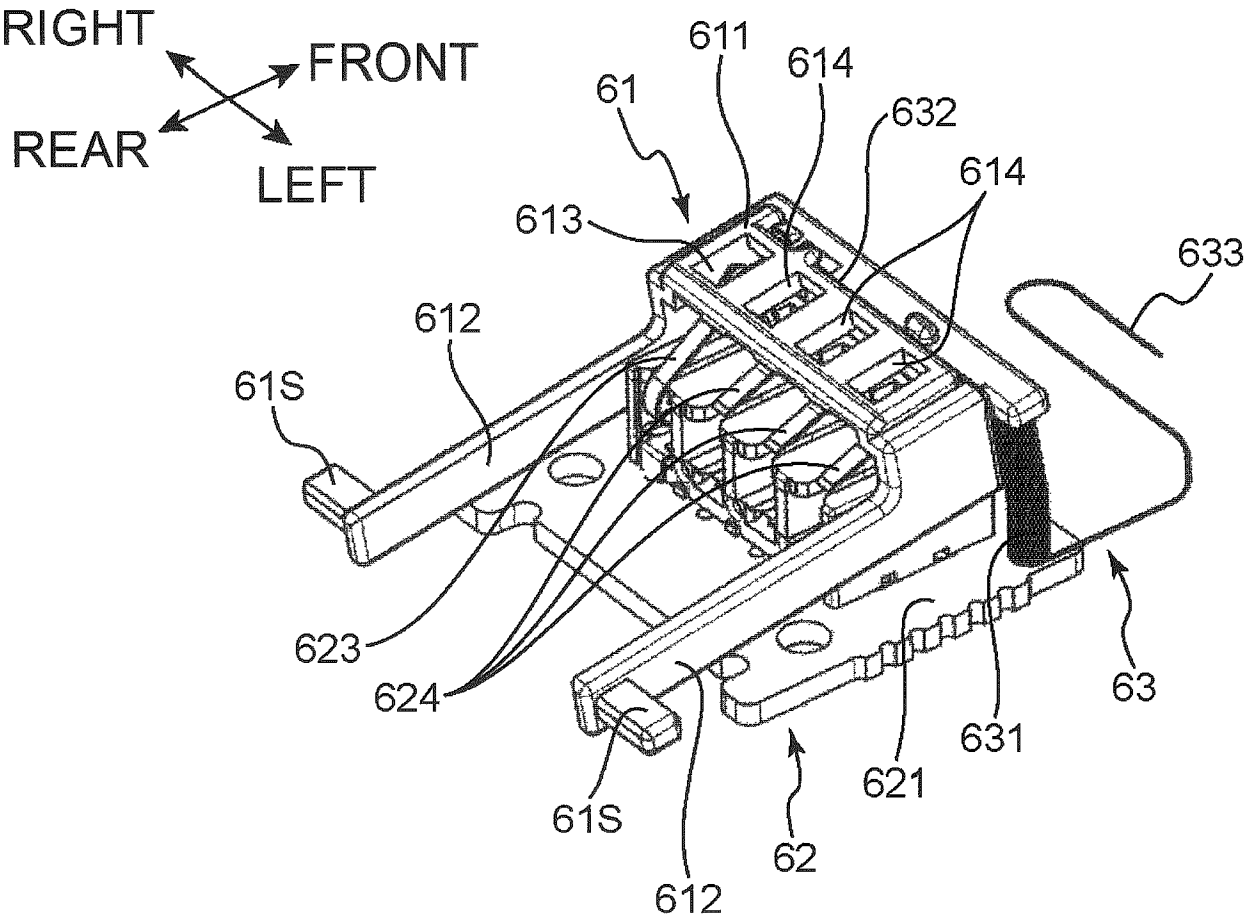
FIG. 19A obliquely illustrates the shutter and a terminal unit of the connector according to the one embodiment.
Figure 19B:
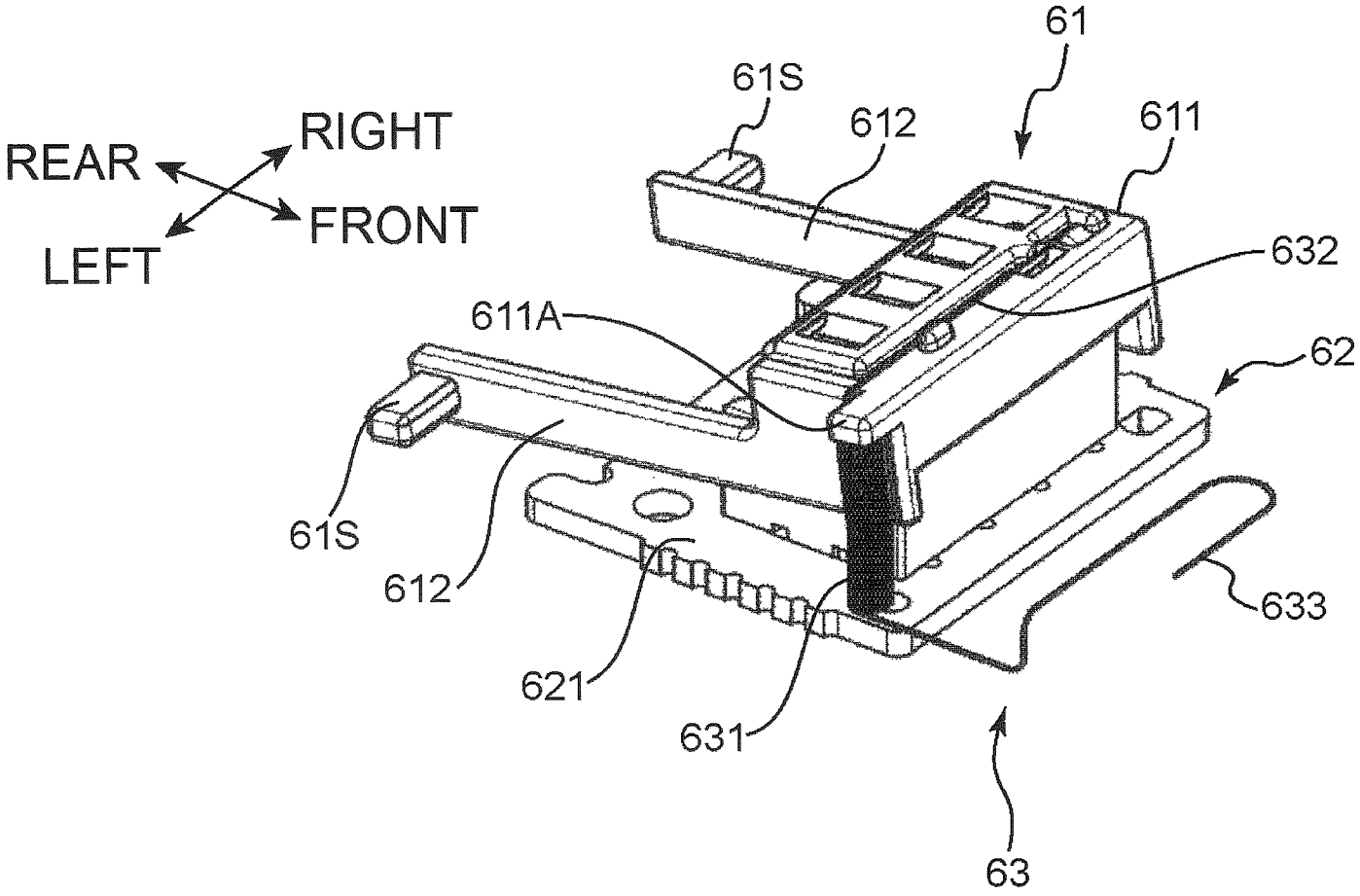
FIG. 19B obliquely illustrates the shutter and the terminal unit of the connector according to the one embodiment.
Figure 20A:
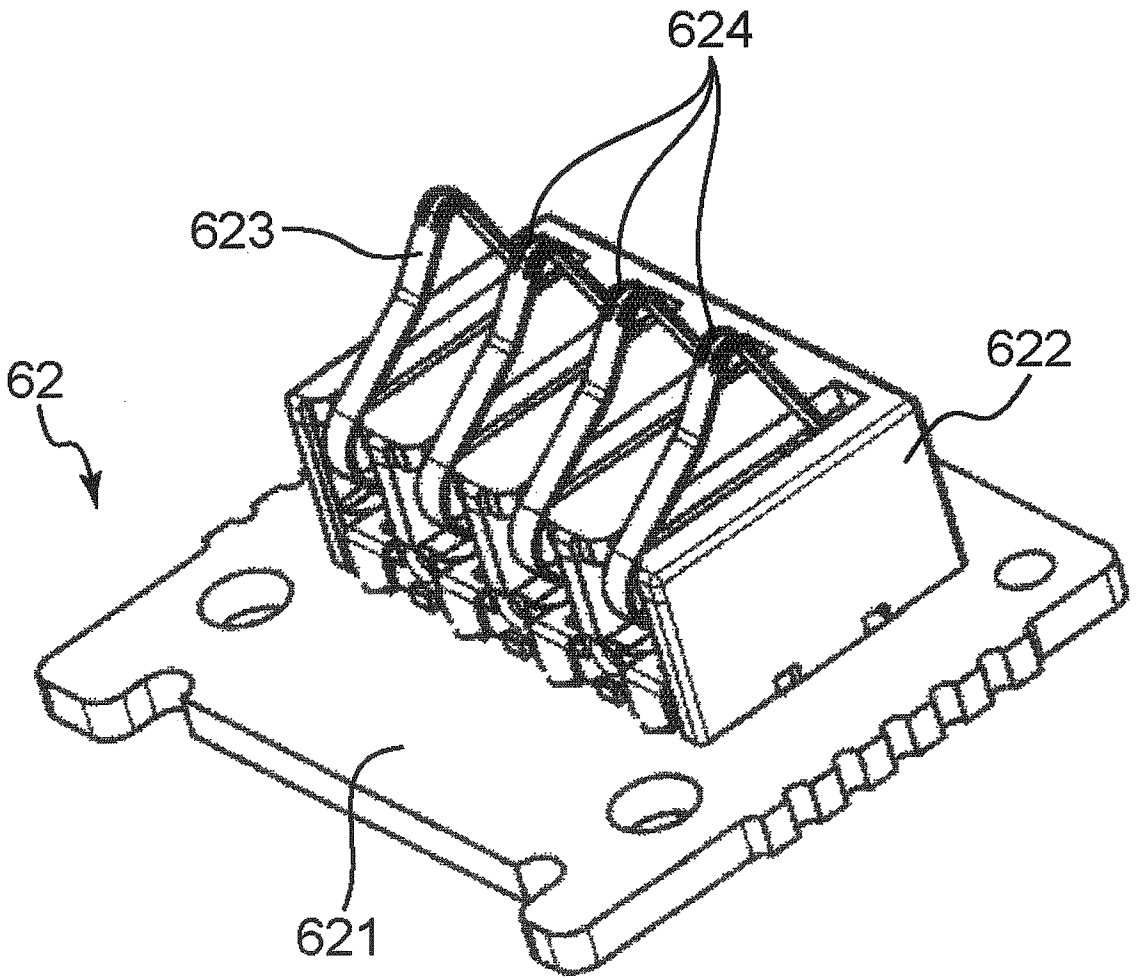
FIG. 20A obliquely illustrates the terminal unit of the connector according to the one embodiment.
Figure 20B:
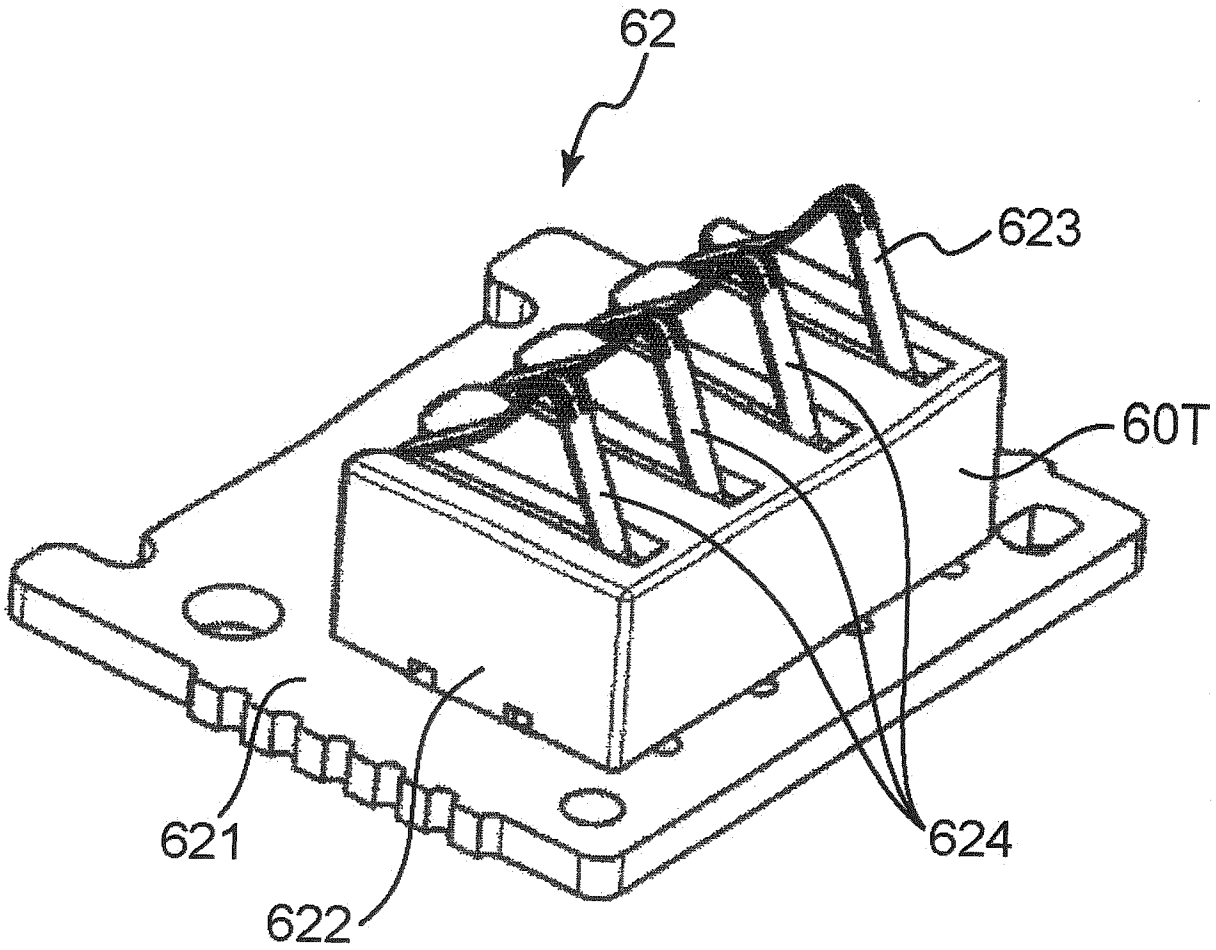
FIG. 20B obliquely illustrates the terminal unit of the connector according to the one embodiment.
Figure 21A:
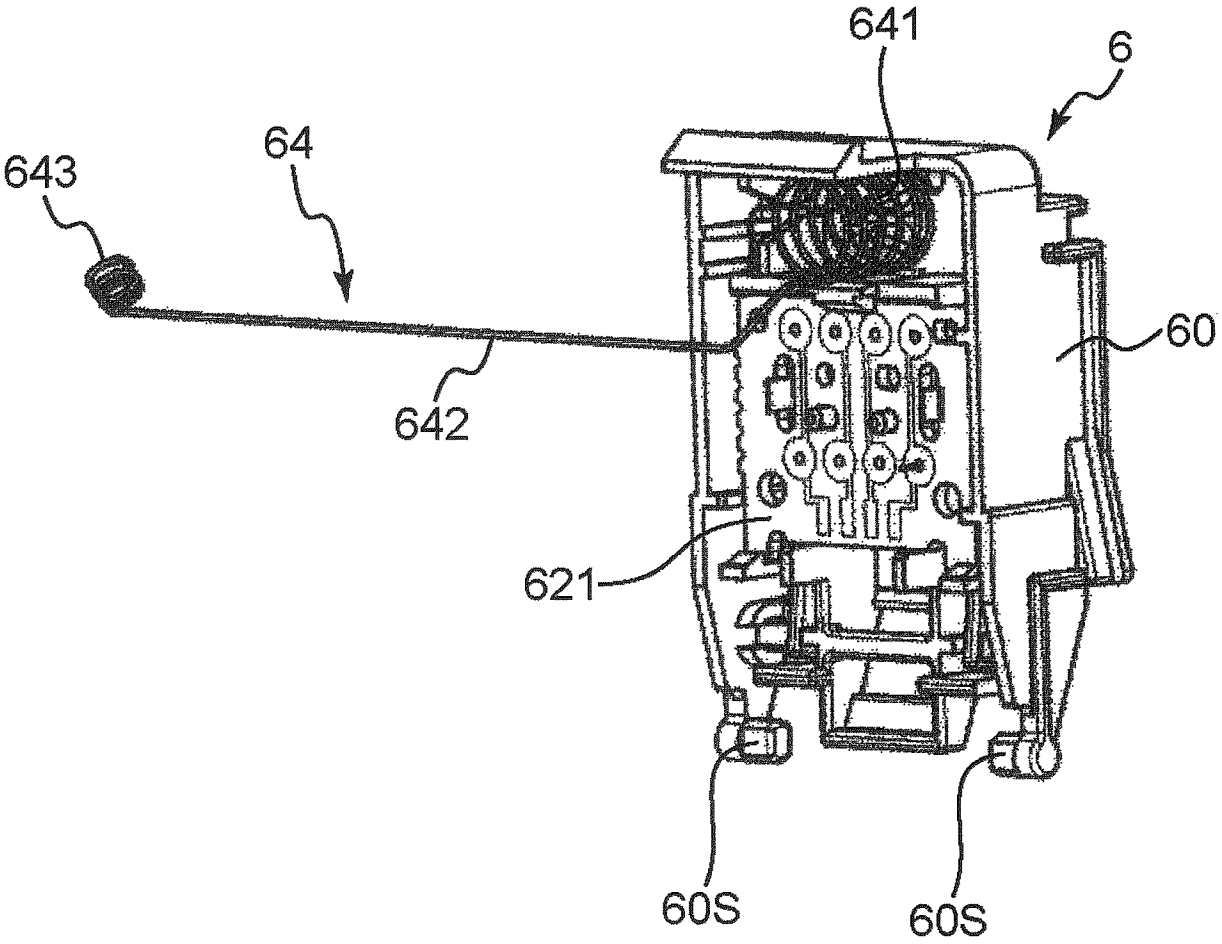
FIG. 21A obliquely illustrates the connector and a first urging member according to the one embodiment.
Figure 21B:
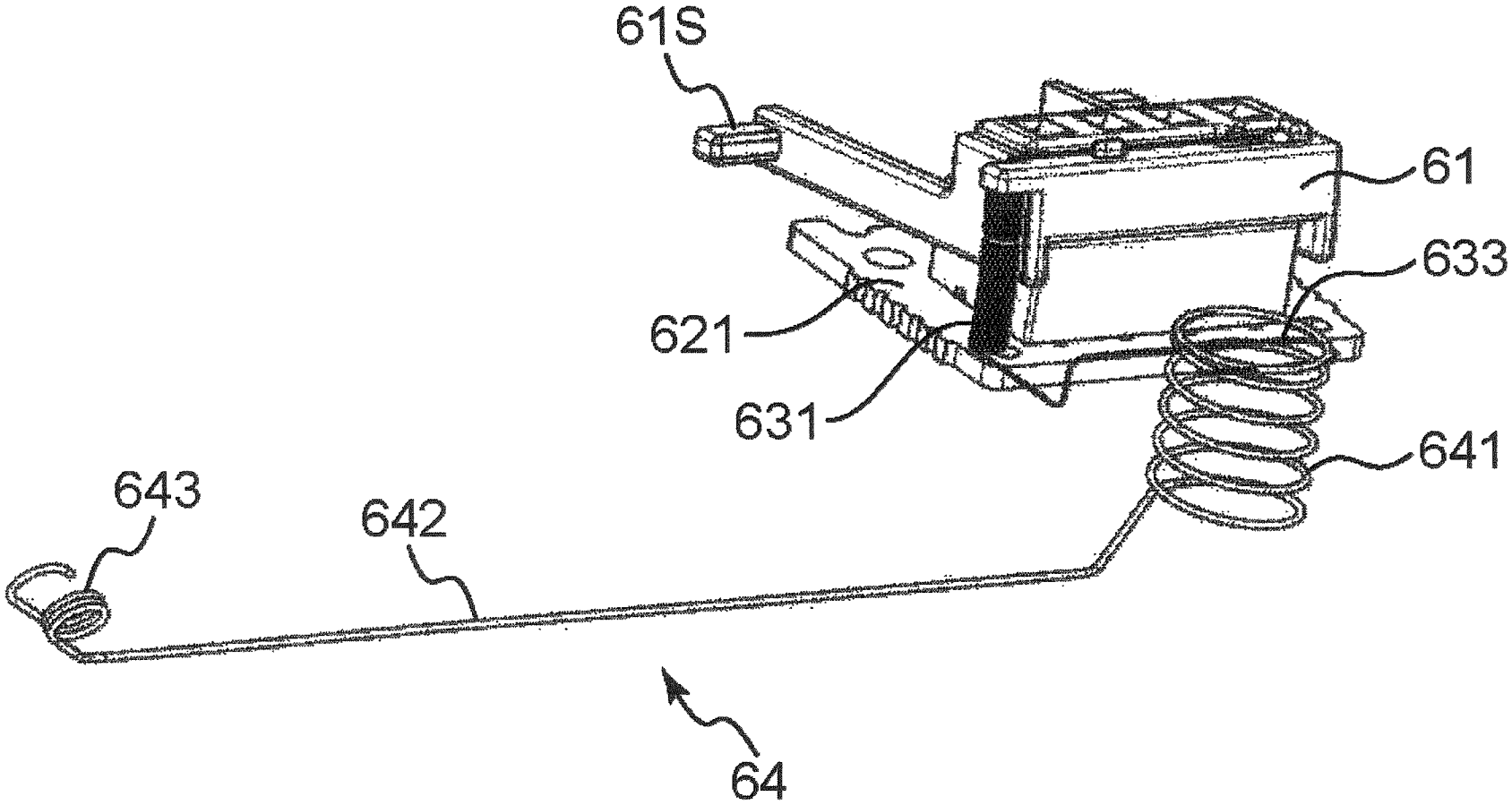
FIG. 21B obliquely illustrates a positional relationship between the first urging member and a second urging member of the connector according to the one embodiment.

The following describes a connector 6 of the main body unit 150 and a storage unit 35 of the toner container 30 according to the embodiment referring to FIGS. 14 to 21B. FIG. 14 obliquely illustrates the enlarged storage unit 35 of the toner container 30 according to the embodiment. FIG. 15 obliquely illustrates the developer unit 120H. FIG. 16 obliquely illustrates the main body unit 150 according to the embodiment. FIGS. 17A and 17B obliquely illustrate the connector 6 according to the embodiment. FIGS. 18A and 18B obliquely illustrate a state where a connector shutter 61, which will be described later, is removed from the connector 6. FIGS. 19A and 19B obliquely illustrate the connector shutter 61 and a terminal unit 62, which will be described later, of the connector 6. FIGS. 20A and 20B obliquely illustrate the terminal unit 62 of the connector 6. FIG. 21A obliquely illustrates the connector 6 and a shutter urging spring 63 (see FIGS. 19A and 19B) according to the embodiment. FIG. 21B illustrates a positional relationship between the shutter urging spring 63 and a housing urging spring 64 of the connector 6.

Referring to FIGS. 4A and 14, the toner container 30 includes the storage unit 35. The storage unit 35 is secured to an outer peripheral portion of the main unit 31A of the toner container 30. The storage unit 35 includes an IC chip 350 (a substrate), a ground terminal 351 (a first ground terminal), and a plurality of input/output terminals 352 (first input/output terminals). The storage unit 35 includes engaging claws 35A, distal end regulating portions 35B, a rear end regulating portion 35C, and guide pieces 35D.

The IC chip 350 is a plate-shaped member having an approximately rectangular shape. The IC chip 350 stores usage logs of the toner container 30, toner information housed in the toner container 30, and similar information. The ground terminal 351 is a ground line exposed outside the IC chip 350. Similarly, the input/output terminals 352 are terminals exposed outside the IC chip 350. An electrical connection of the input/output terminals 352 with the connector 6, which will be described later, transmits and receives various pieces of information stored in the IC chip 350.

The engaging claws 35A, the distal end regulating portions 35B, and the rear end regulating portion 35C are protrusions each projected from the main unit 31A of the toner container 30 and have a function to secure the IC chip 350. The guide pieces 35D are projection pieces located upright from the main unit 31A so as to sandwich the IC chip 350. The guide pieces 35D extend along the rotation direction (the arrow DC2 in FIG. 5 and the arrow DM in FIG. 12B) of the toner container 30 when the toner container 30 is mounted to/removed from the developing device 20.

Referring to FIG. 16, the main body unit 150 includes the connector 6. By an electrical connection of the connector 6 with the IC chip 350 on the toner container 30, the printer 100 and the toner container 30 transmit and receive various pieces of information. As described above, the toner container 30 alone is mountable to the housing 101 or is mountable to the housing 101 integrally with the developing device 20. In this embodiment, with the front cover 106 (FIG. 1) open, an aspect where the toner container 30 is mounted to the main-body internal space 107 of the housing 101 integrally with the developing device 20 while the toner container 30 has been preliminary mounted to the container mounting portion 20H of the developing device 20 such that the toner discharge port 30P communicates with the toner replenishment port 204 is defined as a first mounting aspect. On the other hand, with the front cover 106 open, an aspect where the toner container 30 is mounted to the container mounting portion 20H of the developing device 20 preliminary mounted to the developing position of the main-body internal space 107 such that the toner discharge port 30P communicates with the toner replenishment port 204 is defined as a second mounting aspect. The toner container 30 is mountable to the housing 101 selectably from the first mounting aspect or the second mounting aspect.

Referring to FIG. 15, the developer unit 120H has a container support plate 200H. The container support plate 200H is a support plate consecutively installed to the top panel of the development housing 200 to support the toner container 30 from downward. The container support plate 200H includes a cutout 200H1. The cutout 200H1 is formed by cutting out a part of the container support plate 200H. When the toner container 30 is mounted to the developing device 20, the cutout 200H1 exposes the IC chip 350 to the lower side of the developer unit 120H.

When the toner container 30 is mounted to the housing 101 in the first mounting aspect, as described above, the developer unit 120H moves downward at a final phase where the developing device 20 is mounted at the developing position. In this respect, the IC chip 350 of the toner container 30 exposed at the cutout 200H1 needs to be electrically connected to the connector 6 (FIG. 16) on the main body unit 150. On the other hand, when the toner container 30 is mounted to the housing 101 in the second mounting aspect, the toner container 30 is rotationally driven in a predetermined rotation direction (the arrow DM in FIG. 12B) at the container mounting portion 20H on the developing device 20. Then, in FIG. 15, the IC chip 350 is exposed to the cutout 200H1 from the rear to the front of the cutout 200H1. In accordance with this rotation operation of the toner container 30, the IC chip 350 needs to be electrically connected to the connector 6. Thus, to achieve the connection of the IC chip 350 with the connector 6 in accordance with different movements of the toner container 30, the printer 100 according to the embodiment features the structure of the connector 6.

The connector 6 is located at the main body unit 150 of the housing 101 opposed to the toner container 30. The connector 6 is swingably supported to the main body unit 150. The connector 6 is electrically connected to the IC chip 350 on the toner container 30, which is mounted to the main-body internal space 107 in the first mounting aspect or the second mounting aspect. Referring to FIGS. 16 to 21A, the connector 6 includes a connector housing 60, the connector shutter 61 (the shutter), the terminal unit 62, a shutter urging spring 63 (the second urging member), and the housing urging spring 64 (the first urging member).

Figure 17A:
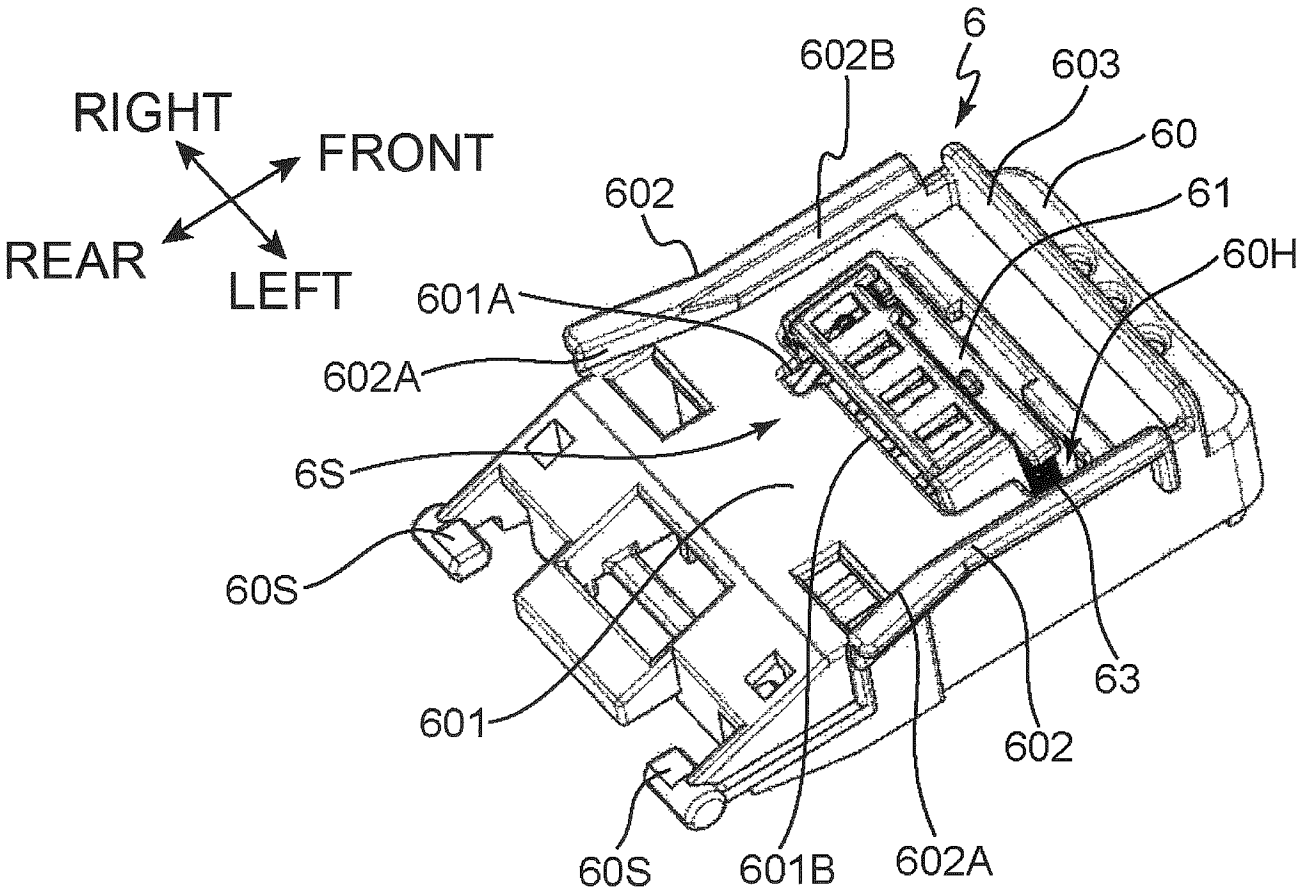
FIG. 17A obliquely illustrates a connector according to the one embodiment.
Figure 17B:
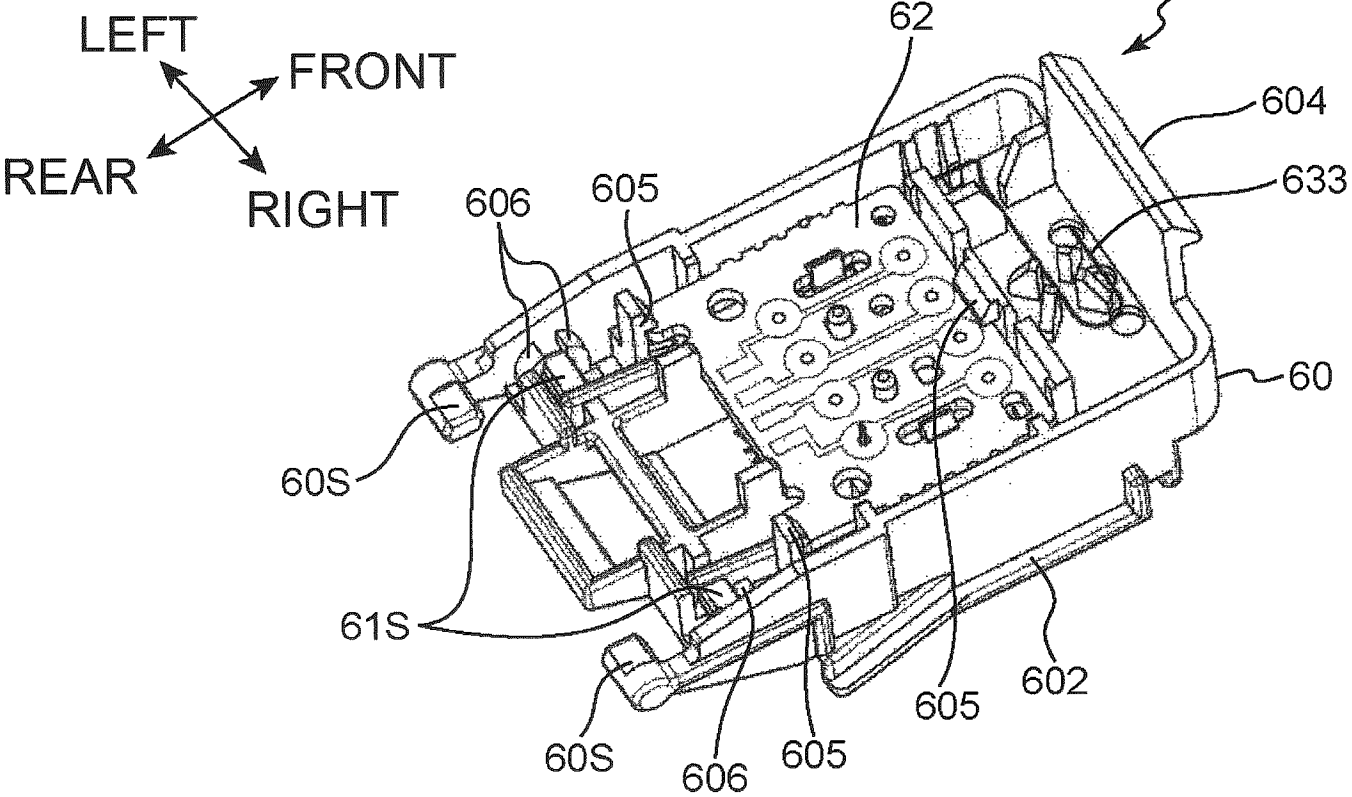
FIG. 17B obliquely illustrates the connector according to the one embodiment.

The connector housing 60 is a housing part of the connector housing 60. The connector housing 60, which has an approximately rectangular parallelepiped shape, internally houses the connector shutter 61 and the terminal unit 62. The connector housing 60 includes housing shaft portions 60S (FIG. 17A), a support surface 601 (an opposed surface), guide sidewalls 602 (guide portions), a guide front wall 603, a housing lock claw 604 (FIG. 17B), substrate engaging claws 605, shutter supporting portions 606, and spring lock portions 607 (FIG. 18B).

The housing shaft portions 60S are pair of shaft portions located at a rear end portion of the connector housing 60. The housing shaft portions 60S are turnably supported to connector supporting portions 150J (FIG. 16) on the main body unit 150. The housing shaft portions 60S are located on the connector housing 60 at an upstream in the rotation direction of the toner container 30 (the arrow DM direction in FIG. 12B) when the toner container 30 is mounted in the second mounting aspect.

The support surface 601 corresponds to the top surface portion of the connector housing 60. By mounting the toner container 30 to the housing 101, the support surface 601 is located opposed to the storage unit 35 in the toner container 30. The support surface 601 has a housing opening 60H (an opening) (FIG. 17A). The rectangular-shaped housing opening 60H is open at an approximately center of the support surface 601. The housing opening 60H extends long in the lateral direction. A cutout end edge 601A (an end edge, a second end edge) and an opening rear end edge 601B (an end edge, a first end edge) define a rear side portion of the housing opening 60H. The cutout end edge 601A is formed by notching a part of the opening rear end edge 601B into a rectangular shape toward the rear. The cutout end edge 601A is opposed to a ground terminal 623 (FIG. 18A), which will be described later. Between the support surface 601 and the housing shaft portions 60S, an inclined surface 601T (FIG. 18A), which is inclined upward toward the support surface 601, is formed.

The guide sidewalls 602 are pair of walls located upright from right and left end portions of the support surface 601 so as to sandwich the housing opening 60H. The guide sidewalls 602 are formed extending long in the front-rear direction. The guide sidewall 602 includes first guide portions 602A and second guide portions 602B. The first guide portion 602A is a region of bent rear end portion of the guide sidewall 602. The pair of first guide portions 602A expand toward the front as approaching the housing shaft portions 60S in a direction along the support surface 601 (FIG. 17A). The second guide portion 602B is formed on the front end side of the guide sidewall 602. The second guide portion 602B is a tapered surface formed on the upper end portion of the guide sidewall 602. The pair of second guide portions 602B expand toward the front as away from the support surface 601 in a direction perpendicular to the support surface 601. In FIG. 17A, only the right second guide portion 602B appears.

The guide front wall 603 is a wall portion located upright from the front end portion of the support surface 601. The guide front wall 603 is formed extending in the lateral direction. The guide front wall 603 and the pair of guide sidewalls 602 form a chip housing portion 6S (FIG. 17A), which is formed of a flat-shaped space open at the rear portion. This chip housing portion 6S can house the IC chip 350 on the storage unit 35 of the toner container 30 (see FIG. 25A).

The housing lock claw 604 is a craw projected from the front side wall portion of the connector housing 60 toward approximately downward. The housing lock claw 604 is lockable to a locked portion 155A (FIG. 24A) of the main body unit 150. The substrate engaging claws 605 (FIG. 17B) are three craws projected from a back side of the support surface 601. The substrate engaging claws 605 secure the terminal unit 62 to the connector housing 60. The shutter supporting portions 606 are pair of bearing portions formed at the front of the pair of housing shaft portions 60S on the back side of the support surface 601. The shutter supporting portions 606 turnably support shutter shaft portions 61S on the connector shutter 61, which will be described later. The spring lock portions 607 are protrusions at the rear of the housing lock claw 604 projected from the back side of the support surface 601. The spring lock portions 607 are four protrusions located in a cross shape. One end of the housing urging spring 64 (see FIGS. 21A and 21B) is locked to the spring lock portions 607 (see FIG. 18B).

The connector shutter 61 (see FIG. 19A) is located inside the connector housing 60. The connector shutter 61 is partially projected from the housing opening 60H on the connector housing 60. The connector shutter 61 has a function to protect the ground terminal 623 and input/output terminals 624 of the terminal unit 62. The connector shutter 61 includes a cover 611, legs 612, a first opening 613, second openings 614, and the shutter shaft portions 61S.

The cover 611 is a main part of the connector shutter 61 and has an approximately U-shape in front view. The cover 611 covers the housing opening 60H. On the top surface portion of the cover 611, the first opening 613 (the window) and the second openings 614 (the windows) are open. The first opening 613 is an opening open to a right edge portion on the top surface portion of the cover 611. The three second openings 614 are open spaced on the left side of the first opening 613. The first opening 613 exposes the ground terminal 623 (see FIG. 18A), which projects from the housing opening 60H. The second openings 614 each expose the input/output terminals 624 (see FIG. 18A), which project from the housing opening 60H. Regions around the first opening 613 and the second openings 614 on the cover 611 protect the ground terminal 623 and the input/output terminals 624. The pair of legs 612 extend from right and left end portions of the cover 611 toward the rear. The shutter shaft portions 61S are located on rear end portions of the respective pair of legs 612. The shutter shaft portions 61S serve as fulcrums in the swing of the connector shutter 61. The shutter supporting portions 606 (see FIG. 17B) of the connector housing 60 turnably support the shutter shaft portions 61S. The shutter shaft portions 61S are located at upstream in the rotation direction (the arrow DM direction in FIG. 12B) of the toner container 30 when the toner container 30 is mounted in the second mounting aspect on the connector shutter 61.

The connector shutter 61 further includes an earth 632 (see FIG. 19B). The earth 632 is adjacent to the first opening 613 and the second openings 614 on the front side. The earth 632 is an electric wire that runs so as to extend in the lateral direction at the upper end portion of the cover 611. When the user of the printer 100 attempts to touch the connector 6 or in a similar case, the earth 632 prevents a discharge and a leakage at the connector 6. Starting the use of the printer 100 grounds the earth 632. In this embodiment, the earth 632 is constituted of a part of the shutter urging spring 63.

The terminal unit 62 (see FIGS. 20A and 20B) is located inside the connector housing 60. As illustrated in FIGS. 19A and 19B, the terminal unit 62 is located below the cover 611 of the connector shutter 61. The terminal unit 62 includes a substrate 621, a support box 622, the ground terminal 623 (the second ground terminal), and input/output terminals 624 (second input/output terminals).

The substrate 621 is located at a lower part of the terminal unit 62. The substrate 621 has an approximately rectangular shape. The substrate 621 is electrically connected to a control unit (not illustrated) in the housing 101 by a harness (not illustrated). The support box 622 has a box shape connected to the substrate 621. The support box 622 has a function to support the ground terminal 623 and the input/output terminals 624. The wall portion on the front side of the support box 622 functions as a support wall 60T, which will be described later. As illustrated in FIGS. 20A and 20B, the ground terminal 623 and the three input/output terminals 624 are terminals projected from respective grooves formed on the support box 622. The ground terminal 623 and the input/output terminals 624 are formed of bent metal wires having an approximately triangular shape in side view. The ground terminal 623 and the input/output terminals 624 are electrically connected to respective terminals (not illustrated) of the substrate 621. The ground terminal 623 and the input/output terminals 624 project from the housing opening 60H upward with leaf spring like elastic force (see FIG. 18A). By mounting the toner container 30 to the main-body internal space 107, the ground terminal 623 and the input/output terminals 624 contact the respective ground terminal 351 and the input/output terminals 352 in the storage unit 35. Pressing the ground terminal 623 and the input/output terminals 624 by the ground terminal 351 and the input/output terminals 352 from upward causes the ground terminal 623 and the input/output terminals 624 to be elastically deformable downward.

The shutter urging spring 63 (see FIGS. 19A and 19B) urges the connector shutter 61 around the shutter shaft portions 61S such that the cover 611 of the connector shutter 61 projects from the housing opening 60H (see FIG. 17A).

The shutter urging spring 63 includes a first coil 631, the above-described earth 632, and a conductive portion 633. The first coil 631, the earth 632, and the conductive portion 633 are constituted of one metal wire. The first coil 631 is a coil spring part compressed between a protrusion 611A (see FIG. 19B), which is formed on the left end portion of the cover 611, and the substrate 621. The earth 632 extends from the upper end portion of the first coil 631 and is locked to the right edge portion of the cover 611. As described above, the earth 632 prevents a leakage or a similar failure at the ground terminal 623 and the input/output terminals 624. The conductive portion 633 is a region that extends from the lower end portion of the first coil 631 and is bent into an approximately U shape in front of the connector shutter 61 and the terminal unit 62. As illustrated in FIG. 17B, the conductive portion 633 is locked to the spring lock portions 607 (see FIG. 18B).

The housing urging spring 64 (see FIGS. 21A and 21B) is compressibly deformable between the connector housing 60 and the main body unit 150. The housing urging spring 64 urges the connector housing 60 around the housing shaft portions 60S in a direction that the ground terminal 623 and the input/output terminals 624 approach the ground terminal 351 and the input/output terminals 352. The housing urging spring 64 includes a second coil 641, a wire 642, and a frame conductive portion 643. The second coil 641 is a coil spring part compressed and deformed between the connector housing 60 and the main body unit 150. The upper end portion of the second coil 641 is locked to the spring lock portions 607 in the connector housing 60 (see FIG. 24A). The lower end portion of the second coil 641 is locked to a spring supporting portion 155B (see FIG. 24A), which is included in the main body unit 150. The wire 642 is a linear part extending from the lower end portion of the second coil 641. The wire 642 is run inside the main body unit 150 (see FIG. 16) to the left side. The frame conductive portion 643, which is constituted of a coiled part and a hook, is formed on the distal end portion of the wire 642. The frame conductive portion 643 is locked to the proximity of an opening open on a unit left wall 150L of the main body unit 150 (see FIG. 16). When the main body unit 150 to which the connector 6 is preliminary mounted is mounted to the inside of the housing 101, the frame conductive portion 643 projecting from the unit left wall 150L contacts a metal frame (not illustrated) of the housing 101. Consequently, the housing urging spring 64 is grounded.

Figure 22A:
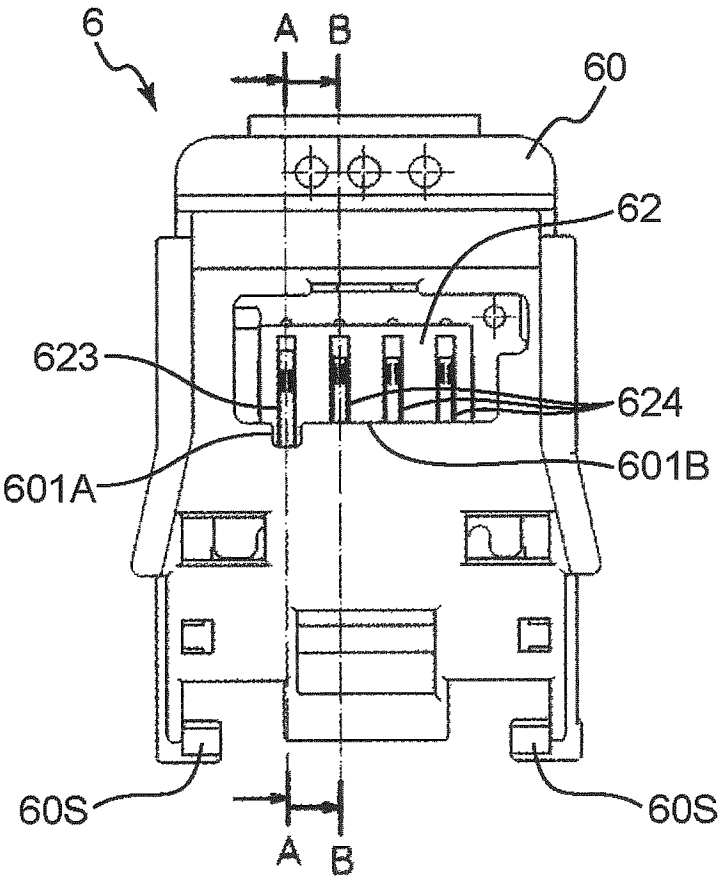
FIG. 22A illustrates a state where the shutter is removed from the connector according to the one embodiment.
Figure 22B:
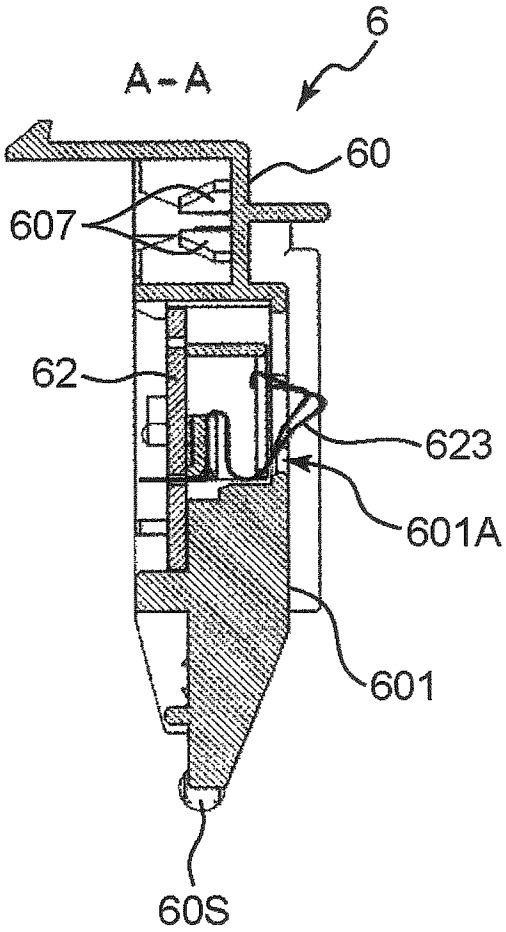
FIG. 22B illustrates a cross section of the connector according to the one embodiment.
Figure 22C:
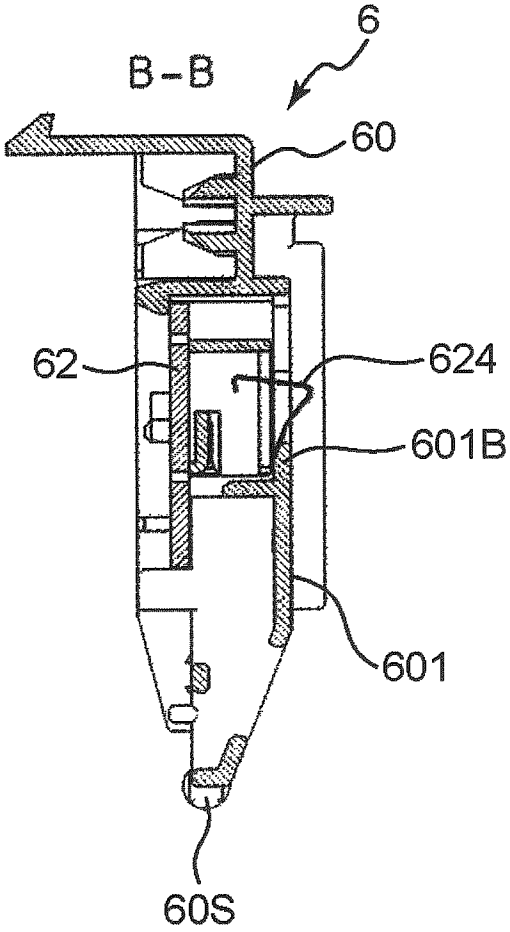
FIG. 22C illustrates a cross section of the connector according to the one embodiment.
Figure 23A:
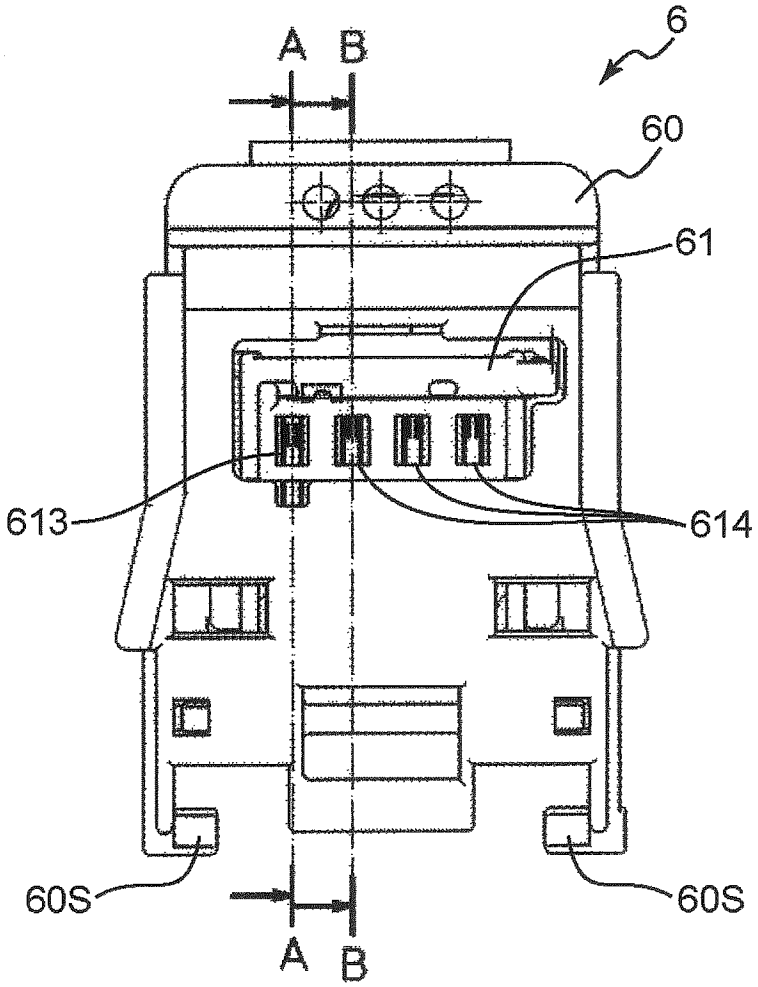
FIG. 23A illustrates the connector according to the one embodiment.
Figure 23B:
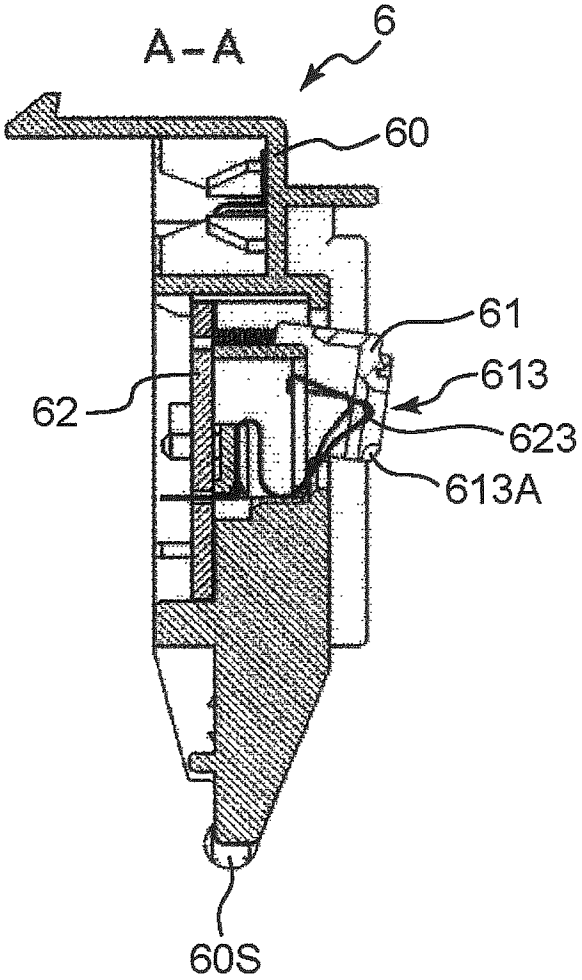
FIG. 23B illustrates a cross section of the connector according to the one embodiment.
Figure 23C:
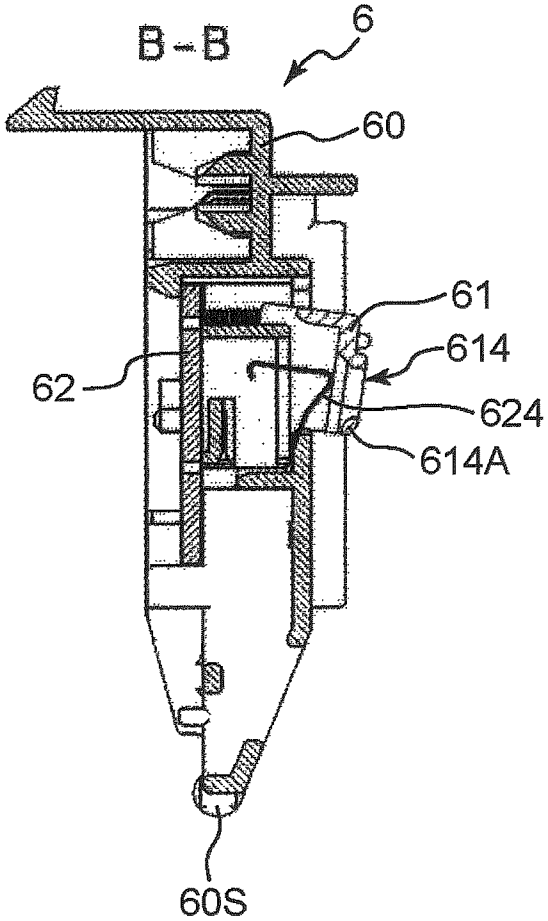
FIG. 23C illustrates a cross section of the connector according to the one embodiment.
Figure 24A:
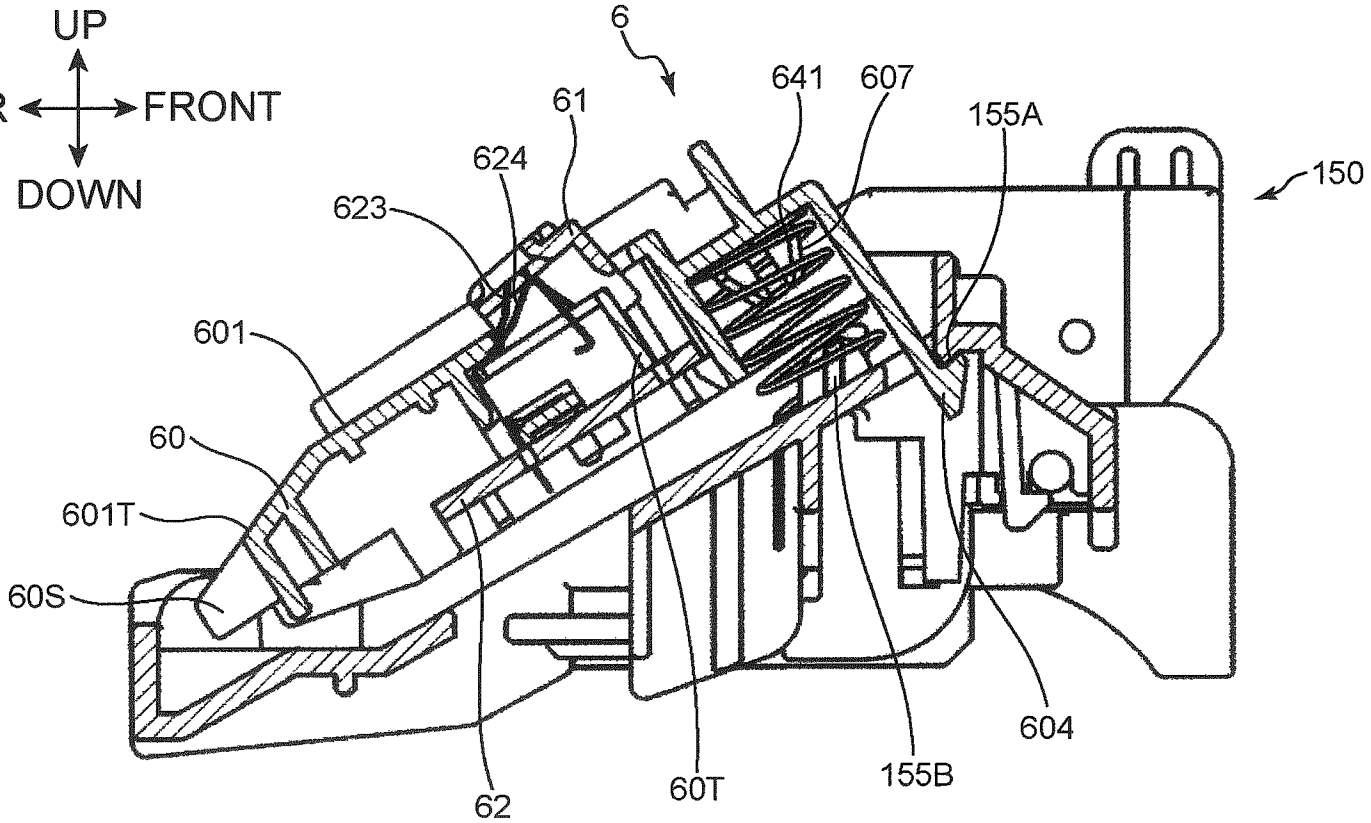
FIG. 24A illustrates a cross section of the connector according to the one embodiment.
Figure 24B:
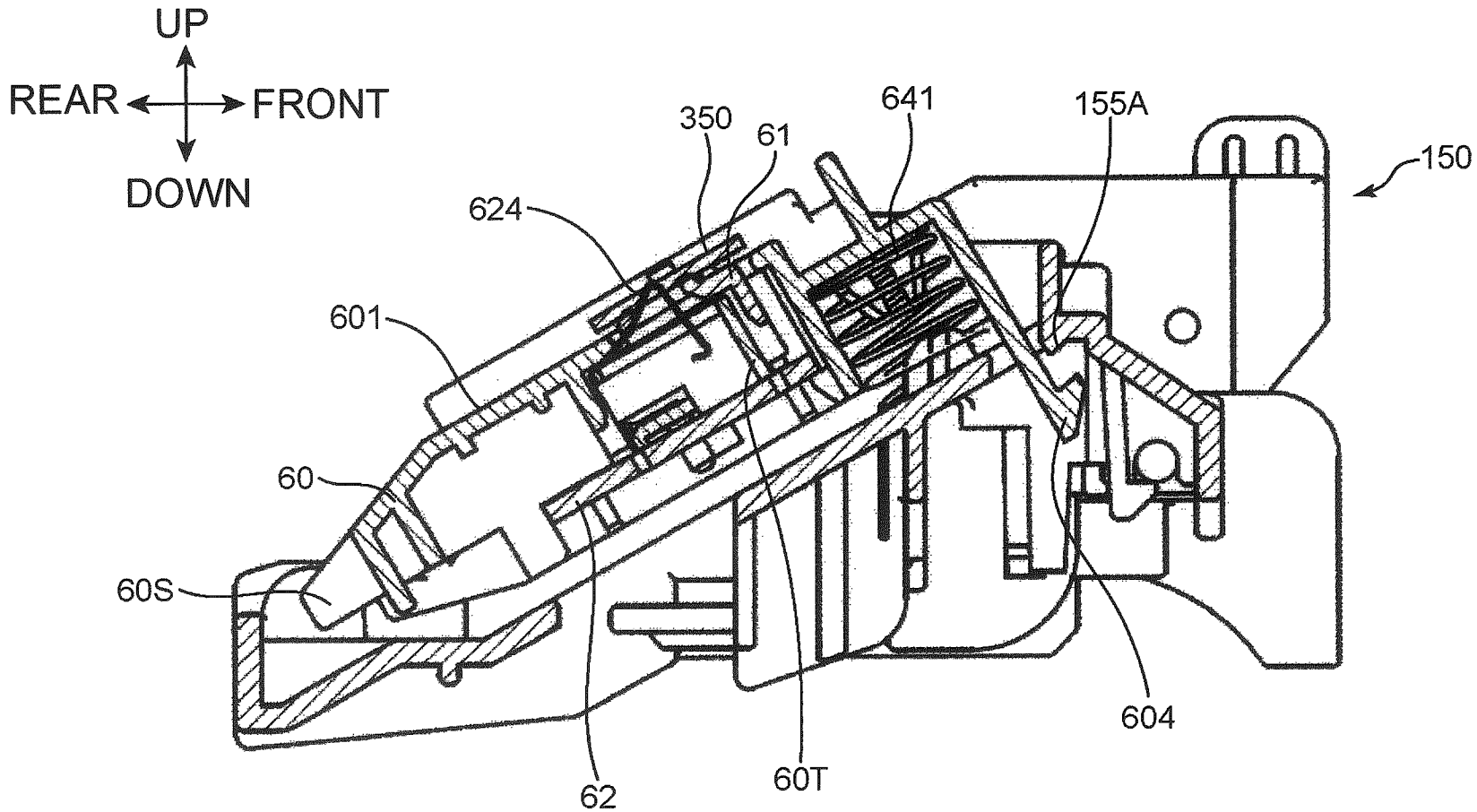
FIG. 24B illustrates a cross section of the connector according to the one embodiment.
Figure 25A:
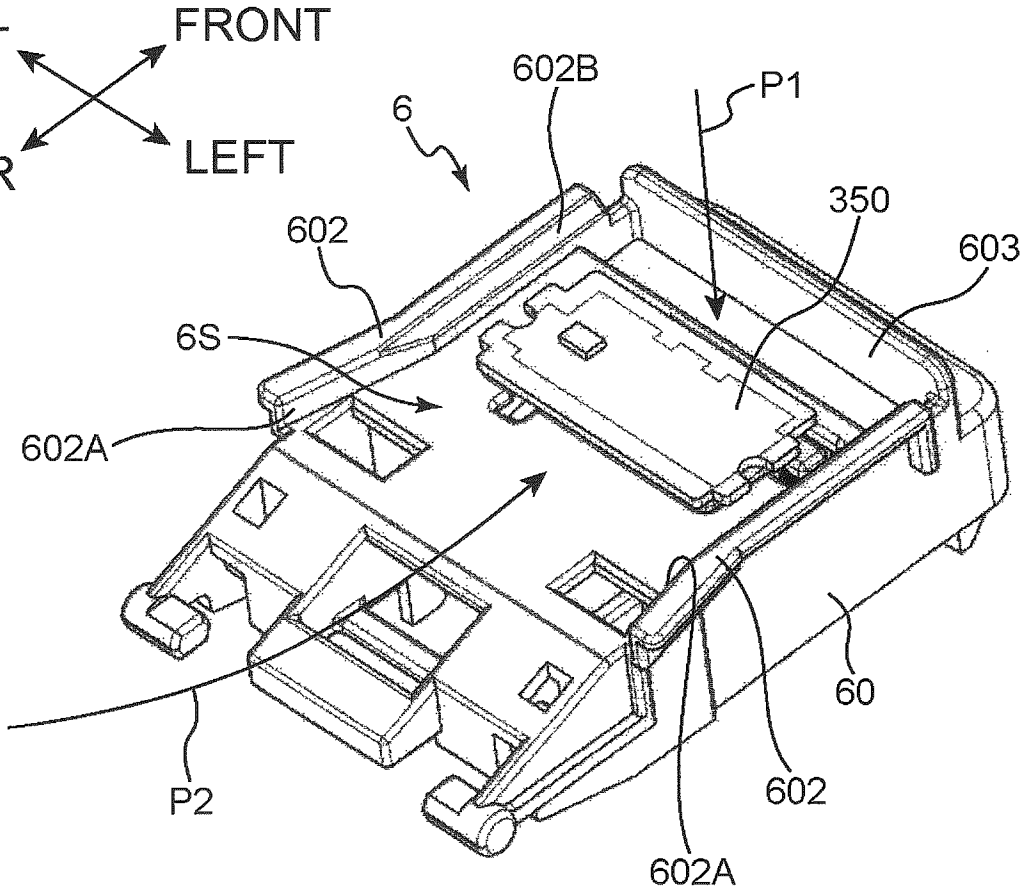
FIG. 25A obliquely illustrates a state where a substrate is housed to the connector according to the one embodiment.
Figure 25B:
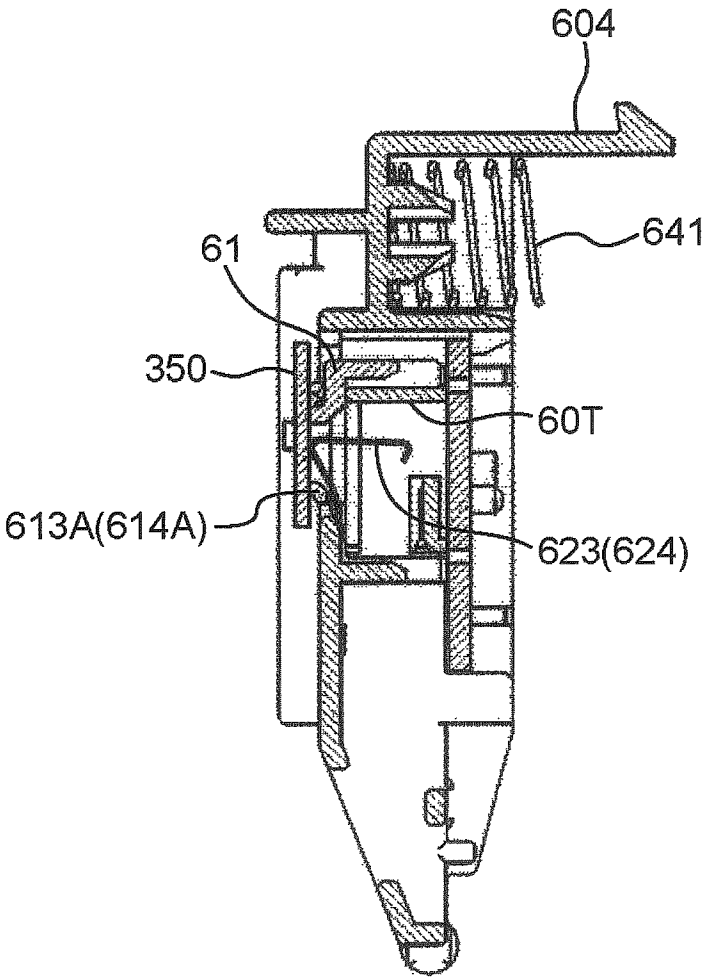
FIG. 25B illustrates a cross section of the connector according to the one embodiment.

The following further describes the mounting of the connector 6 to the main body unit 150 and the functions of the connector 6 in detail referring to FIGS. 22A to 25B in addition to FIGS. 14 to 21B. FIG. 22A illustrates a state where the connector shutter 61 is removed from the connector 6 according to the embodiment. FIG. 22B illustrates a cross section taken along a cut line A-A of the connector 6 in FIG. 22A. FIG. 22C illustrates a cross section taken along a cut line B-B of the connector 6 in FIG. 22A. FIG. 23A illustrates the connector 6. FIG. 23B illustrates a cross section taken along a cut line A-A of the connector 6 in FIG. 23A. FIG. 23C illustrates a cross section taken along a cut line B-B of the connector 6 in FIG. 23A. FIG. 24A illustrates the connector 6 in a state where the toner container 30 is not mounted to the housing 101 in cross section. FIG. 24B illustrates the connector 6 in a state where the toner container 30 is mounted to the housing 101 in cross section. FIG. 25A obliquely illustrates a state where the IC chip 350 is housed in the connector 6. FIG. 25B illustrates a cross section of the connector 6 in FIG. 25A.

The connector 6 is mounted to the main body unit 150 through the following assembly procedure of the connector 6. First, with a posture of the connector shutter 61 such that the support surface 601 (see FIG. 17A) of the connector housing 60 is perpendicular to the legs 612 (see FIG. 19A) of the connector shutter 61, the pair of shutter shaft portions 61S are inserted into a pair of shutter supporting portions 606 of the connector housing 60. Rotationally driving the connector shutter 61 around the shutter shaft portions 61S forward by approximately 90 degrees, the connector shutter 61 is housed inside the connector housing 60. Then, the conductive portion 633 of the shutter urging spring 63 preliminary mounted to the connector shutter 61 is locked to the spring lock portions 607 on the front end side of the connector housing 60 (see FIG. 17B). Further, the terminal unit 62 (see FIG. 20A) is mounted to the inside of the connector housing 60 (see FIG. 17B) so as to compress the first coil 631 with the connector shutter 61. The three substrate engaging claws 605 lock the substrate 621 of the terminal unit 62. With the second coil 641 secured to the spring supporting portion 155B of the main body unit 150, the housing shaft portions 60S of the connector housing 60 are journaled to the connector supporting portions 150J (see FIG. 16). While the spring lock portions 607 on the connector housing 60 compress the upper end portion of the second coil 641, the housing lock claw 604 is locked to the locked portion 155A (see FIG. 24A). When the second coil 641 of the housing urging spring 64 contacts the conductive portion 633 of the shutter urging spring 63 inside the connector housing 60 (see FIG. 21B), the shutter urging spring 63 and the housing urging spring 64 become electrically conductive. Consequently, the earth 632 of the shutter urging spring 63 is grounded via the above-described metal frame of the housing 101.

Figure 18A:
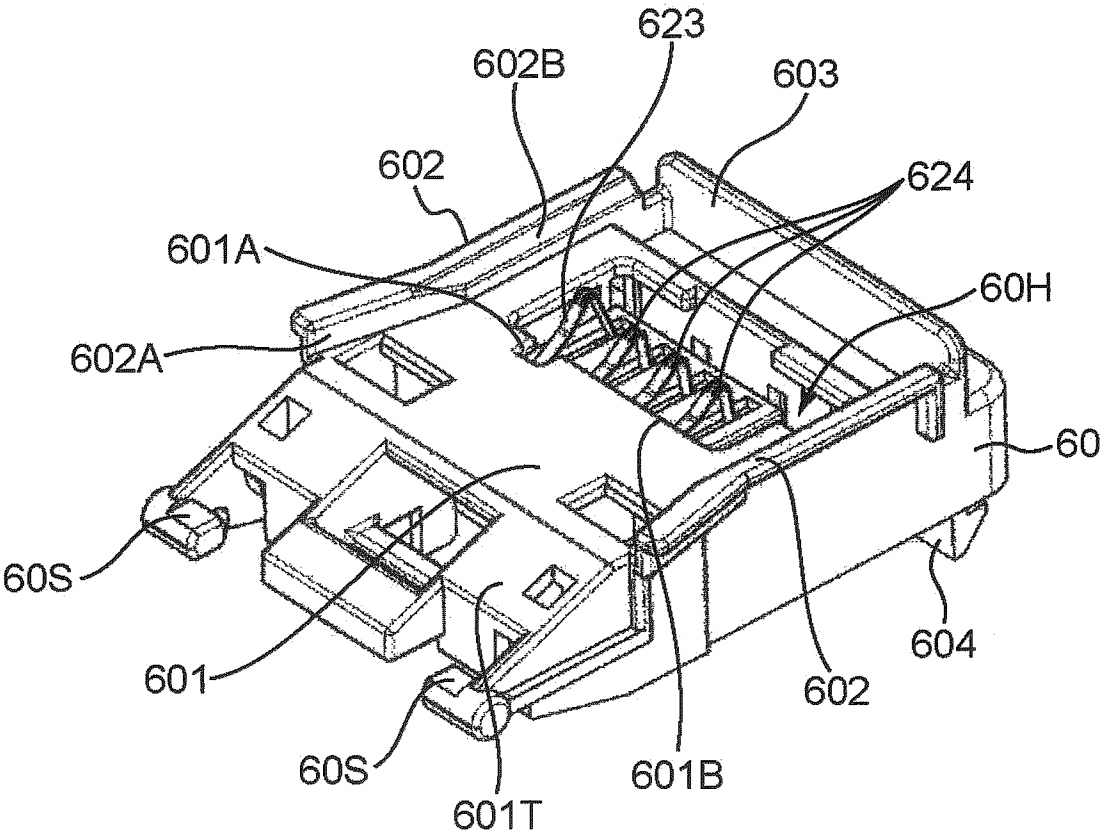
FIG. 18A obliquely illustrates a state where a shutter is removed from the connector according to the one embodiment.
Figure 18B:
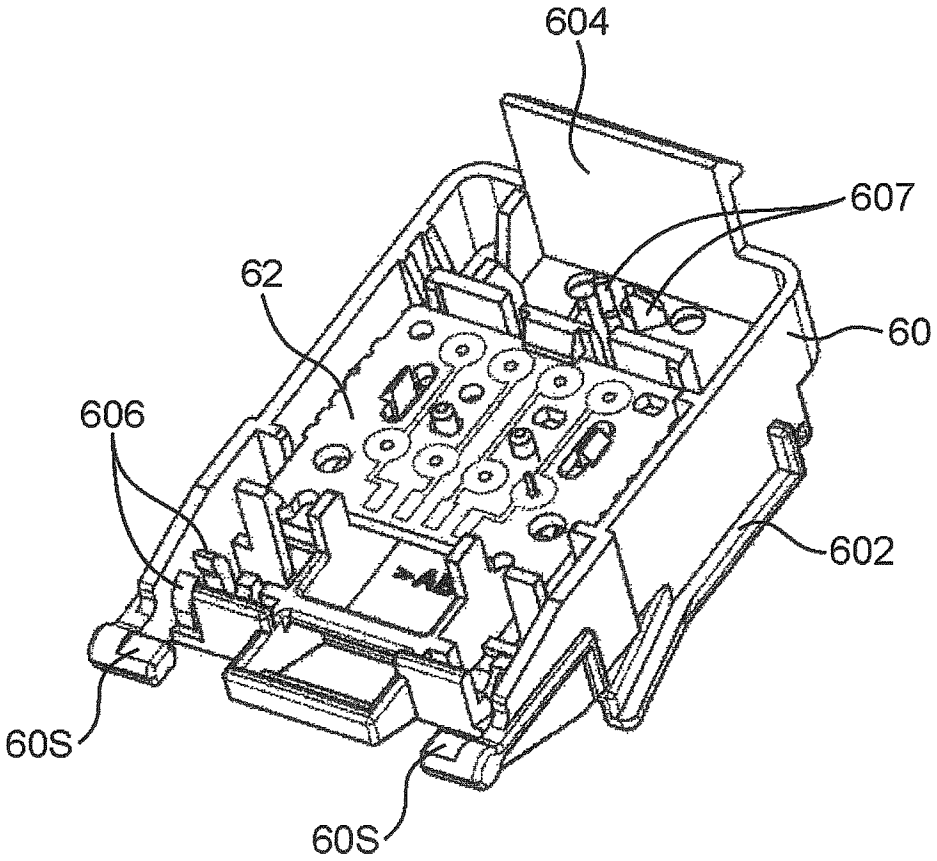
FIG. 18B obliquely illustrates a state where the shutter is removed from the connector according to the one embodiment.

In FIGS. 18A and 22A to 22C, the connector shutter 61 is removed from the connector 6 for explanation. When the connector shutter 61 does not contact the ground terminal 623 and the input/output terminals 624, the ground terminal 623 abuts a rear end edge of the cutout end edge 601A with elastic force (see FIG. 22B). Similarly, the three input/output terminals 624 each abut the opening rear end edge 601B with elastic force (see FIG. 22C). This regulates a maximum amount of projection of the ground terminal 623 and the input/output terminals 624 with respect to the housing opening 60H. This ensures preliminary configuring the amount of projection of terminals, which are likely to cause a contact failure, or a similar member high, thereby preventing the contact failure between the connector 6 and the IC chip 350. Especially in this embodiment, the cutout end edge 601A is notched rearward with respect to the opening rear end edge 601B. Accordingly, as illustrated in FIG. 18A, the maximum amount of projection of the ground terminal 623 with respect to the housing opening 60H is configured larger than a maximum amount of projection of the input/output terminals 624 with respect to the housing opening 60H. Therefore, in both cases where the IC chip 350 enters the chip housing portion 6S from upward (an arrow P1 in FIG. 25A) and where the IC chip 350 enters the chip housing portion 6S from rearward (an arrow P2 in FIG. 25A) in accordance with the mounting of the toner container 30 to the housing 101, the ground terminal 351 is reliably contactable with the ground terminal 623 first among the plurality of the terminals. This prevents the IC chip 350 from being damaged due to the contact failure between the connector 6 and the IC chip 350, a leakage, or a similar failure. After the mounting of the toner container 30, a ground potential of the IC chip 350 is stably maintained, achieving stable transmission and reception of various pieces of information between the IC chip 350 and the printer 100.

Referring to FIG. 25A, when the toner container 30 is mounted to the main-body internal space 107 in the first mounting aspect, guiding the guide pieces 35D on the storage unit 35 by the taper-shaped second guide portions 602B (the arrow P1 in FIG. 25A) locates the IC chip 350 opposed to the support surface 601. On the other hand, when the toner container 30 is mounted to the main-body internal space 107 in the second mounting aspect, guiding the guide pieces 35D on the storage unit 35 to the first guide portions 602A (the arrow P2 in FIG. 25A) locates the IC chip 350 opposed to the support surface 601. In view of this, even when the toner container 30 is mounted in any of the first and the second mounting aspects, the connector 6 and the IC chip 350 are electrically connected smoothly.

Figure 26A:
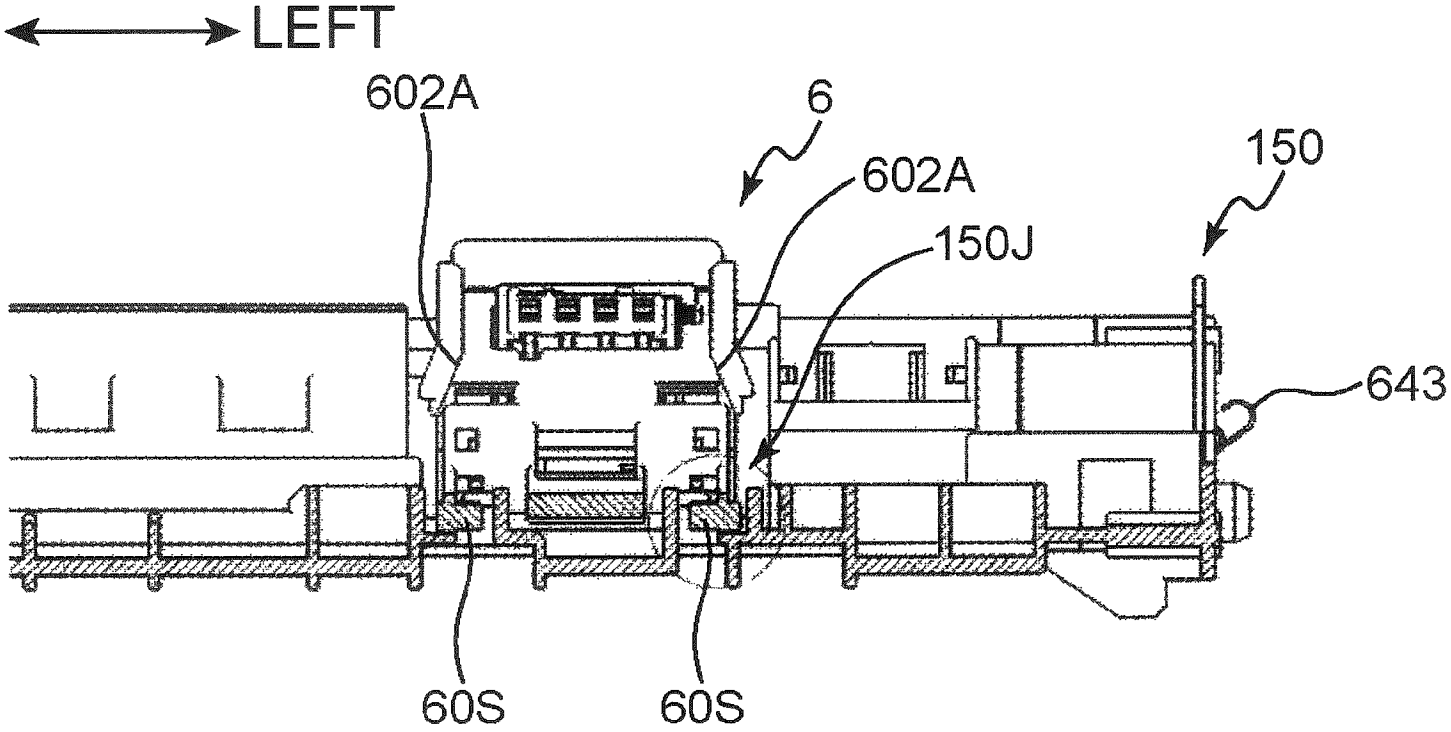
FIG. 26A illustrates a cross section of the guide unit according to the one embodiment.
Figure 26B:
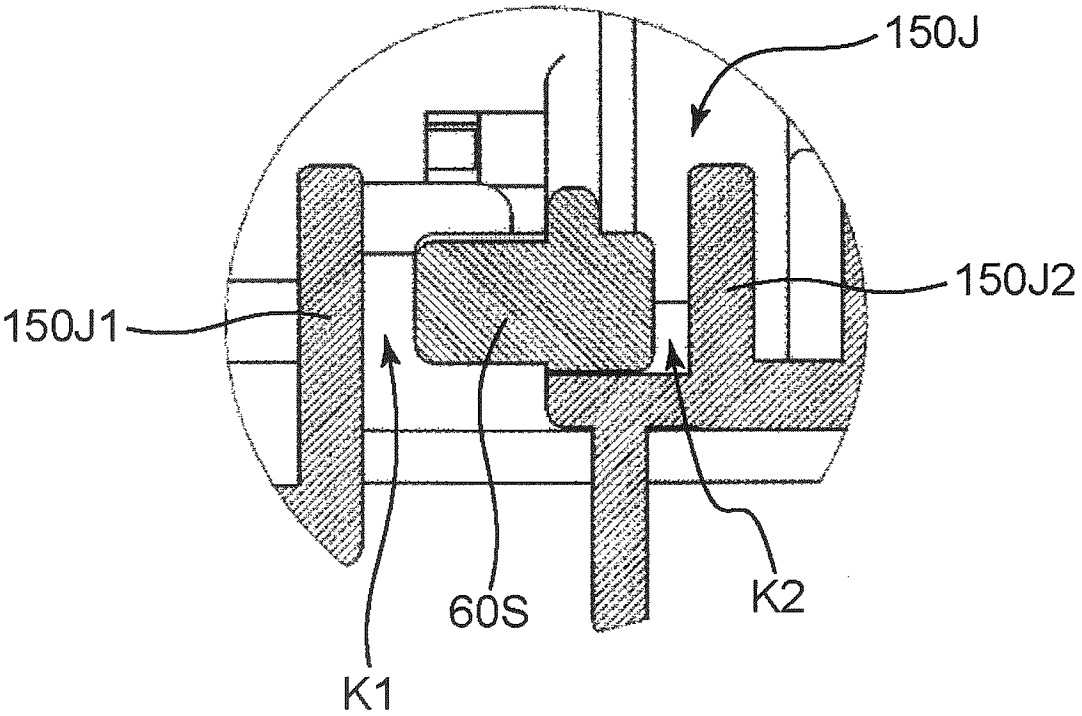
FIG. 26B illustrates a cross section of a part of the enlarged guide unit according to the one embodiment.

FIG. 26A illustrates a cross section of the main body unit 150 according to the embodiment. FIG. 26B is an enlarged cross section at a periphery of the connector supporting portion 150J of the main body unit 150 in FIG. 26A. As illustrated in FIG. 26B, the left connector supporting portion 150J in the pair of connector supporting portions 150J is formed between a first support wall 150J1 and a second support wall 150J2. The right connector supporting portion 150J also has a similar structure. As illustrated in FIG. 26B, mounting the connector 6 to the main body unit 150 forms clearances K1 and K2 between the housing shaft portion 60S and the first support wall 150J1 and between the housing shaft portion 60S and the second support wall 150J2, respectively. In view of this, the connector housing 60 of the connector 6 is supported by the main body unit 150 such that the connector housing 60 is slidably movable in the shaft direction of the housing shaft portions 60S by a predetermined distance. Accordingly, even if a position of the storage unit 35 in an axial direction (a lateral direction) varies when the toner container 30 is mounted in the second mounting aspect, the chip housing portion 6S can internally house the IC chip 350 reliably as indicated by the arrow P2 in FIG. 25A. This electrically and reliably connects the connector 6 and the IC chip 350 smoothly.

When the toner container 30 is not mounted to the housing 101, as illustrated in FIG. 24A, the connector housing 60 is urged upward around the housing shaft portions 60S by the second coil 641. The connector shutter 61 is urged upward around the shutter shaft portions 61S by a urging force from the first coil 631 (see FIG. 19A). In this respect, as illustrated in FIGS. 23B and 23C, the ground terminal 623 and the input/output terminals 624, which project from the housing opening 60H on the connector housing 60, each sink inside the first opening 613 and the second openings 614 of the connector shutter 61. This also stably protects the ground terminal 623 and the input/output terminals 624 physically.

When the toner container 30 is mounted to the housing 101 integrally with the developing device 20 in the first mounting aspect, the IC chip 350 moves downward from the upper portion of the connector 6 in FIG. 24A (the arrow P1 in FIG. 25A). In this respect, while the guide pieces 35D of the storage unit 35 are guided by the second guide portions 602B (see FIG. 25A), the guide pieces 35D press the support surface 601 (see FIG. 24B). This moves down the connector housing 60 around the housing shaft portions 60S against the urging force from the second coil 641. Since the IC chip 350 presses the connector shutter 61 downward, the connector shutter 61 moves down around the shutter shaft portions 61S against the urging force from the first coil 631. Then, a first opening end edge 613A (see FIG. 23B) on the first opening 613 and a second opening end edge 614A (see FIG. 23C) on the second opening 614 additionally regulate the amount of projection of the ground terminal 623 and the input/output terminals 624. Soon, as illustrated in FIGS. 24B and 25B, while the IC chip 350 and the support wall 60T sandwich the connector shutter 61 in the thickness direction of the IC chip 350, the connector housing 60 and the connector shutter 61 stop turning. To show locations of the respective members, FIG. 24B illustrates the input/output terminals 624 and the IC chip 350 so as to overlap. However, as illustrated in FIG. 25B, the IC chip 350 actually presses the input/output terminals 624 downward.

On the other hand, when the toner container 30 is mounted to the developing device 20 inside the housing 101 in the second mounting aspect, the IC chip 350 moves forward from the rear of the connector 6 in FIG. 24A (the arrow P2 in FIG. 25A). In this respect, while the guide pieces 35D of the storage unit 35 are guided by the inclined surface 601T (see FIG. 24A) and the first guide portions 602A (see FIG. 25A), the guide pieces 35D press the support surface 601 (see FIG. 24B). This moves down the connector housing 60 around the housing shaft portions 60S against the urging force from the second coil 641. While the IC chip 350 abuts the connector shutter 61 along the support surface 601, the IC chip 350 presses the connector shutter 61 downward. This moves down the connector shutter 61 around the shutter shaft portions 61S against the urging force from the first coil 631. Soon, as illustrated in FIGS. 24B and 25B, while the IC chip 350 and the support wall 60T sandwich the connector shutter 61 in the thickness direction of the IC chip 350, the connector housing 60 and the connector shutter 61 stop turning.

Thus, when the toner container 30 is mounted to the main-body internal space 107 in the first mounting aspect or the second mounting aspect, this embodiment compresses and deforms the second coil 641 of the housing urging spring 64 to adjust the abutting pressures from the ground terminal 623 and the input/output terminals 624 to the ground terminal 351 and the input/output terminals 352. As illustrated in FIG. 24B, with the toner container 30 mounted, the housing lock claw 604 is separate from the locked portion 155A downward. This restrains the abutment between the respective terminals of the connector 6 and the storage unit 35 at an excessive force and especially prevents the terminals on the IC chip 350 from being damaged.

When the storage unit 35 is located opposed to the connector 6, the connector shutter 61 abuts and is sandwiched between the connector housing 60 and the IC chip 350. This regulates final abutting pressures from the ground terminal 623 and the input/output terminals 624 to the ground terminal 351 and the input/output terminals 352. That is, the connector shutter 61 functions as a spacer, deciding the positions of the IC chip 350 with respect to the terminal unit 62. In view of this, even if the toner container 30 is mounted by any of the mounting aspects or even if the toner container 30 is mounted to the housing 101 several times, the abutting pressure between the terminals of the connector 6 and the storage unit 35 is stably maintained.

The printer 100 that includes the toner container 30 according to the embodiment of the disclosure is described above. Such configuration provides the printer 100 where the contact failure of the storage unit 35 is restrained even if the toner container 30 is removably attachable to the housing 101 by the plurality of postures. The disclosure is not limited to the embodiment and can employ, for example, the following modified embodiments.

(1) The above-described embodiment describes an aspect where the input/output terminals 352 of the storage unit 35 and the input/output terminals 624 of the connector 6 are each located by three; however, the disclosure is not limited to this. The number of the input/output terminals may be one or plural.

(2) The above-described embodiment describes the rotation direction of the toner container 30 when the toner container 30 is mounted to the container mounting portion 20H of the developing device 20 as the arrow DM direction in FIG. 12B; however, the disclosure is not limited to this. The toner container 30 may be mounted to the developing device 20 while being rotationally driven in a direction opposite from the arrow DM in FIG. 12B. In this case, the housing shaft portions 60S of the connector housing 60 are preferably located on a side (the front end side) opposite from the side illustrated in FIG. 16.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body that includes an openable/closable cover member and an internal space;

an image carrier located in the apparatus main body, the image carrier having a circumference surface on which an electrostatic latent image is formed by rotationally driving the image carrier;

a developing device that includes a developer replenishment port to which a developer is replenished and a mounting portion, the developing device being mounted at a developing position with the cover member open, the developing position being opposed to the image carrier in the internal space, the developing device supplying the image carrier with the developer;

a developer housing container that includes a developer discharge port from which the developer is discharged and a storage unit, the developer housing container internally housing the developer, the developer housing container being mountable to the internal space selectably by a first mounting aspect or a second mounting aspect, the first mounting aspect mounting the developer housing container to the internal space integrally with the developing device with the cover member open, the developer housing container being preliminary mounted to the mounting portion of the developing device such that the developer discharge port communicates with the developer replenishment port, the second mounting aspect mounting the developer housing container to the mounting portion of the developing device preliminary mounted to the internal space with the cover member open such that the developer discharge port communicates with the developer replenishment port; and a connector located opposed to the developer housing container in the apparatus main body, the connector being electrically connected to the storage unit in the developer housing container, the developer housing container being mounted to the internal space in the first mounting aspect or the second mounting aspect, wherein the storage unit includes a substrate, a first ground terminal, and a first input/output terminal exposed outside at the substrate, the connector includes:

a connector housing that includes an opening and an end edge, the end edge defining one side portion of the opening; and elastically deformable second ground terminal and second input/output terminal projected from the opening, the second ground terminal and the second input/output terminal contacting the first ground terminal and the first input/output terminal, respectively, by mounting the developer housing container to the internal space, the second ground terminal and the second input/output terminal each abut the end edges on the connector housing with elastic force, the abutment regulating a maximum amount of projection of the second ground terminal and the second input/output terminal with respect to the opening, the end edges include a first end edge and a second end edge, the first end edge defining the side portion of the opening, the second end edge being opposed to the second ground terminal, the second end edge having a shape formed by partially notching the first end edge, and abutting the second ground terminal with the second end edge and abutting the second input/output terminal with the first end edge configure the maximum amount of projection of the second ground terminal with respect to the opening larger than a maximum amount of projection of the second input/output terminal with respect to the opening.

2. An image forming apparatus comprising:

an apparatus main body that includes an openable/closable cover member and an internal space;

an image carrier located in the apparatus main body, the image carrier having a circumference surface on which an electrostatic latent image is formed by rotationally driving the image carrier;

a developing device that includes a developer replenishment port to which a developer is replenished and a mounting portion, the developing device being mounted at a developing position with the cover member open, the developing position being opposed to the image carrier in the internal space, the developing device supplying the image carrier with the developer;

a developer housing container that includes a developer discharge port from which the developer is discharged and a storage unit, the developer housing container internally housing the developer, the developer housing container being mountable to the internal space selectably by a first mounting aspect or a second mounting aspect, the first mounting aspect mounting the developer housing container to the internal space integrally with the developing device with the cover member open, the developer housing container being preliminary mounted to the mounting portion of the developing device such that the developer discharge port communicates with the developer replenishment port, the second mounting aspect mounting the developer housing container to the mounting portion of the developing device preliminary mounted to the internal space with the cover member open such that the developer discharge port communicates with the developer replenishment port; and a connector located opposed to the developer housing container in the apparatus main body, the connector being electrically connected to the storage unit in the developer housing container, the developer housing container being mounted to the internal space in the first mounting aspect or the second mounting aspect, wherein the storage unit includes a substrate, a first ground terminal, and a first input/output terminal exposed outside at the substrate, the connector includes:

a connector housing that includes an opening and an end edge, the end edge defining one side portion of the opening; and elastically deformable second ground terminal and second input/output terminal projected from the opening, the second ground terminal and the second input/output terminal contacting the first ground terminal and the first input/output terminal, respectively, by mounting the developer housing container to the internal space, the second ground terminal and the second input/output terminal each abut the end edges on the connector housing with elastic force, the abutment regulating a maximum amount of projection of the second ground terminal and the second input/output terminal with respect to the opening, the apparatus main body includes a guide unit for guiding an entrance of the developing device into the internal space, the connector housing includes a housing shaft portion turnably journaled to the guide unit, the connector further includes a first urging member, the first urging member being compressibly deformable between the connector housing and the guide unit, the first urging member urging the connector housing around the shaft portion in a direction that the second ground terminal and the second input/output terminal approach the first ground terminal and the first input/output terminal, and when the developer housing container is mounted to the internal space in the first mounting aspect or the second mounting aspect, the compressive deformation of the first urging member adjusts an abutting pressure of the second ground terminal and the second input/output terminal to the first ground terminal and the first input/output terminal.

3. The image forming apparatus according to claim 2, wherein the storage unit in the developer housing container includes a pair of guide pieces located upright so as to sandwich the substrate, the connector housing includes:

an opposed surface on which the opening is open, the opposed surface being located opposed to the storage unit; and a pair of guide portions located upright from the opposed surface so as to sandwich the opening, the pair of guide portions include:

a first guide portion that expands toward a front as approaching the shaft portion in a direction along the opposed surface; and a second guide portion that expands toward a front as away from the opposed surface in a direction perpendicular to the opposed surface, when the developer housing container is mounted to the internal space in the first mounting aspect, guiding the guide pieces on the storage unit to the second guide portion locates the substrate opposed to the opposed surface, and when the developer housing container is mounted to the internal space in the second mounting aspect, guiding the guide pieces on the storage unit to the first guide portion locates the substrate opposed to the opposed surface.

4. The image forming apparatus according to claim 3, wherein the connector housing is supported to the guide unit such that the connector housing is slidably movable in a shaft direction of the housing shaft portion by a predetermined distance.

5. An image forming apparatus comprising:

an apparatus main body that includes an openable/closable cover member and an internal space;

an image carrier located in the apparatus main body, the image carrier having a circumference surface on which an electrostatic latent image is formed by rotationally driving the image carrier;

a developing device that includes a developer replenishment port to which a developer is replenished and a mounting portion, the developing device being mounted at a developing position with the cover member open, the developing position being opposed to the image carrier in the internal space, the developing device supplying the image carrier with the developer;

a developer housing container that includes a developer discharge port from which the developer is discharged and a storage unit, the developer housing container internally housing the developer, the developer housing container being mountable to the internal space selectably by a first mounting aspect or a second mounting aspect, the first mounting aspect mounting the developer housing container to the internal space integrally with the developing device with the cover member open, the developer housing container being preliminary mounted to the mounting portion of the developing device such that the developer discharge port communicates with the developer replenishment port, the second mounting aspect mounting the developer housing container to the mounting portion of the developing device preliminary mounted to the internal space with the cover member open such that the developer discharge port communicates with the developer replenishment port; and a connector located opposed to the developer housing container in the apparatus main body, the connector being electrically connected to the storage unit in the developer housing container, the developer housing container being mounted to the internal space in the first mounting aspect or the second mounting aspect, wherein the storage unit includes a substrate, a first ground terminal, and a first input/output terminal exposed outside at the substrate, the connector includes:

a connector housing that includes an opening and an end edge, the end edge defining one side portion of the opening; and elastically deformable second ground terminal and second input/output terminal projected from the opening, the second ground terminal and the second input/output terminal contacting the first ground terminal and the first input/output terminal, respectively, by mounting the developer housing container to the internal space, the second ground terminal and the second input/output terminal each abut the end edges on the connector housing with elastic force, the abutment regulatinga maximum amount of projection of the second ground terminal and the second input/output terminal with respect to the opening, and the connector further includes:

a plurality of windows each exposing the second ground terminal and the second input/output terminal projecting from the opening; and a shutter that covers the opening.

6. The image forming apparatus according to claim 5, wherein the shutter includes an earth located adjacent to the plurality of windows and grounded.

7. The image forming apparatus according to claim 6, wherein the connector further includes a second urging member for urging the shutter such that the shutter projects from the opening, and the earth is constituted of a part of the second urging member.

8. The image forming apparatus according to claim 5, wherein locating the storage unit opposed to the connector sandwiches the shutter by the connector housing and the substrate to regulate a final abutting pressure of the second ground terminal and the second input/output terminal to the first ground terminal and the first input/output terminal.

* * * * *